US011739669B2

(12) United States Patent
Takami et al.

(10) Patent No.: US 11,739,669 B2
(45) Date of Patent: Aug. 29, 2023

(54) BLOW-BY GAS TREATING DEVICE AND ENGINE INCLUDING BLOW-BY GAS TREATING DEVICE

(71) Applicant: KUBOTA CORPORATION, Osaka (JP)

(72) Inventors: Masayasu Takami, Sakai (JP); Katsunori Ikemachi, Sakai (JP); Yuki Yoshita, Sakai (JP); Masayuki Tochimoto, Sakai (JP); Kazuya Ishida, Sakai (JP); Tomohiro Suzuki, Sakai (JP); Yu Suzuki, Sakai (JP); Toru Suzuki, Sakai (JP); Kentaro Kita, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/786,494

(22) PCT Filed: Mar. 9, 2021

(86) PCT No.: PCT/JP2021/009371
§ 371 (c)(1),
(2) Date: Jun. 16, 2022

(87) PCT Pub. No.: WO2021/187250
PCT Pub. Date: Sep. 23, 2021

(65) Prior Publication Data

US 2022/0403764 A1 Dec. 22, 2022

(30) Foreign Application Priority Data

Mar. 16, 2020 (JP) ..... 2020-045720
Aug. 7, 2020 (JP) ..... 2020-135354
(Continued)

(51) Int. Cl.
*F01M 13/04* (2006.01)
*F01M 11/00* (2006.01)

(52) U.S. Cl.
CPC ..... *F01M 13/04* (2013.01); *F01M 11/0004* (2013.01); *F01M 2011/0033* (2013.01); *F01M 2013/0438* (2013.01)

(58) Field of Classification Search
CPC ..... F01M 13/04; F01M 11/0004; F01M 2011/0033; F01M 2013/0438
See application file for complete search history.

(56) References Cited

U.S. PATENT DOCUMENTS 4,569,323 A * 2/1986 Okumura ..... F01M 13/0416 123/573
2014/0165512 A1* 6/2014 Horiuchi ..... F01M 13/04 55/322
(Continued)

FOREIGN PATENT DOCUMENTS

JP S6039718 U 3/1985
JP H6-53709 U 7/1994
(Continued)

*Primary Examiner* — Syed O Hasan
(74) *Attorney, Agent, or Firm* — Muncy, Geissler, Olds & Lowe, P.C.

(57) ABSTRACT

The blow-by gas treating device 100 has a main structure portion 101 which separates oil OL from the blow-by gas BG and an outlet portion 40 which supplies gas G having been separated from the blow-by gas BG to an intake system. The main structure portion 101 has a first blow-by gas taking-in portion 111, a second blow-by gas taking-in portion 112, a separating portion 330 which separates the blow-by gas BG into oil OL and gas G, a first oil guiding portion 151 which guides the oil OL to a front side, a second oil guiding portion 152 which guides the oil OL to a rear
(Continued)

side, a first oil drain 161 which discharges the oil OL into the engine, and a second oil drain 162 which discharges the oil OL into the engine.

18 Claims, 8 Drawing Sheets

(30) Foreign Application Priority Data

Aug. 7, 2020 (JP) ..... 2020-135355
Aug. 18, 2020 (JP) ..... 2020-138129

(56) References Cited

U.S. PATENT DOCUMENTS

2018/0073404 A1* 3/2018 Yoon ..... F02M 25/06
2018/0207565 A1* 7/2018 Morishita ..... F01M 13/0405

FOREIGN PATENT DOCUMENTS

JP 2001054711 A 2/2001
JP 2010248934 A 11/2010
JP 2016-114035 A 6/2016
JP 2018-119474 A 8/2018

* cited by examiner

BLOW-BY GAS TREATING DEVICE AND ENGINE INCLUDING BLOW-BY GAS TREATING DEVICE

TECHNICAL FIELD

The present invention relates to a blow-by gas treating device, which is mounted on an internal combustion engine such as a diesel engine or the like, separates the blow-by gas into oil and gas, and supplies the gas to an intake system of an engine, and an engine including a blow-by gas treating device.

BACKGROUND ART

A blow-by gas filter is built in a head cover of a diesel engine, for example. The blow-by gas filter separates the blow-by gas into oil and gas such as unburned gas or the like. However, in an ordinary diesel engine, a discharge path of the oil and a discharge path of the gas are not clearly discriminated in some cases.

PTL 1 discloses a breather device which prevents flow-out of oil. In the breather device described in PTL 1, a front-side breather chamber and a rear-side breather chamber are provided in a head cover chamber, and a breather outlet is provided at a center part. The breather outlet is connected to the front-side breather chamber and the rear-side breather chamber by an air passage. When the engine is inclined to a front side or a rear side, even if the oil intrudes into the front-side breather chamber or the rear-side breather chamber, the breather device described in PTL 1 can avoid intrusion of the oil into a portion leading to the breather outlet from either one of the front-side breather chamber and the rear-side breather chamber. Thus, the gas can be discharged from the front-side breather chamber and the rear-side breather chamber without accompanying the flow-out of the oil.

However, in the breather device described in PTL 1, the discharge path of the oil having been separated in the front-side breather chamber and the rear-side breather chamber is not clearly disclosed. That is, the discharge path of the oil having been separated in the front-side breather chamber and the rear-side breather chamber and the discharge path of the gas having been separated in the front-side breather chamber and the rear-side breather chamber are not clearly discriminated. Thus, when the engine is inclined in a front-back direction, the oil having been separated from the blow-by gas is not sufficiently discharged and is emitted to an outside of the engine from a discharge port (outlet) of the blow-by gas treating device in some cases. In this point, the breather device described in PTL 1 has a room for improvement.

Moreover, in the breather device as described in PTL 1, an oil separating material such as glass wool provided in the breather chamber cannot completely separate the blow-by gas into the oil and the gas in some cases. For example, the oil contained in the blow-by gas is not completely separated from the blow-by gas by the oil separating material and slightly passes through the oil separating material in some cases. And there is a concern that the oil having passed the oil separating material remains in the air passage, the breather outlet or the like described in PTL 1, for example.

If the oil remains in the air passage, the breather outlet or the like, since an internal pressure in the air passage or the breather outlet is relatively high, the remaining oil could delude from a vicinity of the breather outlet to the outside of the engine, for example.

Alternatively, if the oil remains in the air passage, the breather outlet or the like, the remaining oil is mixed with steam contained in the blow-by gas and becomes emulsion in some cases. If the emulsion is generated, there is a concern that a path of the blow-by gas such as the air passage, the breather outlet or the like is blocked. If the path of the blow-by gas is blocked, the internal pressure of the engine rises, and there is a concern that components such as an oil gauge guide or the like provided in a crank case, for example, is broken. Moreover, if the path of the blow-by gas is blocked, the internal pressure of the engine rises, and there is a concern that a turbocharger sucks the oil.

As described above, if the oil contained in the blow-by gas remains in the air passage, the breather outlet or the like, nonconformities occur in which the oil deludes to the outside of the engine and the path of the blow-by gas is blocked.

PTL 2 discloses an oil mist separator which can improve oil separation efficiency by discharging scattered oil having flown into a gas channel to a cam chamber side at a position away from a position immediately below a gas introduction port. The oil mist separator described in PTL 2 is to separate the oil from the blow-by gas flowing in the gas channel.

Between a cylinder head cover and a baffle plate, a partitioned chamber and a first guide wall are provided with respect to a gas channel including the gas introduction port. The first guide wall extends with downward inclination above the gas introduction port and the chamber toward the gas introduction port and the chamber. In the baffle plate, a drain hole for discharging the oil in the chamber is formed in a horizontal inner bottom part of the chamber.

As a result, the scattered oil having flown into the gas channel in the scattered oil splashed up by rotation of a cam shaft collides against the inclined first guide wall and is led into the chamber along the first guide wall. And the scattered oil in the chamber is discharged to a cam chamber side at a position away from the position immediately below the gas introduction port through the drain hole of the chamber, whereby oil separation efficiency is improved.

However, in the oil mist separator described in PTL 2, the drain hole is formed in the horizontal inner bottom part of the chamber. Thus, even with the drain hole, the inner bottom part of the chamber is in parallel with an installed surface (a horizontal plane, for example) on which the vehicle with the engine mounted is placed. Therefore, even if the drain hole is formed in the horizontal inner bottom surface, there is a concern that the scattered oil remains on the horizontal inner bottom part of the chamber.

The scattered oil contains a moisture (steam). Thus, the moisture contained in the remaining scattered oil can be frozen on the horizontal inner bottom part of the chamber at a low temperature. If the moisture contained in the remaining scattered oil is frozen, blocking occurs in the horizontal inner bottom surface or the drain hole of the chamber. Then, the scattered oil in the chamber cannot pass through the drain hole formed in the horizontal inner bottom part and is not discharged to the cam chamber side at the position away from the position immediately below the gas introduction port. In this point, the oil mist separator described in PTL 2 has a room for improvement.

PTL 3 discloses an oil mist separator for separating an oil mist from the blow-by gas in an internal combustion engine. A separator unit disposed in the oil mist separator described in PTL 3 is constituted by a porous plate made of a synthetic resin through which an orifice for increasing a flow velocity of the blow-by gas is penetrated/formed, a rear frame made of the synthetic resin including an impact plate for receiving the blow-by gas which has become a high-speed flow, and a fibrous material stacked on the impact plate in order to improve separation performances of the oil.

In PTL 3, fibers such as a polyester fiber, an acrylic fiber, an aramid fiber, a PPS (polyphenylene sulfide) fiber and the like, for example, are cited as the fibrous material. And as a form of the fibrous material, fabrics such as unwoven cloth, fleece and the like are cited. And the fibrous materials described in PTL 3 are compressed at an appropriate compression rate by being pressed by leg portions provided on the porous plate and held between the leg portion and the impact plate.

Here, a filter or an element for improving the separation performances of the oil as the fibrous materials described in PTL 3 are preferably held by using a fastening member such as a bolt on which an adhesive is applied, for example, when removal prevention and improvement of holding performances are considered. However, the filter or the element is formed of the aforementioned fibers, glass wool, steel wool or the like, for example. Thus, if the filter or the element is held by using the fastening member, a deformation amount of the filter or the element is varied in accordance with a torque of the fastening member. Then, a form of the filter or the element is not made stable. As a result, holding of the filter or the element by using the fastening member has such a problem that the separation performances of the oil become unstable.

CITATION LIST

Patent Literature

[PTL 1] Japanese Utility Model Application Publication No. (H)6-53709

[PTL 2] Japanese Patent Application Publication No. 2018-119474

[PTL 3] Japanese Patent Application Publication No. 2016-114035

SUMMARY OF INVENTION

Technical Problem

The present invention was made in order to solve the aforementioned problem and has an object to provide a blow-by gas treating device which can suppress emission of the oil having been separated from the blow-by gas from the outlet even if the engine is inclined in a front-back direction and an engine including the blow-by gas treating device.

Alternatively, it has an object to provide a blow-by gas treating device which can suppress remaining of the oil contained in the blow-by gas in an outlet portion and an engine including the blow-by gas treating device.

Alternatively, it has an object to provide a blow-by gas treating device which can suppress freezing of a moisture contained in the oil at a low temperature by suppressing remaining of the oil contained in the blow-by gas and an engine including the blow-by gas treating device.

Alternatively, it has an object to provide a blow-by gas treating device which can realize stable separation performances of the oil when the filter is held by using the fastening member and an engine including the blow-by gas treating device.

Solution to Problem

The aforementioned problem is solved by a blow-by gas treating device according to the present invention, which is a blow-by gas treating device for treating a blow-by gas generated in an engine, the device including: a main structure portion which is provided in a head cover of the engine, takes in and guides the blow-by gas, and separates from the blow-by gas an oil contained in the blow-by gas; and an outlet portion which supplies the gas, which is gas after the oil has been separated from the blow-by gas by the main structure portion and has been guided from the main structure portion, to an intake system of the engine, the device being characterized in that the main structure portion has a first blow-by gas taking-in portion provided on a front side of the engine and taking in the blow-by gas, a second blow-by gas taking-in portion provided on a rear side of the engine and taking in the blow-by gas, a separating portion provided between the first blow-by gas taking-in portion and the second blow-by gas taking-in portion in a front-back direction of the engine and separating the blow-by gas, having been taken in by the first blow-by gas taking-in portion and the second blow-by gas taking-in portion, into the oil and the gas, a first oil guiding portion which is provided from the separating portion toward the front side and guides the oil, having been separated from the blow-by gas by the separating portion, to the front side, a second oil guiding portion which is provided from the separating portion toward the rear side and guiding the oil, having been separated from the blow-by gas by the separating portion, to the rear side, a first oil drain which is provided on the front side, temporarily stores the oil having been guided by the first oil guiding portion and discharges the oil into the engine, and a second oil drain which is provided on the rear side, temporarily stories the oil having been guided by the second oil guiding portion and discharges the oil into the engine.

According to the blow-by gas treating device according to the present invention, the main structure portion of the blow-by gas treating device has the first oil guiding portion, the second oil guiding portion, the first oil drain, and the second oil drain. The first oil guiding portion is provided toward the front side from the separating portion which separates the blow-by gas into the oil and the gas and guides the oil having been separated from the blow-by gas by the separating portion to the front side of the engine. The second oil guiding portion is provided toward the rear side from the separating portion which separates the blow-by gas into the oil and the gas and guides the oil having been separated from the blow-by gas by the separating portion to the rear side of the engine. The first oil drain is provided on the front side of the engine, temporarily stores the oil having been guided by the first oil guiding portion and discharges it into the engine. The second oil drain is provided on the rear side of the engine, temporarily stores the oil having been guided by the second oil guiding portion and discharges it into the engine. As described above, the oil having been separated from the blow-by gas by the separating portion is guided to the front side of the engine by the first oil guiding portion and temporarily stored in the first oil drain and then, discharged into the engine. Moreover, the oil having been separated from the blow-by gas by the separating portion is guided to the rear side of the engine by the second oil guiding portion and temporarily stored in the second oil drain and then, discharged into the engine. Thus, in the blow-by gas treating device according to the present invention, a discharge path of the oil having been separated from the blow-by gas by the separating portion is clear. Moreover, the gas after the oil was separated from the blow-by gas by the main structure portion is led to the outlet portion of the blow-by gas treating device by the main structure portion. And the outlet portion of the blow-by gas treating device supplies the gas having been led by the main structure portion to the intake system of the engine. As described above, in the blow-by gas treating device according to the present invention, the discharge path of the oil having been separated from the blow-by gas by the separating portion and the discharge path of the gas having been separated from the blow-by gas by the separating portion are clearly discriminated. As a result, even if the engine is inclined in the front-back direction, emission of the oil separated from the blow-by gas from the outlet portion can be suppressed.

In the-blow-by gas treating device according to the present invention, the separating portion is preferably characterized by being provided at a center part between the first oil drain and the second oil drain in the front-back direction.

According to the blow-by gas treating device according to the present invention, the separating portion which separates the blow-by gas into the oil and the gas is provided at the center part between the first oil drain which temporarily stores the oil having been guided by the first oil guiding portion and discharges it into the engine and the second oil drain which temporarily stores the oil having been guided by the second oil guiding portion and discharges it into the engine. As described above, the separating portion is provided at a position relatively far from the first oil drain and the second oil drain. Therefore, even if the engine is inclined in the front-back direction, such a state can be suppressed that the oil temporarily stored in the first oil drain and the second oil drain or the oil or the oil mist present above the first oil drain and the second oil drain is mixed in the gas having been separated from the blow-by gas by the separating portion or is re-mixed. As a result, even if the engine is inclined in the front-back direction, emission of the oil separated from the blow-by gas from the outlet portion can be further suppressed.

Moreover, since such a state that the oil or the oil mist is mixed in the gas having been separated from the blow-by gas by the separating portion or is mixed again can be suppressed, emission of the oil having been separated from the blow-by gas from the outlet portion can be suppressed regardless of the position of the outlet portion. As a result, a degree of freedom in selecting an installation position or an installation direction of the outlet portion can be improved.

In the blow-by gas treating device according to the present invention, the first oil guiding portion and the second oil guiding portion are preferably characterized by exhibiting a groove shape.

According to the blow-by gas treating device according to the present invention, since the first oil guiding portion and the second oil guiding portion present the groove shape, even if the engine is inclined in the front-back direction, the oil having been separated from the blow-by gas by the separating portion can be reliably guided to the front side and the rear side of the engine even with a simple structure.

In the blow-by gas treating device according to the present invention, the main structure portion is preferably characterized by having a partition wall portion disposed horizontally along the front-back direction, the first blow-by gas taking-in portion and the second blow-by gas taking-in portion are provided on a lower surface side of the partition wall portion, and the first oil guiding portion and the second oil guiding portion are provided on an upper surface side of the partition wall portion.

According to the blow-by gas treating device according to the present invention, the first blow-by gas taking-in portion and the second blow-by gas taking-in portion which take in the blow-by gas and the first oil guiding portion and the second oil guiding portion which guide the oil are provided separately on positions on the both sides on the upper surface side and the lower surface side through the common partition wall portion. Therefore, the first blow-by gas taking-in portion and the second blow-by gas taking-in portion as well as the first oil guiding portion as well as the second oil guiding portion can be provided on the partition wall portion as single members. Thus, dimensions in an up-down direction of the blow-by gas treating device can be suppressed. Therefore, a height dimension of the head cover in which the blow-by gas treating device is disposed can be kept low, and the height dimension of the engine including the blow-by gas treating device in the head cover can be also kept low.

In the blow-by gas treating device according to the present invention, the separating portion is preferably characterized by having a flow-velocity rise operating portion which raises the flow velocity of the blow-by gas along a vertical direction, a filter through which the blow-by gas, the flow velocity of which has been raised by the flow-velocity rise operating portion, is passed, and an impact plate which extends in a horizontal direction and causes the blow-by gas having passed the filter to be collided and separated into the oil and the gas.

According to the blow-by gas treating device according to the present invention, after having the flow velocity raised by the flow-velocity rise operating portion, the blow-by gas passes through the filter and collides against the impact plate. Thus, the blow-by gas is reliably separated into the oil and the gas excluding the oil mist. Moreover, the flow-velocity rise operating portion raises the flow velocity of the blow-by gas in the vertical direction (up-down direction) at a center position in the front-back direction of the engine. Moreover, the impact plate extends in the horizontal direction and causes the blow-by gas having passed through the filter to be collided. Thus, as compared with a case where the flow-velocity rise operating portion raises the flow velocity of the blow-by gas along the horizontal direction and causes the blow-by gas to collide against the impact plate extending in the vertical direction, a dimension in the up-down direction of the blow-by gas treating device can be kept low.

The aforementioned problem is solved by the blow-by gas treating device according to the present invention, which is a blow-by gas treating device for treating the blow-by gas generated in the engine, the device being characterized by including the separating portion which is provided in the head cover of the engine and separates the blow-by gas, having been taken in from the blow-by gas taking-in portion, into the oil and the gas and the outlet portion which supplies the gas, which is the gas after the oil has been separated from the blow-by gas by the separating portion and is led from the separating portion, to the intake system of the engine, wherein the outlet portion has an oil guiding surface for guiding the oil remaining in the gas after having been separated from the blow-by gas into the head cover.

According to the blow-by gas treating device according to the present invention, the outlet portion has the oil guiding surface for guiding the oil remaining in the gas after having been separated from the blow-by gas into the head cover. As a result, even if the oil remains in the gas after having been separated from the blow-by gas by the separating portion, the blow-by gas treating device according to the present invention can suppress the remaining of the oil contained in the blow-by gas in the outlet portion.

In the blow-by gas treating device according to the present invention, the outlet portion is preferably characterized by having an outlet mounting portion having a through hole which is provided in an upper part of the head cover and through which the gas is passed and a container body which is mounted on the outlet mounting portion and temporarily stores the gas having passed through the through hole and supplies the gas to the intake system, in which the oil guiding surface is an oil-guiding inclined surface inclined downward toward the through hole from a mating surface between the outlet mounting portion and the container body.

According to the blow-by gas treating device according to the present invention, the oil guiding surface is the oil-guiding inclined surface inclined downward toward the through hole from the mating surface between the outlet mounting portion and the container body. Thus, the oil remaining in the gas after having been separated from the blow-by gas by the separating portion flows downward toward the through hole on the oil-guiding inclined surface, passes through the through hole, and is reliably guided into the head cover. As a result, the blow-by gas treating device according to the present invention can suppress the remaining of the oil contained in the blow-by gas in the outlet portion more reliably.

In the blow-by gas treating device according to the present invention, the oil-guiding inclined surface is preferably characterized by being formed over an entire region from the mating surface to an inner surface of the through hole.

According to the blow-by gas treating device according to the present invention, the oil-guiding inclined surface is formed over the entire region from the mating surface between the outlet mounting portion and the container body to the inner surface of the through hole. Therefore, the oil remaining in the gas after having been separated from the blow-by gas by the separating portion is suppressed from being caught or remaining at least at a part of the outlet portion but flows smoothly downward toward the through hole on the oil-guiding inclined surface. Then, the oil having flown toward the through hole on the oil-guiding inclined surface passes through the through hole and is guided into the head cover more reliably. As a result, the blow-by gas treating device according to the present invention can suppress the remaining of the oil contained in the blow-by gas in the outlet portion more reliably.

In the blow-by gas treating device according to the present invention, the oil-guiding inclined surface is preferably characterized by exhibiting a part of a surface of a pyramid.

According to the blow-by gas treating device according to the present invention, since the oil-guiding inclined surface presents a part of the pyramid surface, the oil remaining in the gas after having been separated from the blow-by gas by the separating portion can smoothly flow downward toward the through hole on the oil-guiding inclined surface.

The blow-by gas treating device according to the present invention is preferably characterized by further including a guiding wall portion which is provided in the head cover and guides the gas after having been separated from the blow-by gas to the outlet portion and an oil guiding portion which guides the oil, having been separated from the blow-by gas by the separating portion, to the oil drain, and the oil having been guided by the oil guiding surface from the outlet portion into the head cover flows on the guiding wall portion and is led to the oil guiding portion.

According to the blow-by gas treating device according to the present invention, the oil having been guided by the oil guiding surface from the outlet portion into the head cover flows on the guiding wall portion and is led to the oil guiding portion. The oil guiding portion guides the oil having been separated from the blow-by gas by the separating portion to the oil drain and can guide the oil having been guided by the oil guiding surface from the outlet portion into the head cover to the oil drain. As a result, the oil having been separated from the blow-by gas is recovered into an oil pun or an oil container provided in the engine, for example, and emission from the outlet portion is suppressed.

The problem is solved by the blow-by gas treating device according to the present invention, which is a blow-by gas treating device for treating the blow-by gas generated in the engine, the device being characterized by including the separating portion which separates the blow-by gas, taken in from the blow-by gas taking-in portion, into the oil and the gas and the oil guiding portion which guides the oil having been separated from the blow-by gas by the separating portion, wherein the separating portion is provided with inclination in a direction in which the oil having been separated from the blow-by gas by the separating portion is guided to the oil guiding portion.

According to the blow-by gas treating device according to the present invention, the separating portion is provided with inclination in the direction in which the oil having been separated from the blow-by gas by the separating portion is guided to the oil guiding portion. Thus, the oil having been separated from the blow-by gas by the separating portion does not remain in the separating portion but is led to the oil guiding portion. As a result, the blow-by gas treating device according to the present invention suppresses remaining of the oil contained in the blow-by gas and can suppress freezing of the moisture contained in the oil at a low temperature. As a result, an operation by the separating portion of separating the blow-by gas into the oil and the gas can be performed more reliably.

In the blow-by gas treating device according to the present invention, the separating portion is preferably characterized by having the flow-velocity rise operating portion which raises the flow velocity of the blow-by gas in a direction inclined with respect to the vertical direction, the filter through which the blow-by gas, the flow velocity of which has been raised by the flow-velocity rise operating portion, is passed, and the impact plate which causes the blow-by gas having passed the filter to be collided and separated into the oil and the gas, in which the surface of the flow-velocity rise operating portion faced with the impact plate is inclined downward toward the oil guiding portion.

According to the blow-by gas treating device according to the present invention, the flow-velocity rise operating portion causes the blow-by gas to collide against the impact plate while raising the flow velocity of the blow-by gas along a direction inclined with respect to the vertical direction (up-down direction). As a result, the blow-by gas is reliably separated into the oil and the gas. Then, the oil having been separated from the blow-by gas at the impact plate passes through the filter and falls onto a surface of the flow-velocity rise operating portion faced with the impact plate. Here, the surface of the flow-velocity rise operating portion is inclined downward toward the oil guiding portion. Thus, the oil having fallen onto the surface of the flow-velocity rise operating portion flows by its own weight on the surface of the flow-velocity rise operating portion and is led to the oil guiding portion. As a result, the blow-by gas treating device according to the present invention can suppress the remaining of the oil contained in the blow-by gas more reliably and can suppress the freezing of the moisture contained in the oil at a low temperature more reliably.

The blow-by gas treating device according to the present invention is preferably characterized in that a setting portion on which the filter and the impact plate are placed and which inclines the filter and the impact plate downward toward the oil guiding portion is further provided, and the flow-velocity rise operating portion has a throttle hole which causes the blow-by gas to pass therethrough and to be supplied to the filter, and an axis of the throttle hole extends along the direction inclined with respect to the vertical direction and intersects an inner surface of the impact plate.

According to the blow-by gas treating device according to the present invention, the setting portion on which the filter and the impact plate are placed is further provided. The setting portion inclines the filter and the impact plate downward toward the oil guiding portion. Moreover, the flow-velocity rise operating portion has the throttle hole which causes the blow-by gas to be passed and supplied it to the filter. And the axis of the throttle hole intersects the inner surface of the impact plate. Thus, the blow-by gas which has passed through the throttle hole of the flow-velocity rise operating portion and whose flow velocity has risen perpendicularly collides against the inner surface of the impact plate. As a result, the blow-by gas receives a strong impact force from the impact plate and is reliably separated into the oil and the gas. And since the axis of the throttle hole extends along the direction inclined with respect to the vertical direction, the oil having been separated from the blow-by gas at the impact plate falls onto the surface of the flow-velocity rise operating portion toward a direction (that is, the vertical direction) different from the flow direction of the blow-by gas which collides against the inner surface of the impact plate. Thus, entry of the oil having been separated from the blow-by gas at the impact plate into the throttle hole is suppressed, and blocking of the throttle hole can be suppressed. As a result, the operation of causing the blow-by gas to collide against the impact plate and of separating it into the oil and the gas is performed more reliably.

In the blow-by gas treating device according to the present invention, the flow-velocity rise operating portion is preferably characterized by having a plurality of the throttle holes, in which the plurality of throttle holes are disposed at positions shifted from each other in a direction intersecting the inclination direction of the surface of the flow-velocity rise operating portion.

According to the blow-by gas treating device according to the present invention, the entry of the oil led to the oil guiding portion along the inclination direction of the surface of the flow-velocity rise operating portion into the throttle hole disposed on the downstream side in the plurality of throttle holes, for example, is suppressed, and the blocking of the throttle hole on the downstream side can be suppressed. As a result, the operation of causing the blow-by gas to collide against the impact plate and of separating it into the oil and the gas is performed more reliably.

In the blow-by gas treating device according to the present invention, the setting portion is preferably characterized by protruding outward from the surface of the flow-velocity rise operating portion and forms an oil-guiding clearance region as a space between the flow-velocity rise operating portion and the filter, and the oil having been separated from the blow-by gas by the separating portion flows along the surface of the flow-velocity rise operating portion in the oil-guiding clearance region.

According to the blow-by gas treating device according to the present invention, the setting portion on which the filter is placed protrudes outward from the surface of the flow-velocity rise operating portion and forms the oil-guiding clearance region as the space between the flow-velocity rise operating portion and the filter. And the oil having been separated from the blow-by gas by the separating portion flows along the surface of the flow-velocity rise operating portion in the oil-guiding clearance region. As a result, the remaining of the oil having been separated from the blow-by gas on the surface of the flow-velocity rise operating portion is suppressed more reliably, and the oil having been separated from the blow-by gas is led toward the oil guiding portion from the oil-guiding clearance region formed between the flow-velocity rise operating portion and the filter more reliably.

The blow-by gas treating device according to the present invention is preferably characterized by further including an oil-outlet inclined-guiding portion connected to the surface of the flow-velocity rise operating portion and the oil guiding portion, and inclined downward toward the oil guiding portion from the surface of the flow-velocity rise operating portion, and moreover leading the oil having flown along the surface of the flow-velocity rise operating portion to the oil guiding portion, in which an inclination angle of the oil-outlet inclined-guiding portion with respect to the horizontal plane is larger than an inclination angle with respect to a horizontal plane of the surface of the flow-velocity rise operating portion.

According to the blow-by gas treating device according to the present invention, the oil-outlet inclined-guiding portion is further provided. The oil-outlet inclined-guiding portion is connected to the surface of the flow-velocity rise operating portion and the oil guiding portion and is inclined downward toward the oil guiding portion from the surface of the flow-velocity rise operating portion. And the oil-outlet inclined-guiding portion guides the oil having flown along the surface of the flow-velocity rise operating portion to the oil guiding portion. Here, the inclination angle of the oil-outlet inclined-guiding portion with respect to the horizontal plane is larger than the inclination angle of the surface of the flow-velocity rise operating portion with respect to the horizontal plane. As a result, the oil-outlet inclined-guiding portion can rapidly lead the oil having been separated from the blow-by gas by the separating portion and flown along the surface of the flow-velocity rise operating portion to the oil guiding portion. Moreover, the remaining of the oil in the vicinity of the surface of the flow-velocity rise operating portion is suppressed, and mixing of the oil having been separated from the blow-by gas by the separating portion in the blow-by gas again can be suppressed.

The blow-by gas treating device according to the present invention is preferably characterized by further including an oil inclined-guiding return portion provided on an opposite side to the oil-outlet inclined-guiding portion when seen from the oil guiding portion and is formed with inclination to have a counter gradient to a gradient of the oil-outlet inclined-guiding portion from the lowest part of the oil-outlet inclined-guiding portion.

According to the blow-by gas treating device according to the present invention, the oil inclined-guiding return portion is further provided. The oil inclined-guiding return portion is provided on the side opposite to the oil-outlet inclined-guiding portion when seen from the oil guiding portion. Moreover, the oil inclined-guiding return portion is formed with the counter gradient to the gradient of the oil-outlet inclined-guiding portion from the lowest part of the oil-outlet inclined-guiding portion. Thus, the oil inclined-guiding return portion suppresses flow-out from the oil-outlet inclined-guiding portion and the oil guiding portion by momentum of the oil flow when the oil having been separated from the blow-by gas by the separating portion flows from the surface of the flow-velocity rise operating portion via the oil-outlet inclined-guiding portion, and can store the oil temporarily. And the oil inclined-guiding return portion can guide and return the oil to the oil guiding portion.

In the blow-by gas treating device according to the present invention, it is preferably characterized in that, in the direction in which the oil guiding portion extends, a length of the oil inclined-guiding return portion is longer than a length of the oil-outlet inclined-guiding portion.

According to the blow-by gas treating device according to the present invention, even if the oil having been separated from the blow-by gas by the separating portion flows in from the surface of the flow-velocity rise operating portion via the oil-outlet inclined-guiding portion, after storing the oil with allowance while suppressing overflow of the flowing-in oil, the oil inclined-guiding return portion can allow the oil to flow and to return into the oil guiding portion.

The problem is solved by the blow-by gas treating device according to the present invention, which is a blow-by gas treating device for treating the blow-by gas generated in the engine, the device being characterized by including the separating portion which separates the blow-by gas, taken in from the blow-by gas taking-in portion, into the oil and the gas, wherein the separating portion has the flow-velocity rise operating portion which raises the flow velocity of the blow-by gas, the filter through which the blow-by gas, the flow velocity of which has been raised by the flow-velocity rise operating portion, is passed, the impact plate which causes the blow-by gas having passed through the filter to be collided and separated into the oil and the gas, the fastening member which is fastened to the flow-velocity rise operating portion and holds the filter between the flow-velocity rise operating portion and the impact plate, and a deformation suppressing member which is disposed between the flow-velocity rise operating portion and the impact plate and suppresses deformation of the filter caused by the fastening of the fastening member.

According to the blow-by gas treating device according to the present invention, the filter of the separating portion which separates the blow-by gas into the oil and the gas is held between the flow-velocity rise operating portion and the impact plate by the fastening member being fastened to the flow-velocity rise operating portion. Here, the deformation suppressing member is disposed between the flow-velocity rise operating portion and the impact plate. The deformation suppressing member suppresses deformation of the filter held between the flow-velocity rise operating portion and the impact plate caused by the fastening of the fastening member. As a result, when the filter is held by using the fastening member, the deformation of the filter can be suppressed. For example, variation in a deformation amount of the filter in accordance with a torque of the fastening member or an unstable shape of the filter can be suppressed. As a result, when the filter is held by using the fastening member, stable oil separation performances can be realized.

In the blow-by gas treating device according to the present invention, the fastening member is preferably characterized by having a shaft part fastened to the flow-velocity rise operating portion and a head part provided on one of end portions of the shaft part, in which the deformation suppressing member is a cylindrical member having a hole through which the shaft part is passed and is disposed between the flow-velocity rise operating portion and the head part in a state where the shaft part is passed through the hole.

According to the blow-by gas treating device according to the present invention, the deformation suppressing member is a cylindrical member having the hole through which the shaft part of the fastening member is passed. And the deformation suppressing member is disposed between the flow-velocity rise operating portion and the head part of the fastening member in the state where the shaft part of the fastening member is passed through the hole of the deformation suppressing member. Thus, the deformation suppressing member can receive a force transmitted from the flow-velocity rise operating portion and the head part of the fastening member by the fastening of the fastening member between the flow-velocity rise operating portion and the head part of the fastening member. Thus, the deformation suppressing member can suppress deformation of the filter held between the flow-velocity rise operating portion and the impact plate caused by the fastening of the fastening member more reliably. As a result, when the filter is held by using the fastening member, the stable oil separation performances can be realized more reliably.

In the blow-by gas treating device according to the present invention, the deformation suppressing member is preferably characterized by receiving by an end portion of the cylindrical member the force transmitted from the head part through the impact plate and the force transmitted from the flow-velocity rise operating portion by the fastening of the fastening member.

According to the blow-by gas treating device according to the present invention, the deformation suppressing member receives the force transmitted from the head part of the fastening member through the impact plate and the force transmitted from the flow-velocity rise operating portion by the fastening of the fastening member by the end portion of the cylindrical member. Thus, the deformation suppressing member can receive the force transmitted from the head part of the fastening member, which is the force made relatively uniform via the impact plate, by the end portion. Thus, the deformation suppressing member can suppress the deformation of the filter held between the flow-velocity rise operating portion and the impact plate caused by the fastening of the fastening member more reliably. As a result, when the filter is held by using the fastening member, the stable oil separation performances can be realized more reliably.

In the blow-by gas treating device according to the present invention, it is preferably characterized in that the length of the deformation suppressing member in an axial direction of the hole is equal to a thickness of the filter.

According to the blow-by gas treating device according to the present invention, the length in the axial direction of the hole of the deformation suppressing member is equal to the thickness of the filter. Thus, the deformation suppressing member can suppress such a state that the filter is crushed to a length shorter than the length in the axial direction of the hole of the deformation suppressing member. Thus, the variation in the deformation amount of the filter in accordance with the torque of the fastening member can be suppressed more reliably. As a result, when the filter is held by using the fastening member, the stable oil separation performances can be realized.

The problem is solved by an engine according to the present invention including any one of the aforementioned blow-by gas treating devices.

According to the engine including the blow-by gas treating device according to the present invention, a main structure portion of the blow-by gas treating device included in the engine has a first oil guiding portion, a second oil guiding portion, a first oil drain, and a second oil drain. The first oil guiding portion is provided from the separating portion for separating the blow-by gas into the oil and the gas toward the front side and guides the oil having been separated from the blow-by gas by the separating portion to the front side of the engine. The second oil guiding portion is provided from the separating portion for separating the blow-by gas into the oil and the gas toward the rear side and guides the oil having been separated from the blow-by gas by the separating portion to the rear side of the engine. The first oil drain is provided on the front side of the engine and temporarily stores the oil having been guided by the first oil guiding portion and discharges it into the engine. The second oil drain is provided on the rear side of the engine and temporarily stores the oil having been guided by the second oil guiding portion and discharges it into the engine. As described above, the oil having been separated from the blow-by gas by the separating portion is guided to the front side of the engine by the first oil guiding portion and is temporarily stored in the first oil drain and then, is discharged into the engine. Moreover, the oil having been separated from the blow-by gas by the separating portion is guided to the rear side of the engine by the second oil guiding portion and is temporarily stored in the second oil drain and then, is discharged into the engine. Thus, in the engine including the blow-by gas treating device according to the present invention, the discharge path of the oil having been separated from the blow-by gas by the separating portion is clear. Moreover, the gas after the oil has been separated from the blow-by gas by the main structure portion is led to the outlet portion of the blow-by gas treating device by the main structure portion. Then, the outlet portion of the blow-by gas treating device supplies the gas having been led by the main structure portion to the intake system of the engine. As described above, in the engine including the blow-by gas treating device according to the present invention, the discharge path of the oil having been separated from the blow-by gas by the separating portion and the discharge path of the gas having been separated from the blow-by gas by the separating portion are clearly discriminated. As a result, even if the engine is inclined in the front-back direction, emission of the oil having been separated from the blow-by gas from the outlet portion can be suppressed.

According to the engine according to the present invention, the outlet portion of the blow-by gas treating device has the oil guiding surface for guiding the oil remaining in the gas after having been separated from the blow-by gas into the head cover. As a result, even if the oil remains in the gas after having been separated from the blow-by gas by the separating portion, the engine according to the present invention can suppress the remaining of the oil contained in the blow-by gas in the outlet portion.

According to the engine according to the present invention, the separating portion of the blow-by gas treating device is provided with inclination in a direction in which the oil having been separated from the blow-by gas by the separating portion is led to the oil guiding portion. Thus, the oil having been separated from the blow-by gas by the separating portion does not remain in the separating portion but is led to the oil guiding portion. As a result, the engine according to the present invention can suppress the remaining of the oil contained in the blow-by gas and freezing of the moisture contained in the oil at a low temperature. As a result, the operation of separating the blow-by gas into the oil and the gas by the separating portion is performed more reliably.

According to the engine according to the present invention, the filter of the separating portion in the blow-by gas treating device, which separates the blow-by gas into the oil and the gas, is held between the flow-velocity rise operating portion and the impact plate by fastening of the fastening member to the flow-velocity rise operating portion. Here, the deformation suppressing member is disposed between the flow-velocity rise operating portion and the impact plate. The deformation suppressing member suppresses deformation of the filter held between the flow-velocity rise operating portion and the impact plate caused by the fastening of the fastening member. As a result, when the filter is held by using the fastening member, the deformation of the filter can be suppressed. Variation of the deformation amount of the filter in accordance with the torque of the fastening member and the unstable shape of the filter, for example, can be suppressed. As a result, when the filter is held by using the fastening member, stable oil separation performances can be realized.

Advantageous Effects of Invention

According to the present invention, the blow-by gas treating device which can suppress emission of the oil having been separated from the blow-by gas from the outlet, even if the engine is inclined in the front-back direction and the engine including the blow-by gas treating device can be provided.

Alternatively, according to the present invention, the blow-by gas treating device which can suppress the remaining of the oil contained in the blow-by gas in the outlet portion and the engine including the blow-by gas treating device can be provided.

Alternatively, according to the present invention, the blow-by gas treating device which can suppress the remaining of the oil and prevent the freezing of the oil at a low temperature when the blow-by gas is separated into the oil and the gas and the engine including the blow-by gas treating device can be provided.

Alternatively, according to the present invention, when the filter is held by using the fastening member, the blow-by gas treating device which can realize the stable oil separation performances and the engine including the blow-by gas treating device can be provided.

DESCRIPTION OF EMBODIMENTS

Hereinafter, preferred embodiments of the present invention will be described in detail with reference to the drawings.

Note that, the embodiments described below are preferred specific examples of the present invention, and technically preferable various limitations are given, but the scope of the present invention is not limited to these modes unless there is description particularly limiting the present invention in the following description. Moreover, the same signs are given to similar constituent elements in each of the figures, and detailed description will be omitted as appropriate.

(Outline of Engine 1)

Figure 1:
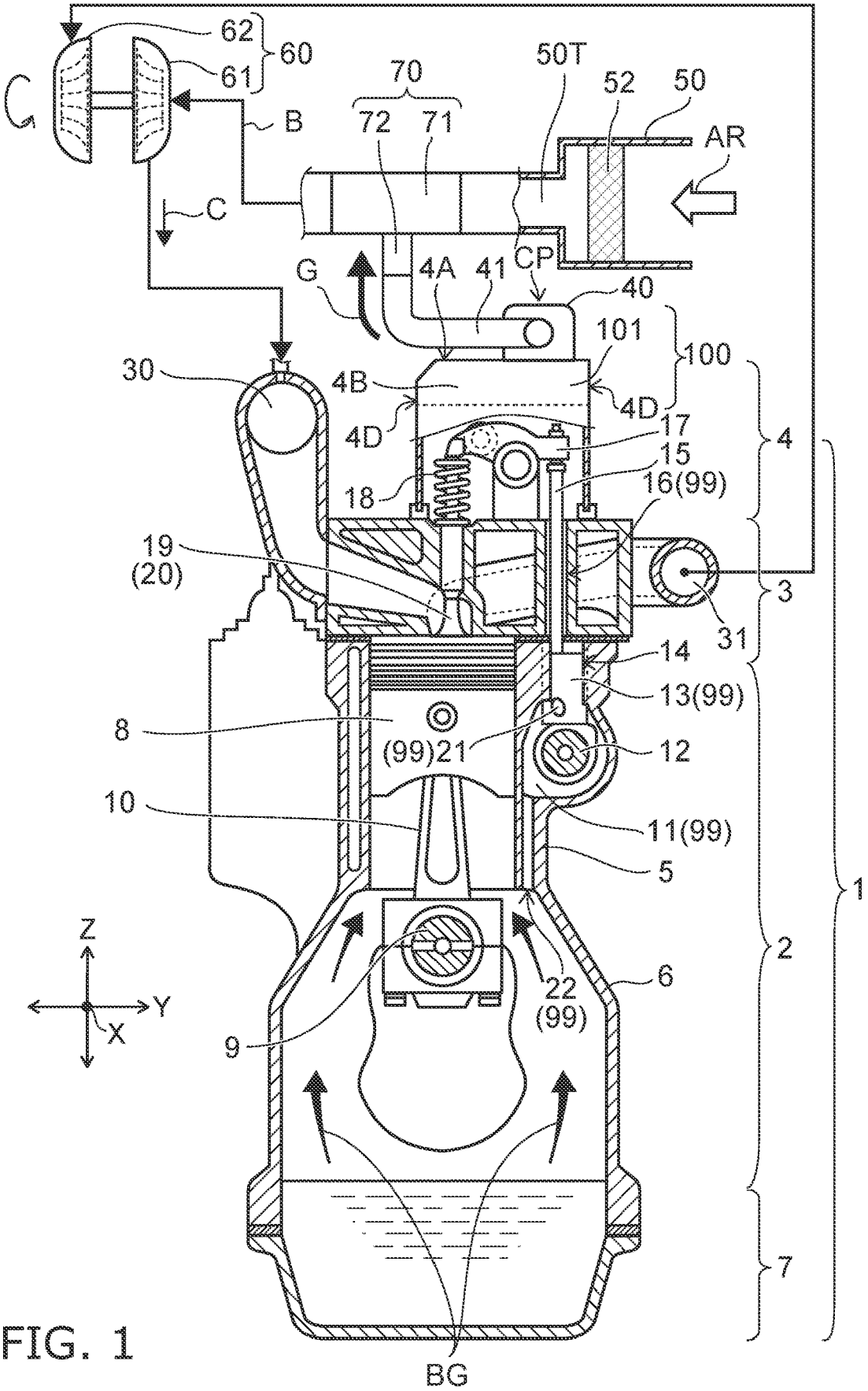
FIG. 1 is a sectional view illustrating an engine including a blow-by gas treating device according to an embodiment of the present invention.

FIG. 1 is a sectional view illustrating an engine including a blow-by gas treating device according to a first embodiment of the present invention.

The engine 1 shown in FIG. 1 is an internal combustion engine such as an industrial diesel engine, for example. The engine 1 is a multi-cylinder engine such as a supercharging type high-output 3-cylinder engine, 4-cylinder engine or the like with a turbocharger, for example. The engine 1 is mounted on a vehicle such as a construction machine, an agricultural machine, a lawn mower and the like, for example.

(Structure Example of Engine 1)

The engine 1 includes a cylinder block 2, a cylinder head 3, a head cover 4, an oil pun 7, and a blow-by gas treating device 100. The cylinder head 3 is assembled on the cylinder block 2. The head cover 4 is assembled onto the cylinder head 3. The cylinder block 2 has a cylinder 5 on an upper part and a crank case 6 on a lower part. The oil pun 7 is disposed on a lower part of the crank case 6. A piston 8 is disposed in the cylinder 5. A crank shaft 9 is disposed in the crank case 6. The piston 8 is connected to the crank shaft 9 through a con rod 10.

As shown in FIG. 1, the cylinder 5 has a valve cam chamber 11. The valve cam chamber 11 accommodates a valve cam shaft 12. A tappet 13 is configured vertically movably along a tappet guide hole 14. A lower part of the tappet 13 is placed on the valve cam shaft 12. A push rod 15 passes through an insertion hole 16. A rocker arm 17 is disposed in the head cover 4. An upper end portion of the push rod 15 is in contact with the rocker arm 17.

The rocker arm 17 is biased by a spring 18 to an upper end portion side of the push rod 15. An intake valve 19 and an exhaust valve 20 are moved vertically by power transmitted through the push rod 15 and the rocker arm 17 by rotation of the valve cam shaft 12 and open/close an intake port and an exhaust port, respectively.

As shown in FIG. 1, an oil flow-out hole 21, for example, is provided in the tappet 13. An oil drop hole 22 is provided from the valve cam chamber 11 to the crank case 6. As a result, the insertion hole 16, an inside of the tappet 13, the oil flow-out hole 21, the valve cam chamber 11, and the oil drop hole 22 constitute an oil return path 99. The oil return path 99 can return oil in the head cover 4 to the oil pun 7 through the inside of the crank case 6. Each cylinder of the cylinder head 3 is connected to an intake passage 30 and an exhaust passage 31.

As shown in FIG. 1, a blow-by gas BG is generated at least in either of a compression stroke and a combustion stroke of the engine 1 in some cases. The blow-by gas BG is a gas flowing into the crank case 6 through a gap between the piston 8 and the cylinder 5 shown in FIG. 1 and contains mists such as an unburned fuel component, a burned gas component, oil and the like. The blow-by gas BG leaking out to the crank case 6 from the gap between the cylinder 5 and the piston 8 rises into the head cover 4 through the aforementioned oil return path 99, for example. That is, if the blow-by gas BG leaks out to the crank case 6 from the gap between the cylinder 5 and the piston 8, it intrudes into the head cover 4 through the oil drop hole 22, the valve cam chamber 11, the oil flow-out hole 21 of the tappet 13, and the insertion hole 16 of the oil return path 99 as a blow-by gas passage path, for example. Note that the aforementioned oil return path 99 is an example of the blow-by gas passage path. The blow-by gas passage path is not limited only to the aforementioned oil return path 99.

As shown in FIG. 1, the blow-by gas treating device 100 is provided in the head cover 4. The blow-by gas treating device 100 has a role of separating the blow-by gas BG into oil OL (see FIG. 2) and a gas (gas after the treating) G (see FIG. 2) from which a mist of the oil OL has been separated. The gas G contained in the blow-by gas BG, for example, is sent to a pipe 41 connected to the intake system outside of the head cover through the blow-by gas treating device 100. The gas G contained in the blow-by gas BG is the unburned gas component and the burned gas component, for example, excluding the oil OL and the mist of the oil OL from the blow-by gas BG. Note that the oil (lubricant component) OL is recovered in the oil pun 7 through the head cover 4, the inside of the cylinder head 3, and the oil return path 99, for example.

A connecting pipe 50T of an intake pipe 50 and the pipe 41 shown in FIG. 1 are connected to each another by a blow-by gas mixing joint 70. When new intake air AR is sucked into the intake pipe 50, it passes through an air cleaner 52 and the connecting pipe 50T and enters a main pipe 71 of the blow-by gas mixing joint 70. On the other hand, the gas G after the oil OL is separated from the blow-by gas BG by the blow-by gas treating device 100 enters a sub pipe 72 of the blow-by gas mixing joint 70 through the pipe 41 from the outlet portion 40 of the blow-by gas treating device 100. As a result, the new intake air AR and the gas G are mixed in the blow-by gas mixing joint 70 and become intake air B.

On the other hand, an exhaust from the exhaust passage 31 is supplied to a turbine 62 of a turbocharger 60 and rotates the turbine 62 and a blower 61 at a high speed. The mixed intake air B is supplied to the blower 61 of turbocharger 60 and is compressed. Compressed intake air C supercharges the intake passage 30 of the intake system.

(Blow-by Gas Treating Device 100 According to First Embodiment)

Subsequently, a preferred structure example of the blow-by gas treating device 100 according to the first embodiment will be described by referring to FIGS. 2 and 3.

Figure 2:
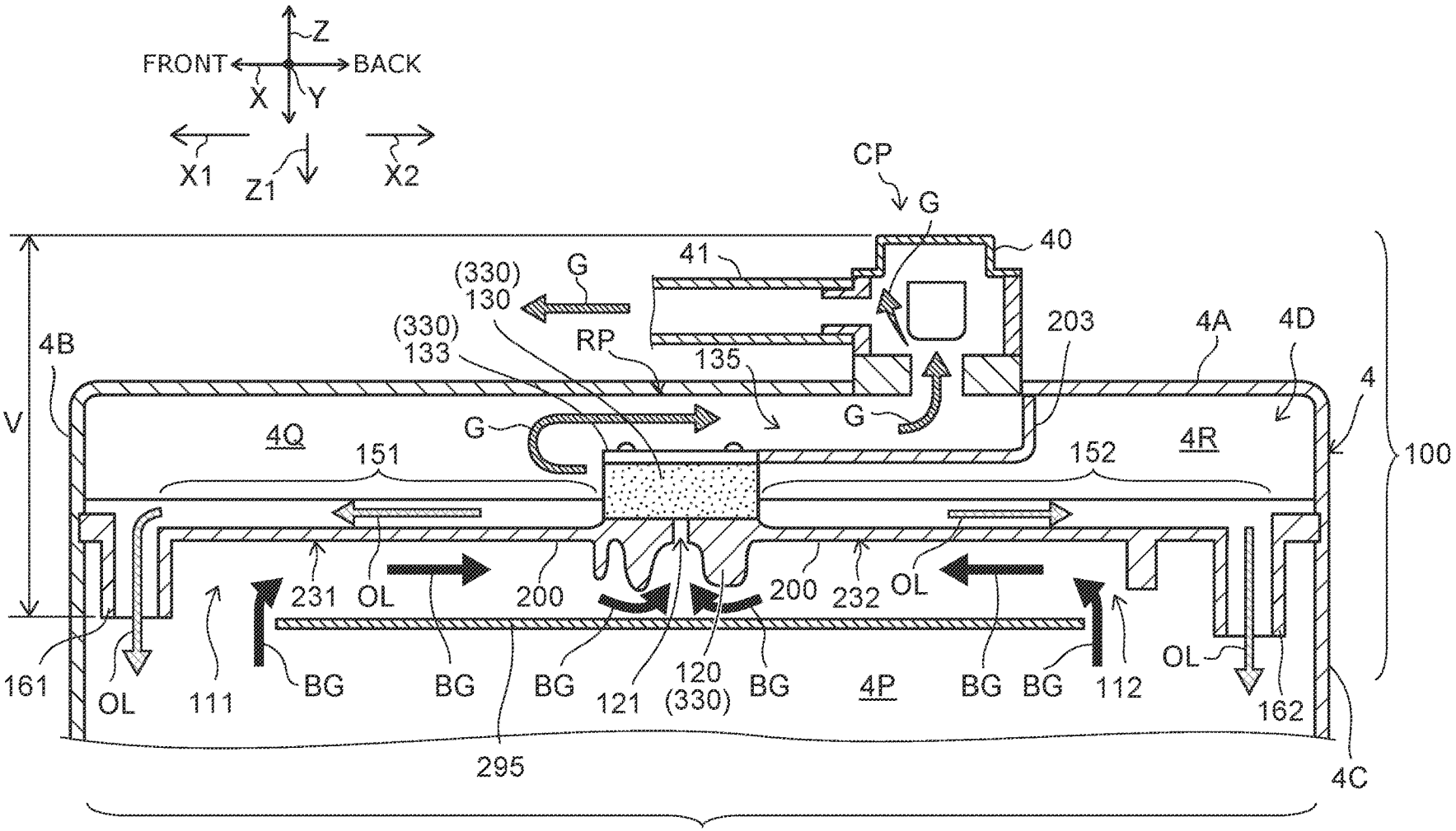
FIG. 2 is a sectional view on an X-Z plane illustrating a structure example of the blow-by gas treating device according to this embodiment.

FIG. 2 is a sectional view on an X-Z plane illustrating the structure example of the blow-by gas treating device according to this embodiment.

Figure 3A:
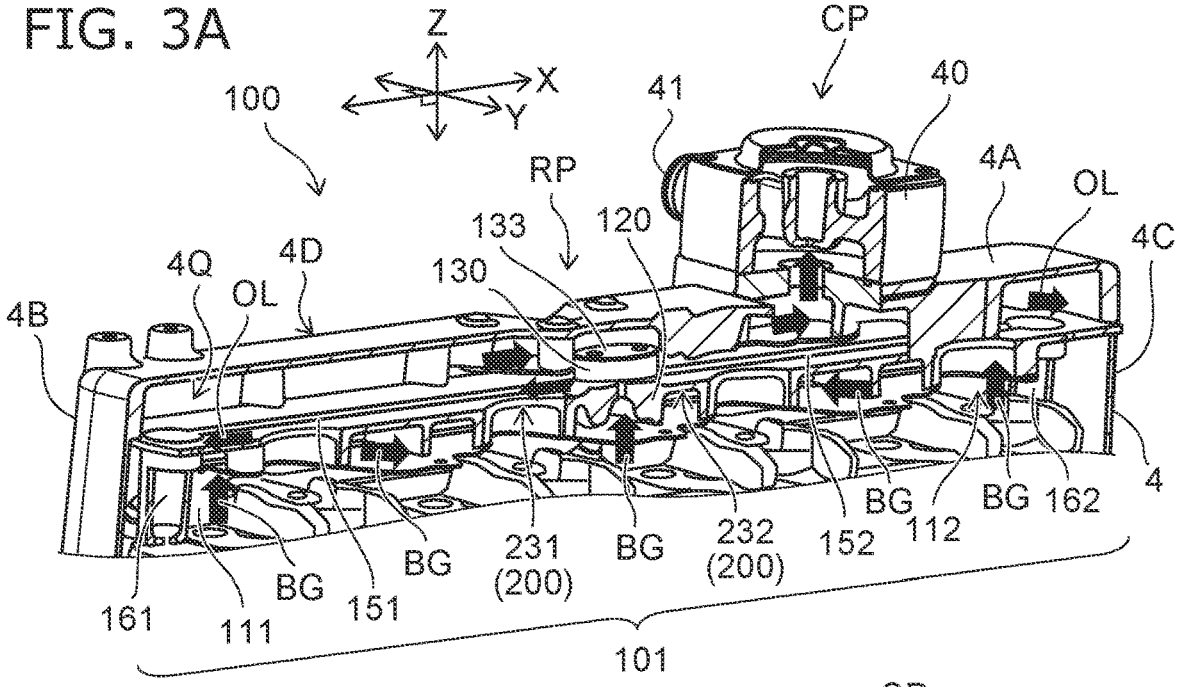
FIGS. 3A and 3B are perspective views having a section on the X-Z plane illustrating the structure example of the blow-by gas treating device according to this embodiment.
Figure 3B:
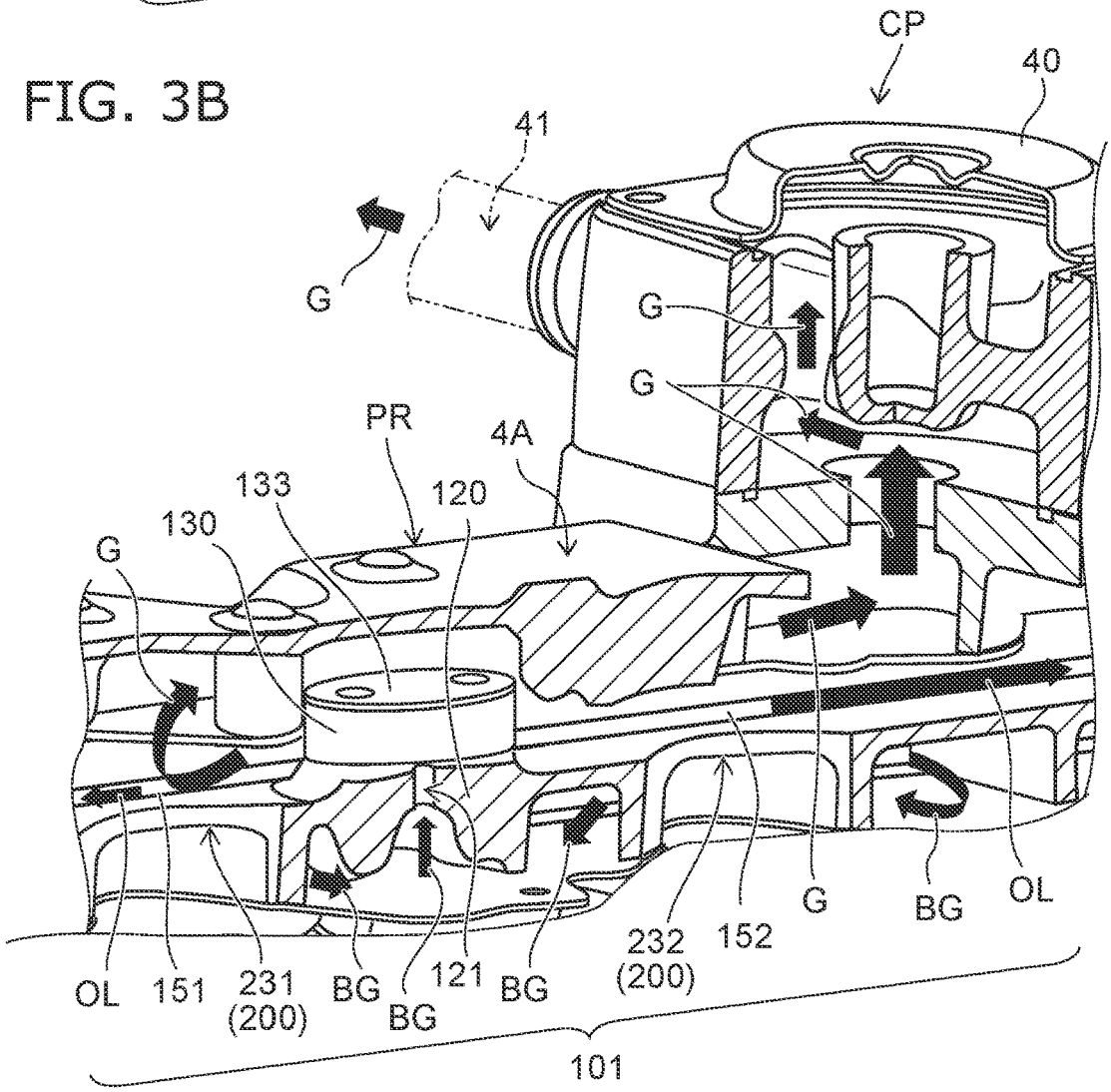

FIGS. 3A and 3B are perspective views having a section on the X-Z plane illustrating the structure example of the blow-by gas treating device according to this embodiment.

Note that FIG. 3A is a perspective view having the section on the X-Z plane illustrating the structure example of the blow-by gas treating device 100. FIG. 3B is a perspective view in which a part of the blow-by gas treating device 100 shown in FIG. 3A is enlarged.

Here, an X-direction shown in FIGS. 1 to 3 is a front-back direction of the engine 1 shown in FIG. 1, that is, an axial direction of the crank shaft 9. A Y-direction is a left-right direction of the engine 1. A Z-direction is an up-down direction of the engine 1. The X, Y, and Z directions are orthogonal to one another.

As shown in FIGS. 1 and 2, the blow-by gas treating device 100 is also called a breather device or a breather and is disposed in the head cover 4. As shown in FIG. 2, the blow-by gas treating device 100 separates the blow-by gas BG into the oil OL and the gas G and can guide the oil OL and the gas G in separate paths.

The blow-by gas treating device 100 shown in FIG. 2 has a main structure portion 101 and the outlet portion 40. The main structure portion 101 is provided in the head cover 4. The outlet portion 40 is provided by protruding above the head cover 4. Moreover, as shown in FIG. 2, the outlet portion 40 is disposed at a substantially center position CP, for example, with respect to the front-back direction, which is the X-direction of the main structure portion 101. The outlet portion 40 adjusts a pressure of the gas G at the substantially center position CP, for example, of the engine 1 and sends only the gas G led from the main structure portion 101 to the pipe 41 of the intake system in the engine 1. In the outlet portion 40, a pressure regulation valve (diaphragm), for example, is provided. The pressure regulation valve provided in the outlet portion 40 suppresses flowing-in of the new intake air AR into the engine 1 through the blow-by gas mixing joint 70 and the pipe 41 of the intake system.

<Main Structure Portion 101 of Blow-by Gas Treating Device 100>

First, a preferred structure example of the main structure portion 101 of the blow-by gas treating device 100 will be described by referring to FIGS. 1 to 3.

As shown in FIGS. 1 and 2, the main structure portion 101 is accommodated in the head cover 4. Specifically, the head cover 4 has an upper surface portion 4A, a front surface portion 4B, a rear surface portion 4C, and left and right surface portions 4D. The main structure portion 101 is disposed in a space surrounded by the upper surface portion 4A, the front surface portion 4B, the rear surface portion 4C, and the left and right surface portions 4D. The main structure portion 101 takes in and guides the blow-by gas BG and separates the oil OL contained in the blow-by gas BG from the blow-by gas BG. Then, the main structure portion 101 guides the oil OL and the gas G in the separate paths so that the oil OL and the gas G having been separated from the blow-by gas BG do not leak out of the engine 1. For that purpose, the head cover 4 is held by the cylinder head 3 in a state where air tightness inside the head cover 4 is kept with respect to the outside of the head cover 4. As a result, leakage of the blow-by gas BG and the oil OL as well as the gas G having been separated from the blow-by gas BG to the outside of the engine 1 is suppressed.

As shown in FIG. 2, the main structure portion 101 roughly has a first blow-by gas taking-in portion 111, a second blow-by gas taking-in portion 112, the separating portion 330, a first oil-guiding groove portion 151, a second oil-guiding groove portion 152, a first oil drain 161, and a second oil drain 162.

As shown in FIG. 2, the main structure portion 101 has a partition wall portion 200, a guiding wall portion 203, and a guiding plate 295 in order to constitute the aforementioned constituent elements. The partition wall portion 200 is disposed on an X-Y plane in the head cover 4, that is, horizontally, and partitions a space into a lower region 4P and upper regions 4Q and 4R in the head cover 4. Therefore, the lower region 4P and the upper regions 4Q and 4R are spaces independent of one another.

As shown in FIG. 2, the guiding wall portion 203 guides the gas G after being treated, that is, only the gas G after the mist of the oil OL has been separated from the blow-by gas BG to the outlet portion 40. The guiding wall portion 203 is disposed between the partition wall portion 200 and the upper surface portion 4A of the head cover 4 and partitions the space into the upper region 4Q and the upper region 4R. Therefore, the upper region 4Q and the upper region 4R are spaces independent of each other.

<First Blow-by Gas Taking-In Portion 111 and Second Blow-by Gas Taking-In Portion 112>

Subsequently, the first blow-by gas taking-in portion 111 and the second blow-by gas taking-in portion 112 will be described by referring to FIGS. 2 and 3.

The first blow-by gas taking-in portion 111 and the second blow-by gas taking-in portion 112 are holes formed by the partition wall portion 200 and the guiding plate 295 and take in the blow-by gas BG. The partition wall portion 200 is separated into a first guiding lower-surface portion 231 side and a second guiding lower-surface portion 232 side with the separating portion 330 as a center. The first blow-by gas taking-in portion 111 is provided at a position closer to the front surface portion 4B (that is, on the front side of the engine 1) and takes in the blow-by gas BG from the front side. In addition, the second blow-by gas taking-in portion 112 is provided at a position closer to the rear surface portion 4C (that is, on the rear side of the engine 1) and takes in the blow-by gas BG from the rear side. The guiding plate 295 shown in FIG. 2 has a portion away from the partition wall portion 200 so as to face the first guiding lower-surface portion 231 and the second guiding lower-surface portion 232 and is disposed along the X-Y plane.

As shown in FIG. 1, when the blow-by gas BG having risen in the crank case 6 reaches the lower region 4P of the head cover 4 shown in FIG. 2, it passes through the first blow-by gas taking-in portion 111 and is taken in between the first guiding lower-surface portion 231 of the partition wall portion 200 and the guiding plate 295 and is guided toward the separating portion 330. Alternatively, the blow-by gas BG passes through the second blow-by gas taking-in portion 112, is taken in between the second guiding lower-surface portion 232 and the guiding plate 295 and is guided toward the separating portion 330. Then, the blow-by gas BG reaches an impactor 120 of the separating portion 330 located at a center position RP with respect to the X-direction, which is the front-back direction, as an arrow indicated in FIGS. 2 and 3.

<Impactor 120 of Separating Portion 330>

The separating portion 330 shown in FIG. 2 has the impactor 120, a filter 130, and the impact plate 133 and is provided between the first blow-by gas taking-in portion 111 and the second blow-by gas taking-in portion 112 in the front-back direction of the engine 1. More specifically, the separating portion 330 is provided at a center part between the first oil drain 161 and the second oil drain 162 in the front-back direction of the engine 1, that is, at the center position RP.

The impactor 120 has a function of a nozzle or an orifice. A throttle hole 121 axial direction of the impactor 120 is a so-called vertical throttle hole along a vertical direction, which is the Z-direction, or the up-down direction. The impactor 120 is a rise operating portion which can raise the flow velocity of the blow-by gas BG by having the blow-by gas BG passed upward along the throttle hole 121. The impactor 120 is disposed at the center position RP with respect to the X-direction of the partition wall portion 200. As a result, the blow-by gas BG taken in by the first blow-by gas taking-in portion 111 and the blow-by gas BG taken in by the second blow-by gas taking-in portion 112 are both guided to the impactor 120 more reliably. The impactor 120 raises the flow velocity of the blow-by gas BG flowing in the throttle hole 121 and then, leads the blow-by gas BG to the filter 130.

<Filter 130 of Separating Portion 330>

As shown in FIGS. 2 and 3(B), the filter 130 is replaceably mounted on the partition wall portion 200. The filter 130 is disposed between the impact plate 133 and the impactor 120. That is, on a lower surface of the filter 130, the impactor 120 as the flow-velocity rise operating portion is disposed. On an upper surface of the filter 130, the impact plate 133 is disposed. The impact plate 133 is a metal plate, for example, and extends in the horizontal direction. The impact plate 133 causes the blow-by gas BG whose flow velocity has risen and passed through the filter 130 to be collided and separated into the blow-by gas BG into the oil OL and the gas G not containing the mist of the oil OL. The filter 130 is made of a material such as glass wool or the like, for example. However, the material of the filter 130 is not particularly limited. The blow-by gas BG whose flow velocity has been raised passes through the filter 130 and collides against the impact plate 133, while having foreign substances removed, whereby it is separated into the oil OL and the gas G not containing the mist of the oil OL. Then, the gas G having been separated from the blow-by gas BG by the separating portion 330 is emitted from the filter 130.

As described above, the guiding wall portion 203 is provided between the partition wall portion 200 and the upper surface portion 4A of the head cover 4. Thus, the gas G not containing the mist of the oil OL emitted from the filter 130 is guided by the guiding wall portion 203, passes through a passage 135 of the upper region 4Q and is led to the outlet portion 40.

The separating portion 330 is located at the center position RP in the X-direction shown in FIG. 2 and plays a role as a collecting portion which can collect the blow-by gas BG from the front side and the rear side of the engine 1 toward the center part in the X-direction. As described above, since the separating portion 330 is located at the center position RP with respect to the X-direction of the head cover 4, the blow-by gas BG can be collected to the center part from the front side and the rear side with respect to the X-direction and can be separated into the oil OL and the gas G not containing the mist of the oil OL in the head cover 4.

<First Oil-Guiding Groove Portion 151 and Second Oil-Guiding Groove Portion 152>

The first oil-guiding groove portion 151 shown in FIG. 2 presents a groove shape and is provided from the front surface portion 4B of the head cover 4 to the vicinity of the filter 130. Similarly, the second oil-guiding groove portion 152 presents the groove shape and is provided from the rear surface portion 4C of the head cover 4 to the vicinity of the filter 130. The first oil-guiding groove portion 151 and the second oil-guiding groove portion 152 guide the oil OL having been separated from the blow-by gas BG by the separating portion 330. The first oil-guiding groove portion 151 is a specific structure example of the "first oil guiding portion" of the present invention and can guide the oil OL emitted from the filter 130 to the front indicated by an X1-direction when the engine 1 in FIG. 1 is inclined to the front side and can lead it to the first oil drain 161 on the front side. Similarly, the second oil-guiding groove portion 152 is a specific structure example of the "second oil guiding portion" of the present invention and can guide the oil OL emitted from the filter 130 to the rear indicated by an X2-direction when the engine 1 in FIG. 1 is inclined to the rear side and can lead it to the second oil drain 162 on the rear side.

Note that the first oil-guiding groove portion 151 and the second oil-guiding groove portion 152 may be connected to each other. In this case, in one of the oil-guiding groove portions, a portion provided from the filter 130 toward the front side of the engine 1 is called a first oil-guiding groove portion 151, while a portion provided from the filter 130 toward the rear side of the engine 1 is called a second oil-guiding groove portion 152.

<First Oil Drain 161 and Second Oil Drain 162>

The first oil drain 161 is provided on the front side of the engine 1 and presents a cylindrical shape, for example. The first oil drain 161 is provided downward, which is a Z1-direction in the head cover 4 at a front position of the first guiding lower-surface portion 231 of the partition wall portion 200. The first oil drain 161 has a check valve, temporarily stores the oil OL having been guided by the first oil-guiding groove portion 151 and discharges it into the engine 1. Similarly, the second oil drain 162 is provided on the rear side of the engine 1 and presents a cylindrical shape, for example. The second oil drain 162 is provided downward, which is the Z1-direction in the head cover 4 at a rear position of the second guiding lower-surface portion 232 of the partition wall portion 200. The second oil drain 162 has a check valve, temporarily stores the oil OL having been guided by the second oil-guiding groove portion 152 and discharges it into the engine 1.

As a result, if the engine 1 is inclined to the front side, the oil OL having been separated from the blow-by gas BG by the separating portion 330 is guided in the X1-direction by the first oil-guiding groove portion 151, is temporarily stored in the first oil drain 161 and then, is discharged in the Z1-direction through the first oil drain 161. Similarly, if the engine 1 is inclined to the rear side, the oil OL having been separated from the blow-by gas BG by the separating portion 330 is guided in the X2-direction by the second oil-guiding groove portion 152, is temporarily stored in the second oil drain 162 and then, is discharged in the Z1-direction through the second oil drain 162. In the head cover 4, the oil OL having been discharged from the first oil drain 161 and the second oil drain 162 is recovered by the oil pun 7 from the head cover 4 shown in FIG. 1, for example, through the aforementioned oil return path 99. Alternatively, the discharged oil OL can be also recovered by an oil container, not shown, for example. As a result, the oil OL discharged from the first oil drain 161 and the second oil drain 162 is discharged into the engine 1 and does not leak to the outside of the engine 1.

(Action Example of Blow-by Gas Treating Device 100)

Subsequently, an action example of the blow-by gas treating device 100 in the engine 1 described above will be explained by referring to FIGS. 1 to 3.

The blow-by gas BG having leaked from between the piston 8 and the cylinder 5 shown in FIG. 1 reaches the lower region 4P of the head cover 4 shown in FIG. 2. The blow-by gas BG passes through the first blow-by gas taking-in portion 111 and the second blow-by gas taking-in portion 112, is taken in between the first guiding lower-surface portion 231 and the guiding plate 295 and between the second guiding lower-surface portion 232 and the guiding plate 295, and is guided toward the separating portion 330. Then, the blow-by gas BG having been guided toward the separating portion 330 reaches the impactor 120 of the separating portion 330 at the center position RP.

The impactor 120 raises the flow velocity of the blow-by gas BG flowing into the throttle hole 121 and then, leads the blow-by gas BG to the filter 130. The blow-by gas BG whose flow velocity has been raised passes through the filter 130 and collides against the impact plate 133 and then, it is separated into the oil OL and the gas G not containing the mist of the oil OL.

The gas G having been separated from the blow-by gas BG by the separating portion 330 is emitted from the filter 130, rises and passes through the passage 135 of the upper region 4Q and is sent to the outlet portion 40.

On the other hand, the oil OL having been separated from the blow-by gas BG by the separating portion 330 is, if the engine 1 is inclined to the front side, emitted from the filter 130, guided to the front indicated by the X1-direction by the first oil-guiding groove portion 151, and is led to the first oil drain 161 on the front side. Similarly, the oil OL having been separated from the blow-by gas BG by the separating portion 330 is, if the engine 1 is inclined to the rear side, emitted from the filter 130, guided to the rear indicated by the X2-direction by the second oil-guiding groove portion 152, and is led to the second oil drain 162 on the rear side.

The oil OL having been guided by the first oil-guiding groove portion 151 to the first oil drain 161 is temporarily stored in the first oil drain 161 and then, is discharged into the engine 1 through the check valve provided in the first oil drain 161. Similarly, the oil OL having been guided by the second oil-guiding groove portion 152 to the second oil drain 162 is temporarily stored in the second oil drain 162 and then, is discharged into the engine 1 through the check valve provided in the second oil drain 162. The oil OL having been discharged from the first oil drain 161 and the second oil drain 162 is recovered by the oil pun 7 through the oil return path 99 from inside the head cover 4, for example.

By the way, the engine 1 is inclined to a front direction or a rear direction depending on start or stop or acceleration or deceleration performed when the vehicle on which the engine 1 shown in FIG. 1 is mounted moves, irregular states and the like of a traveling surface such as a road surface and the like. If the engine 1 is inclined to the front direction or to the rear direction, a liquid level of the oil stored in the oil pun 7 is fluctuated, and an air pressure of the gas present in the crank case 6 might be fluctuated in some cases. Moreover, the air pressure of the gas present in the crank case 6 might be fluctuated in accordance with a stroke of the engine 1 in some cases. Then, the oil OL having been separated from the blow-by gas BG is not discharged sufficiently and mixed in the gas G having been separated from the blow-by gas BG and is emitted to the outside of the engine 1 from the outlet portion of the blow-by gas treating device in some cases, for example.

On the other hand, according to the blow-by gas treating device 100 and the engine 1 including the blow-by gas treating device 100 according to this embodiment, the oil OL having been separated from the blow-by gas BG by the separating portion 330 is guided to the front side of the engine 1 by the first oil-guiding groove portion 151, is temporarily stored in the first oil drain 161 and then, is discharged into the engine 1. Moreover, the oil OL having been separated from the blow-by gas BG by the separating portion 330 is guided to the rear side of the engine 1 by the second oil-guiding groove portion 152, is temporarily stored in the second oil drain 162 and then, is discharged into the engine 1. Thus, in the blow-by gas treating device 100 according to this embodiment, the discharge path of the oil OL having been separated from the blow-by gas BG by the separating portion 330 is clear. Moreover, the gas G after the oil OL has been separated from the blow-by gas BG is led to the outlet portion 40 of the blow-by gas treating device 100 by the main structure portion 101. Then, the outlet portion 40 of the blow-by gas treating device 100 supplies the gas G having been led by the main structure portion 101 to the intake system of the engine 1. As described above, in the blow-by gas treating device 100 according to this embodiment, the discharge path of the oil OL having been separated from the blow-by gas BG by the separating portion 330 and the discharge path of the gas G having been separated from the blow-by gas BG by the separating portion 330 are clearly discriminated. As a result, even if the engine 1 is inclined to the front-back direction, emission of the oil OL having been separated from the blow-by gas BG from the outlet portion 40 can be suppressed. Moreover, since the flowing of the mist of the oil OL to the intake system can be suppressed, burning of the mist of the oil OL can be suppressed, and purification of an exhaust gas can be promoted.

Moreover, the separating portion 330 which separates the blow-by gas BG into the oil OL and the gas G is provided at the center part, that is, the center position RP between the first oil drain 161 which temporarily stores the oil OL having been guided by the first oil-guiding groove portion 151 and discharges it into the engine 1 and the second oil drain 162 which temporarily stores the oil OL having been guided by the second oil-guiding groove portion 152 and discharges it into the engine 1. As described above, the separating portion 330 is provided at a position relatively far from the first oil drain 161 and the second oil drain 162. Thus, even if the engine 1 is inclined in the front-back direction, mixing or re-mixing of the oil OL temporarily stored in the first oil drain 161 and the second oil drain 162 or the oil OL or the mist of the oil OL present above the first oil drain 161 and the second oil drain 162 in the gas G having been separated from the blow-by gas BG by the separating portion 330 can be suppressed. As a result, even if the engine 1 is inclined in the front-back direction, emission of the oil OL having been separated from the blow-by gas BG from the outlet portion 40 can be further suppressed.

Moreover, since mixing or re-mixing of the oil OL or the mist of the oil OL in the gas G having been separated from the blow-by gas BG by the separating portion 330 can be suppressed, emission of the oil OL having been separated from the blow-by gas BG from the outlet portion 40 can be suppressed regardless of the position of the outlet portion 40.

As a result, a degree of freedom in selecting an installation position or an installation direction of the outlet portion 40 can be increased.

The first oil-guiding groove portion 151 and the second oil-guiding groove portion 152 present the groove shape and thus, even if the engine 1 is inclined in the front-back direction, the oil OL having been separated from the blow-by gas BG by the separating portion 330 can be guided to the front side and the rear side of the engine 1 reliably even with a simple structure.

Moreover, according to the blow-by gas treating device 100 according to this embodiment, the first blow-by gas taking-in portion 111 as well as the second blow-by gas taking-in portion 112 which take in the blow-by gas BG, and the first oil-guiding groove portion 151 as well as the second oil-guiding groove portion 152 which guide the oil OL are provided separately at positions on both sides on the upper surface side and the lower surface side through the common partition wall portion 200. Therefore, the first blow-by gas taking-in portion 111 as well as the second blow-by gas taking-in portion 112 and the first oil-guiding groove portion 151 as well as the second oil-guiding groove portion 152 can be provided as single members on the partition wall portion 200. Therefore, a dimension V (see FIG. 2) in the up-down direction of the blow-by gas treating device 100 can be suppressed. Thus, the height dimension of the head cover 4 in which the blow-by gas treating device 100 is disposed can be suppressed, and the height dimension of the engine 1 including the blow-by gas treating device 100 in the head cover 4 can be suppressed.

Moreover, the blow-by gas BG passes through the filter 130 and collides against the impact plate 133 after having the flow velocity raised by the impactor 120. Thus, the blow-by gas BG is separated into the oil OL and the gas G excluding the mist of the oil OL more reliably. Moreover, the impactor 120 raises the flow velocity of the blow-by gas BG along the vertical direction (up-down direction) at the center position RP in the front-back direction of the engine 1. Furthermore, the impact plate 133 extends in the horizontal direction and causes the blow-by gas BG having passed through the filter 130 to be collided. Thus, as compared with the case where the impactor raises the flow velocity of the blow-by gas along the horizontal direction and causes the blow-by gas to collide against the impact plate extending in the vertical direction, the dimension V in the up-down direction of the blow-by gas treating device 100 can be suppressed.

Subsequently, a second embodiment of the present invention will be described.

Note that, when constituent elements of the blow-by gas treating device according to the second embodiment are similar to the constituent elements of the blow-by gas treating device according to the first embodiment, duplicated explanation will be omitted as appropriate, and different points will be mainly explained below.

(Blow-by Gas Treating Device 100 According to Second Embodiment)

A preferred structure example of the blow-by gas treating device 100 according to the second embodiment will be described by referring to FIGS. 4 to 6.

Figure 4:
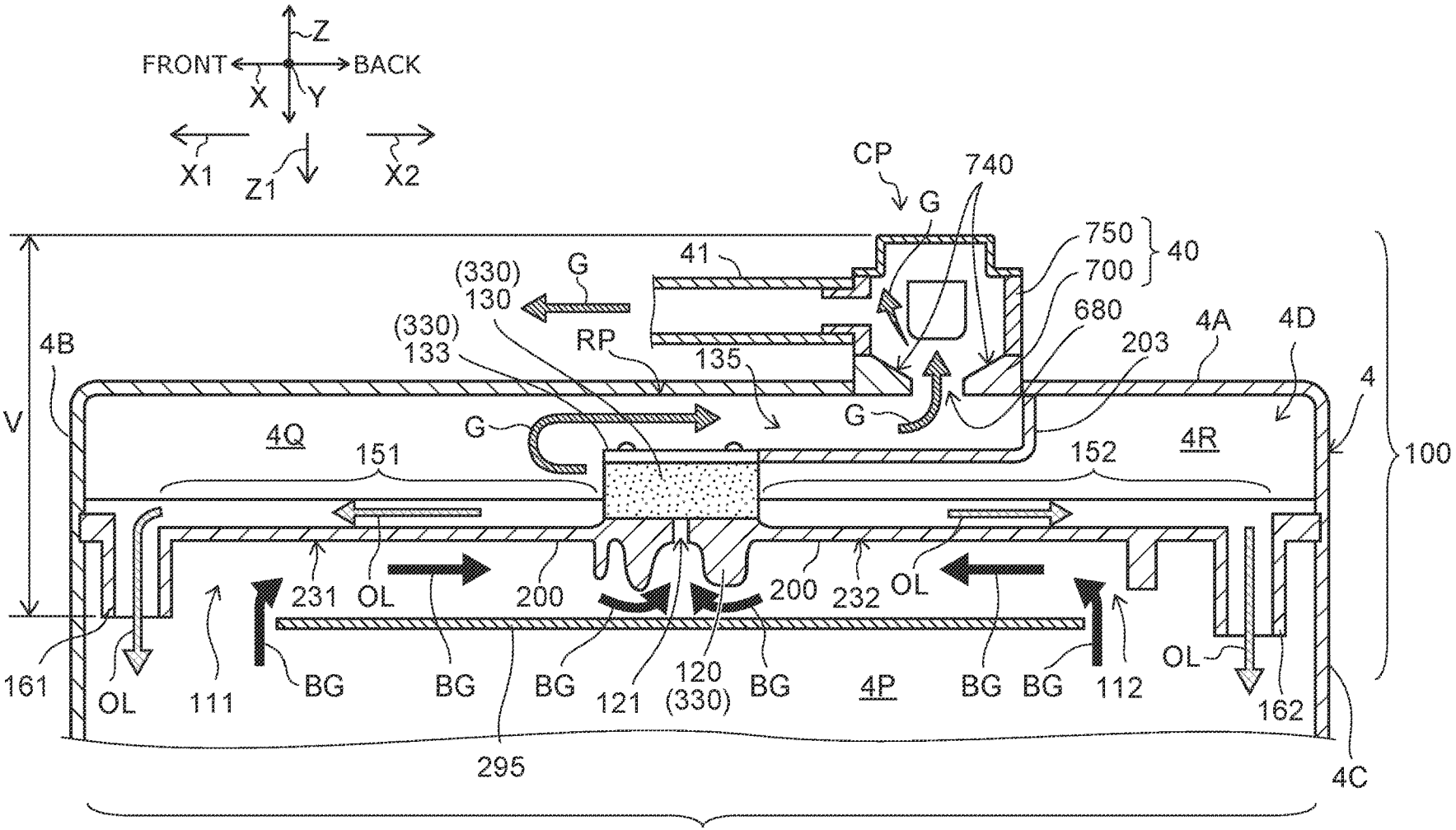
FIG. 4 is a sectional view on the X-Z plane illustrating the structure example of the blow-by gas treating device according to this embodiment.

FIG. 4 is a sectional view on the X-Z plane illustrating the structure example of the blow-by gas treating device according to this embodiment.

Figure 5:
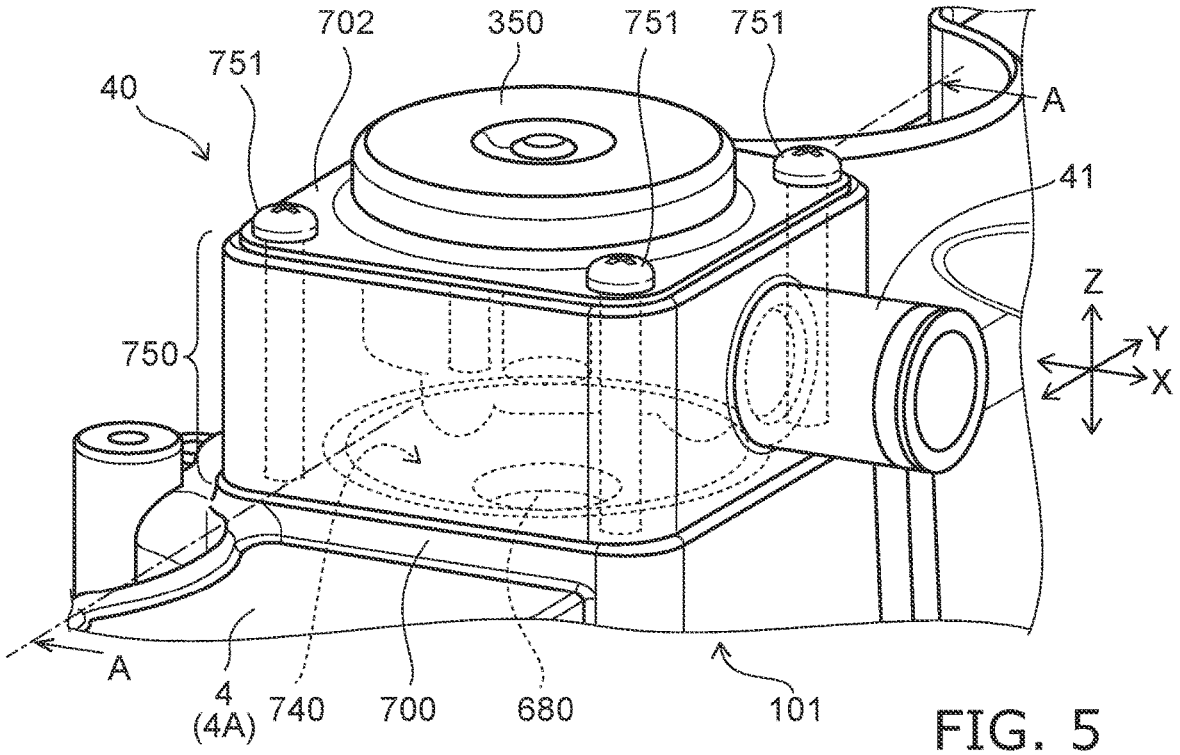
FIG. 5 is a perspective view illustrating a structure example of an outlet portion of the blow-by gas treating device according to this embodiment.

FIG. 5 is a perspective view illustrating a structure example of the outlet portion of the blow-by gas treating device according to this embodiment.

Figure 6:
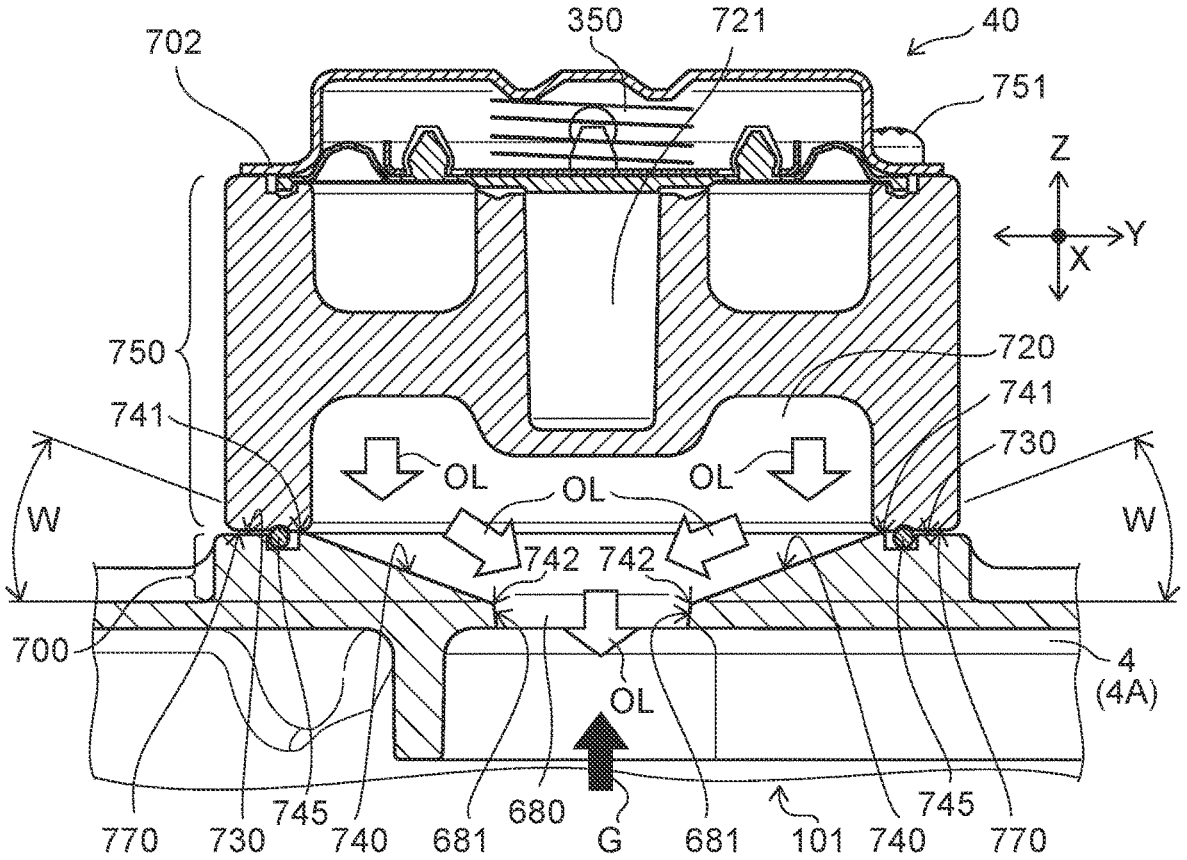
FIG. 6 is a sectional view on a cut surface A-A shown in FIG. 5.

FIG. 6 is a sectional view on a cut surface A-A shown in FIG. 5.

Here, the X-direction shown in FIGS. 4 to 6 is the front-back direction of the engine 1 shown in FIG. 1, that is, an axial direction of the crank shaft 9. The Y-direction is the left-right direction of the engine 1. The Z-direction is the up-down direction of the engine 1. The X, Y, and Z directions are orthogonal to one another.

As shown in FIGS. 1 and 4, the blow-by gas treating device 100 is also called a breather device or a breather and is disposed in the head cover 4. As shown in FIG. 4, the blow-by gas treating device 100 separates the blow-by gas BG into the oil OL and the gas G and can guide the oil OL and the gas G in separate paths.

The blow-by gas treating device 100 shown in FIG. 4 has the main structure portion 101 and the outlet portion 40. The main structure portion 101 is provided in the head cover 4. The outlet portion 40 is provided by protruding above the head cover 4. Moreover, as shown in FIG. 4, the outlet portion 40 is disposed at the substantially center position CP, for example, with respect to the front-back direction, which is the X-direction of the main structure portion 101. A detailed structure example of the outlet portion 40 will be described after the detailed structure example of the main structure portion 101 is described.

<Main Structure Portion 101 of Blow-by Gas Treating Device 100 According to Second Embodiment>

First, a preferred structure example of the main structure portion 101 of the blow-by gas treating device 100 according to the second embodiment will be described by referring to FIGS. 1 and 4.

As shown in FIGS. 1 and 4, the main structure portion 101 is accommodated in the head cover 4. Specifically, the head cover 4 has the upper surface portion 4A, the front surface portion 4B, the rear surface portion 4C, and the left and right surface portions 4D. The main structure portion 101 is disposed in a space surrounded by the upper surface portion 4A, the front surface portion 4B, the rear surface portion 4C, and the left and right surface portions 4D. The main structure portion 101 takes in and guides the blow-by gas BG and separates the oil OL contained in the blow-by gas BG from the blow-by gas BG. Then, the main structure portion 101 guides the oil OL and the gas G in the separate paths so that the oil OL and the gas G separated from the blow-by gas BG do not leak out of the engine 1. For that purpose, the head cover 4 is held by the cylinder head 3 in a state where air tightness inside the head cover 4 is kept with respect to the outside of the head cover 4. As a result, leakage of the blow-by gas BG and the oil OL and the gas G having been separated from the blow-by gas BG to the outside of the engine 1 is suppressed.

As shown in FIG. 4, the main structure portion 101 roughly has the first blow-by gas taking-in portion 111, the second blow-by gas taking-in portion 112, the separating portion 330, the first oil-guiding groove portion 151, the second oil-guiding groove portion 152, the first oil drain 161, and the second oil drain 162. Each of the first oil-guiding groove portion 151 and the second oil-guiding groove portion 152 is an example of the "oil guiding portion" of the present invention. The first oil drain 161 and the second oil drain 162 are examples of the "oil drain" of the present invention.

As shown in FIG. 4, the main structure portion 101 has the partition wall portion 200, the guiding wall portion 203, and the guiding plate 295 in order to constitute the aforementioned constituent elements. The partition wall portion 200 is disposed on the X-Y plane in the head cover 4, that is, horizontally, and partitions the space into the lower region 4P and the upper regions 4Q and 4R of the head cover 4. Therefore, the lower region 4P and the upper regions 4Q and 4R are spaces independent of one another.

As shown in FIG. 4, the guiding wall portion 203 guides the gas G after being treated, that is, only the gas G after the mist of the oil OL has been separated from the blow-by gas BG to the outlet portion 40. The guiding wall portion 203 is disposed between the partition wall portion 200 and the upper surface portion 4A of the head cover 4 and partitions the space into the upper region 4Q and the upper region 4R. Therefore, the upper region 4Q and the upper region 4R are spaces independent of each other.

<First Blow-by Gas Taking-In Portion 111 and Second Blow-by Gas Taking-In Portion 112>

Subsequently, the first blow-by gas taking-in portion 111 and the second blow-by gas taking-in portion 112 will be described by referring to FIG. 4.

The first blow-by gas taking-in portion 111 and the second blow-by gas taking-in portion 112 are holes formed by the partition wall portion 200 and the guiding plate 295 and take in the blow-by gas BG. The partition wall portion 200 is separated into the first guiding lower-surface portion 231 side and the second guiding lower-surface portion 232 side with the separating portion 330 as the center. The first blow-by gas taking-in portion 111 is provided at a position closer to the front surface portion 4B (that is, on the front side of the engine 1) and takes in the blow-by gas BG from the front side. In addition, the second blow-by gas taking-in portion 112 is provided at a position closer to the rear surface portion 4C (that is, on the rear side of the engine 1) and takes in the blow-by gas BG from the rear side. The guiding plate 295 shown in FIG. 4 has a portion away from the partition wall portion 200 so as to face the first guiding lower-surface portion 231 and the second guiding lower-surface portion 232 and is disposed along the X-Y plane.

As shown in FIG. 1, when the blow-by gas BG having risen in the crank case 6 reaches the lower region 4P of the head cover 4 shown in FIG. 4, it passes through the first blow-by gas taking-in portion 111 and is taken in between the first guiding lower-surface portion 231 of the partition wall portion 200 and the guiding plate 295 and is guided toward the separating portion 330. Alternatively, the blow-by gas BG passes through the second blow-by gas taking-in portion 112, is taken in between the second guiding lower-surface portion 232 and the guiding plate 295 and is guided toward the separating portion 330. Then, the blow-by gas BG reaches the impactor 120 of the separating portion 330 located at the center position RP with respect to the X-direction, which is the front-back direction, as an arrow indicated in FIG. 4.

<Impactor 120 of Separating Portion 330>

The separating portion 330 shown in FIG. 4 has the impactor 120, the filter 130, and the impact plate 133 and is provided between the first blow-by gas taking-in portion 111 and the second blow-by gas taking-in portion 112 in the front-back direction of the engine 1. More specifically, the separating portion 330 is provided at the center part between the first oil drain 161 and the second oil drain 162 in the front-back direction of the engine 1, that is, at the center position RP.

The impactor 120 has a function of a nozzle or an orifice. An axial direction of the throttle hole 121 of the impactor 120 is a so-called vertical throttle hole along the vertical direction, which is the Z-direction, or the up-down direction. The impactor 120 is the flow-velocity rise operating portion which can raise the flow velocity of the blow-by gas BG by having the blow-by gas BG passed upward along the throttle hole 121. The impactor 120 is disposed at the center position RP with respect to the X-direction of the partition wall portion 200. As a result, the blow-by gas BG taken in by the first blow-by gas taking-in portion 111 and the blow-by gas BG taken in by the second blow-by gas taking-in portion 112 are uniformly guided to the impactor 120. The impactor 120 raises the flow velocity of the blow-by gas BG flowing in the throttle hole 121 and then, leads the blow-by gas BG to the filter 130.

<Filter 130 of Separating Portion 330>

As shown in FIG. 4, the filter 130 is replaceably mounted on the partition wall portion 200. The filter 130 is disposed between the impact plate 133 and the impactor 120. That is, on the lower surface of the filter 130, the impactor 120 as the flow-velocity rise operating portion is disposed. On the upper surface of the filter 130, the impact plate 133 is disposed. The impact plate 133 is a metal plate, for example, and extends in the horizontal direction. The impact plate 133 is collided against the blow-by gas BG whose flow velocity has risen and which has passed through the filter 130, whereby the blow-by gas BG is separated into the oil OL and the gas G not containing the mist of the oil OL. The filter 130 is made of a material such as glass wool or the like, for example. However, the material of the filter 130 is not particularly limited. The blow-by gas BG whose flow velocity has been raised passes through the filter 130 and collides against the impact plate 133, while having foreign substances removed, whereby it is separated into the oil OL and the gas G not containing the mist of the oil OL. Then, the gas G having been separated from the blow-by gas BG by the separating portion 330 is emitted from the filter 130.

As described above, the guiding wall portion 203 is provided between the partition wall portion 200 and the upper surface portion 4A of the head cover 4. Thus, the gas G not containing the mist of the oil OL emitted from the filter 130 is guided by the guiding wall portion 203, passes through the passage 135 of the upper region 4Q and is led to the outlet portion 40. The guiding wall portion 203 can guide the gas G having been separated by the separating portion 330 to the outlet portion 40, since it is disposed in the head cover 4.

The separating portion 330 is located at the center position RP in the X-direction shown in FIG. 4 and plays a role as the collecting portion which can collect the blow-by gas BG from the front side and the rear side of the engine 1 toward the center part in the X-direction. As described above, since the separating portion 330 is located at the center position RP with respect to the X-direction of the head cover 4, the blow-by gas BG from the front side and the rear side with respect to the X-direction can be collected to the center part and can be separated into the oil OL and the gas G not containing the mist of the oil OL in the head cover 4.

<First Oil-Guiding Groove Portion 151 and Second Oil-Guiding Groove Portion 152>

The first oil-guiding groove portion 151 shown in FIG. 4 presents a groove shape and is provided from the front surface portion 4B of the head cover 4 to the vicinity of the filter 130. Similarly, the second oil-guiding groove portion 152 presents the groove shape and is provided from the rear surface portion 4C of the head cover 4 to the vicinity of the filter 130. The first oil-guiding groove portion 151 and the second oil-guiding groove portion 152 guide the oil OL having been separated from the blow-by gas BG by the separating portion 330. The first oil-guiding groove portion 151 is a specific structure example of the "first oil guiding portion" of the present invention and can guide the oil OL emitted from the filter 130 to the front indicated by the X1-direction when the engine 1 in FIG. 1 is inclined to the front side and can lead it to the first oil drain 161 on the front side. Similarly, the second oil-guiding groove portion 152 is a specific structure example of the "second oil guiding portion" of the present invention and can guide the oil OL emitted from the filter 130 to the rear indicated by an X2-direction when the engine 1 in FIG. 1 is inclined to the rear side and can lead it to the second oil drain 162 on the rear side.

Note that the first oil-guiding groove portion 151 and the second oil-guiding groove portion 152 may be connected to each other. In this case, in one of the oil-guiding groove portions, a portion provided from the filter 130 toward the front side of the engine 1 is called the first oil-guiding groove portion 151, while a portion provided from the filter 130 toward the rear side of the engine 1 is called the second oil-guiding groove portion 152.

<First Oil Drain 161 and Second Oil Drain 162>

The first oil drain 161 is provided on the front side of the engine 1 and presents a cylindrical shape, for example. The first oil drain 161 is provided downward, which is the Z1-direction in the head cover 4 at a front position of the first guiding lower-surface portion 231 of the partition wall portion 200. The first oil drain 161 has a check valve, temporarily stores the oil OL having been guided by the first oil-guiding groove portion 151 and discharges it into the engine 1. Similarly, the second oil drain 162 is provided on the rear side of the engine 1 and presents a cylindrical shape, for example. The second oil drain 162 is provided downward, which is the Z1-direction in the head cover 4 at a rear position of the second guiding lower-surface portion 232 of the partition wall portion 200. The second oil drain 162 has a check valve, temporarily stores the oil OL having been guided by the second oil-guiding groove portion 152 and discharges it into the engine 1.

As a result, if the engine 1 is inclined to the front side, the oil OL having been separated from the blow-by gas BG by the separating portion 330 is guided in the X1-direction by the first oil-guiding groove portion 151, is temporarily stored in the first oil drain 161 and then, is discharged in the Z1-direction through the first oil drain 161. Similarly, if the engine 1 is inclined to the rear side, the oil OL having been separated from the blow-by gas BG by the separating portion 330 is guided in the X2-direction by the second oil-guiding groove portion 152, is temporarily stored in the second oil drain 162 and then, is discharged in the Z1-direction through the second oil drain 162. In the head cover 4, the oil OL having been discharged from the first oil drain 161 and the second oil drain 162 is recovered by the oil pun 7 from the head cover 4 shown in FIG. 1, for example, through the aforementioned oil return path 99. Alternatively, the discharged oil OL can be also recovered by an oil container, not shown, for example. As a result, the oil OL discharged from the first oil drain 161 and the second oil drain 162 is discharged into the engine 1 and does not leak to the outside of the engine 1.

<Structure Example of Outlet Portion 40 of Blow-by Gas Treating Device 100 According to Second Embodiment>

Subsequently, a structure example of the outlet portion 40 of the blow-by gas treating device 100 according to the second embodiment will be described by referring to FIGS. 4 to 6.

As having been already described, the outlet portion 40 shown in FIG. 4 is provided by protruding toward the Z-direction in the head cover 4. The outlet portion 40 is disposed at the substantially center position CP, for example, with respect to the front-back direction, which is the X-direction of the main structure portion 101 of the head cover 4.

The outlet portion 40 adjusts the pressure of the gas G at the substantially center position CP, for example, of the engine 1 and sends only the gas G having been led from the main structure portion 101 to the pipe 41 of the intake system in the engine 1. In the outlet portion 40, a pressure regulation valve (diaphragm) 350, for example, is provided (See FIG. 6). The pressure regulation valve 350 provided in the outlet portion 40 suppresses flowing-in of the new intake air AR into the engine 1 through the blow-by gas mixing joint 70 and the pipe 41 of the intake system (see FIG. 1).

As illustrated in FIGS. 5 and 6, the outlet portion 40 can return the gas G having been separated from the blow-by gas BG by the separating portion 330 to the intake system of the engine 1 through the pipe 41 and reburn it. As a result, emission of the gas G having been separated from the blow-by gas BG to the outside of the engine 1 is prevented, and environmental performances of the engine 1 can be improved.

As shown in FIGS. 5 and 6, the outlet portion 40 has an outlet mounting portion 700 and a container body 750 fixed to the outlet mounting portion 700. The outlet mounting portion 700 is a part of the head cover 4 and is formed so as to rise from the upper surface portion 4A of the head cover 4 to the outside around a through hole 680 for gas discharge provided in the head cover 4. The through hole 680 for gas discharge is provided by penetrating the upper surface portion 4A of the head cover 4 circularly along the Z-direction. That is, a center axis of the through hole 680 for gas discharge is along the Z-direction. The through hole 680 causes the gas G having been separated from the blow-by gas BG by the separating portion 330 to be passed therethrough.

The container body 750 shown in FIGS. 5 and 6 is also called as a spacer or the like and is installed on the outlet mounting portion 700. Positions of four corners of the container body 750 are fixed removably with respect to the outlet mounting portion 700 by using four screws 751, for example. As a result, the container body 750 is removable from the outlet mounting portion 700, and a worker or the like can perform a maintenance work of the container body 750 and the outlet mounting portion 700 or replace the container body 750 or the like. On an upper surface 702 of the container body 750, the aforementioned pressure regulation valve 350 is mounted.

As shown in FIG. 6, the container body 750 is a substantially cuboid member having a lower-side internal space 720 and an upper-side internal space 721. The internal spaces 720, 721 communicate with each other, through which the gas G can pass. The upper-side internal space 721 is connected to the pipe 41 as shown in FIG. 5. The internal spaces 720, 721 of the container body 750 temporarily store the gas G having risen via the through hole 680 of the outlet mounting portion 700 from the inside of the head cover 4 and can supply it to the intake system side of the engine 1 shown in FIG. 1 through the pipe 41.

As shown in FIG. 6, the outlet mounting portion 700 has a mating surface 730 and an oil-guiding inclined surface 740. The oil-guiding inclined surface 740 of this embodiment is an example of the "oil guiding surface" of the present invention. The mating surface 730 and the oil-guiding inclined surface 740 are provided in a periphery of the through hole 680 around the through hole 680. The mating surface 730 of the upper end side of the outlet mounting portion 700 is a part contacting and in close contact with a mating surface 770 on the lower end side of the container body 750. The mating surfaces 730, 770 are flat surfaces in parallel with the horizontal installation surface on which the vehicle with the engine mounted is placed and is along the X-Y plane. That is, the mating surfaces 730, 770 are horizontal. Between the mating surfaces 730, 770, a seal member 745 is provided. The seal member 745 suppresses leakage of the gas G from a gap between the mating surface 730 of the outlet mounting portion 700 and the mating surface 770 of the container body 750 to the outside of the engine 1.

As shown in FIG. 6, the oil-guiding inclined surface 740 is a part connected to the mating surface 730 and the through hole 680 and is inclined downward from the mating surface 730 toward the through hole 680. The oil-guiding inclined surface 740 guides the oil OL remaining in the gas G having been separated from the blow-by gas BG by the separating portion 330 into the head cover 4. The details thereof will be described later. As shown in FIG. 5, the oil-guiding inclined surface 740 presents a part of the surface of a pyramid or specifically, presents a part of the surface of a conical body. That is, the oil-guiding inclined surface 740 is an inner surface of the outlet mounting portion 700 and is a surface inclined in a mortar shape tapered as it goes into the head cover 4 from the inside of the container body 750. Note that the oil-guiding inclined surface 740 is not limited to presenting of a part of the surface of the conical body but may present a part of the surface of a triangular prism or may present a part of the surface of a square prism, for example. The oil-guiding inclined surface 740 is formed with inclination only by a predetermined inclination angle W with respect to the horizontal installation surface on which the vehicle with the engine mounted is placed. The inclination angle W of the oil-guiding inclined surface 740 is approximately 15 degrees or more and 30 degrees or less, for example. According to this, while a dimension of the engine 1 in the up-down direction (Z-direction) is suppressed, the oil OL remaining in the gas G having been separated from the blow-by gas BG by the separating portion 330 can be guided into the head cover 4 more reliably.

As shown in FIG. 6, an upper end portion 741 of the oil-guiding inclined surface 740 corresponds to an inner end portion of the mating surface 730 of the outlet mounting portion 700 and most of it is covered by the mating surface 770 of the container body 750. That is, the upper end portion 741 of the oil-guiding inclined surface 740 is hardly exposed to the internal space 720. Thus, the horizontal mating surface 730 of the outlet mounting portion 700 is hardly exposed to the internal space 720. Moreover, a lower end portion 742 of the oil-guiding inclined surface 740 is formed gently continuing to an inner peripheral surface 681 of the through hole 680. As described above, the oil-guiding inclined surface 740 extends from the mating surface 770 of the container body 750 to the inner peripheral surface 681 of the through hole 680. In other words, the oil-guiding inclined surface 740 is formed over the entire region from the mating surface 770 of the container body 750 to the inner peripheral surface 681 of the through hole 680.

(Action Example of Blow-by Gas Treating Device 100 According to Second Embodiment)

Subsequently, an action example of the blow-by gas treating device 100 according to the second embodiment will be explained by referring to FIGS. 4 to 6.

The blow-by gas BG having leaked from between the piston 8 and the cylinder 5 shown in FIG. 1 reaches the lower region 4P of the head cover 4 shown in FIG. 4. The blow-by gas BG passes through the first blow-by gas taking-in portion 111 and the second blow-by gas taking-in portion 112, is taken in between the first guiding lower-surface portion 231 and the guiding plate 295 and between the second guiding lower-surface portion 232 and the guiding plate 295 and is guided toward the separating portion 330. Then, the blow-by gas BG having been guided toward the separating portion 330 reaches the impactor 120 of the separating portion 330 at the center position RP.

The impactor 120 raises the flow velocity of the blow-by gas BG flowing into the throttle hole 121 and then, leads the blow-by gas BG to the filter 130. The blow-by gas BG whose flow velocity has been raised passes through the filter 130 and collides against the impact plate 133, whereby it is separated into the oil OL and the gas G not containing the mist of the oil OL.

The gas G having been separated from the blow-by gas BG by the separating portion 330 is emitted from the filter 130, rises and is guided along the guiding wall portion 203, passes through the passage 135 of the upper region 4Q and is sent to the outlet portion 40. The gas G sent to the outlet portion 40 passes through the through hole 680 of the outlet mounting portion 700 and is temporarily stored in the internal spaces 720, 721 of the container body 750. Then, when internal pressures of the internal spaces 720, 721 become a predetermined pressure or more, or when an internal pressure of the pipe 41 becomes a predetermined pressure or less, the gas G temporarily stored in the internal spaces 720, 721 of the container body 750 passes through the pressure regulation valve 350, is led to the sub pipe 72 of the blow-by gas mixing joint 70 through the pipe 41, and is mixed in the new intake air AR.

Here, the separating portion 330 cannot completely separate the blow-by gas BG into the oil OL and the gas G in some cases. For example, the oil OL contained in the blow-by gas BG is not completely separated from the blow-by gas BG by the separating portion 330 but is led to the outlet portion 40 in some cases. Then, there is a concern that the oil OL contained in the blow-by gas BG remains in the outlet portion 40. For example, if there is a horizontal plane in the path through which the blow-by gas BG flows in the outlet portion 40, there is a concern that the oil OL contained in the blow-by gas BG remains on the horizontal plane.

When the oil OL remains in the outlet portion 40, since the internal pressures of the internal spaces 720, 721 of the outlet portion 40 are relatively high, even if the seal member 745 is provided, there is a concern that the remaining oil OL deludes out to the outside of the engine 1 from the gap between the mating surface 730 of the outlet mounting portion 700 and the mating surface 770 of the container body 750. Alternatively, when the oil OL remains in the outlet portion 40, the remaining oil OL is mixed with the steam contained in the blow-by gas BG and becomes an emulsion in some cases. When the emulsion is generated, there is a concern that a path of the blow-by gas BG is blocked. If the path of the blow-by gas BG is blocked, the internal pressure of the engine 1 rises, and there is a concern that components such as an oil gauge guide provided in the crank case 6, for example, is broken. Moreover, if the path of the blow-by gas BG is blocked, the internal pressure of the engine 1 rises, and there is a concern that the turbocharger sucks in the oil OL. As described above, if the oil OL contained in the blow-by gas BG remains in the outlet portion 40, such nonconformity occurs that the oil OL deludes out to the outside of the engine 1 or blocks the path of the blow-by gas BG.

On the other hand, the outlet mounting portion 700 of the blow-by gas treating device 100 according to this embodiment has the oil-guiding inclined surface 740. As described above, the oil-guiding inclined surface 740 is inclined downward toward the through hole 680 from the mating surface 730. Thus, even if the oil OL contained in the blow-by gas BG is led to the outlet portion 40, that is, even if the oil OL remains in the gas G having been separated from the blow-by gas BG by the separating portion 330, the oil OL flows on the oil-guiding inclined surface 740 and is guided into the head cover 4. As a result, remaining of the oil OL contained in the blow-by gas BG in the outlet portion 40 can be suppressed.

The oil OL having been guided from the outlet portion 40 into the head cover 4 by the oil-guiding inclined surface 740 flows on the guiding wall portion 203 and is led at least to either one of the first oil-guiding groove portion 151 and the second oil-guiding groove portion 152. At this time, if the guiding wall portion 203 is inclined downward toward the first oil-guiding groove portion 151 and the second oil-guiding groove portion 152, the oil OL is smoothly led from the guiding wall portion 203 at least by either one of the first oil-guiding groove portion 151 and the second oil-guiding groove portion 152. The oil OL having been led to the first oil-guiding groove portion 151 is guided forward indicated by the X1-direction shown in FIG. 4 and is led to the first oil drain 161 on the front side. Moreover, the oil OL having been led to the second oil-guiding groove portion 152 is guided rearward indicated by the X2-direction shown in FIG. 4 and is led to the second oil drain 162 on the rear side.

On the other hand, if the engine 1 is inclined to the front side, the oil OL having been separated from the blow-by gas BG by the separating portion 330 is emitted from the filter 130, is guided forward indicated by the X1-direction by the first oil-guiding groove portion 151 and is led to the first oil drain 161 on the front side. Similarly, if the engine 1 is inclined to the rear side, the oil OL having been separated from the blow-by gas BG by the separating portion 330 is emitted from the filter 130, is guided rearward indicated by the X2-direction by the second oil-guiding groove portion 152 and is led to the second oil drain 162 on the rear side.

The oil OL having been guided to the first oil drain 161 by the first oil-guiding groove portion 151 is temporarily stored in the first oil drain 161 and then, discharged into the engine 1 through the check valve provided on the first oil drain 161. Similarly, the oil OL having been guided to the second oil drain 162 by the second oil-guiding groove portion 152 is temporarily stored in the second oil drain 162 and then, discharged into the engine 1 through the check valve provided on the second oil drain 162. The oil OL discharged from the first oil drain 161 and the second oil drain 162 is recovered by the oil pun 7 from inside of the head cover 4 through the oil return path 99, for example.

According to the blow-by gas treating device 100 and the engine 1 according to this embodiment, the outlet portion 40 has the oil-guiding inclined surface 740 as an oil guiding surface for guiding the oil OL remaining in the gas G after having been separated from the blow-by gas BG into the head cover 4. As a result, even if the oil OL remains in the gas G after having been separated from the blow-by gas BG by the separating portion 330, the blow-by gas treating device 100 according to this embodiment can suppress the remaining of the oil OL contained in the blow-by gas BG in the outlet portion 40.

Moreover, the oil-guiding inclined surface 740 is inclined downward toward the through hole 680 from the mating surface 730. Thus, the oil OL remaining in the gas G after having been separated from the blow-by gas BG by the separating portion 330 flows downward on the oil-guiding inclined surface 740 toward the through hole 680, passes through the through hole 680, and is guided into the head cover more reliably. As a result, the blow-by gas treating device 100 according to this embodiment can suppress the remaining of the oil OL contained in the blow-by gas BG in the outlet portion 40 more reliably.

Moreover, the oil-guiding inclined surface 740 is formed over the entire region from the mating surface 730 to the inner peripheral surface 681 of the through hole 680. Thus, regarding the oil OL remaining in the gas G after having been separated from the blow-by gas BG by the separating portion 330, being caught or remaining at least in a part of the outlet portion 40 is suppressed but it smoothly flows downward on the oil-guiding inclined surface 740 toward the through hole 680. Then, the oil OL having flown on the oil-guiding inclined surface 740 toward the through hole 680 passes through the through hole 680 and is guided into the head cover 4 more reliably. As a result, the blow-by gas treating device 100 according to this embodiment can suppress the remaining of the oil OL contained in the blow-by gas BG in the outlet portion 40 more reliably.

Moreover, since the oil-guiding inclined surface 740 presents a part of the surface of the pyramid (conical body in this embodiment), the oil OL remaining in the gas G after having been separated from the blow-by gas BG by the separating portion 330 can smoothly flow downward on the oil-guiding inclined surface 740 toward the through hole 680.

Moreover, the oil OL having been guided into the head cover 4 from the outlet portion 40 by the oil-guiding inclined surface 740 flows on the guiding wall portion 203 and is led at least to either one of the first oil-guiding groove portion 151 and the second oil-guiding groove portion 152. The first oil-guiding groove portion 151 can guide the oil OL having been separated from the blow-by gas BG by the separating portion 330 to the first oil drain 161 and guide the oil OL having been guided into the head cover 4 from the outlet portion 40 by the oil-guiding inclined surface 740 to the first oil drain 161. Moreover, the second oil-guiding groove portion 152 can guide the oil OL having been separated from the blow-by gas BG by the separating portion 330 to the second oil drain 162 and guide the oil OL having been guided into the head cover 4 from the outlet portion 40 by the oil-guiding inclined surface 740 to the second oil drain 162. As a result, the oil OL having been separated from the blow-by gas BG is recovered by the oil pun 7 or the oil container provided in the engine 1, for example, and emission from the outlet portion 40 can be suppressed.

Moreover, according to the blow-by gas treating device 100 and the engine 1 including the blow-by gas treating device 100 according to this embodiment, the oil OL having been separated from the blow-by gas BG by the separating portion 330 is guided to the front side of the engine 1 by the first oil-guiding groove portion 151, is temporarily stored in the first oil drain 161 and then, is discharged into the engine 1. Moreover, the oil OL having been separated from the blow-by gas BG by the separating portion 330 is guided to the rear side of the engine 1 by the second oil-guiding groove portion 152, is temporarily stored in the second oil drain 162 and then, is discharged into the engine 1. Thus, in the blow-by gas treating device 100 according to this embodiment, the discharge path of the oil OL having been separated from the blow-by gas BG by the separating portion 330 is clear. Moreover, the gas G after the oil OL has been separated from the blow-by gas BG is led to the outlet portion 40 of the blow-by gas treating device 100 by the main structure portion 101. Then, the outlet portion 40 of the blow-by gas treating device 100 supplies the gas G having been led by the main structure portion 101 to the intake system of the engine 1. As described above, in the blow-by gas treating device 100 according to this embodiment, the discharge path of the oil OL having been separated from the blow-by gas BG by the separating portion 330 and the discharge path of the gas G having been separated from the blow-by gas BG by the separating portion 330 are clearly discriminated. As a result, even if the engine 1 is inclined in the front-back direction, emission of the oil OL having been separated from the blow-by gas BG from the outlet portion 40 can be suppressed. Moreover, since the flowing of the mist of the oil OL to the intake system can be suppressed, burning of the mist of the oil OL can be suppressed, and purification of the exhaust gas can be promoted.

Moreover, the separating portion 330 which separates the blow-by gas BG into the oil OL and the gas G is provided at the center part, that is, the center position RP between the first oil drain 161 which temporarily stores the oil OL having been guided by the first oil-guiding groove portion 151 and discharges it into the engine 1 and the second oil drain 162 which temporarily stores the oil OL having been guided by the second oil-guiding groove portion 152 and discharges it into the engine 1. As described above, the separating portion 330 is provided at the position relatively far from the first oil drain 161 and the second oil drain 162. Thus, even if the engine 1 is inclined in the front-back direction, mixing or re-mixing of the oil OL temporarily stored in the first oil drain 161 and the second oil drain 162 or the oil OL or the mist of the oil OL present above the first oil drain 161 and the second oil drain 162 in the gas G having been separated from the blow-by gas BG by the separating portion 330 can be suppressed. As a result, even if the engine 1 is inclined in the front-back direction, emission of the oil OL having been separated from the blow-by gas BG from the outlet portion 40 can be further suppressed.

Moreover, since mixing or re-mixing of the oil OL or the mist of the oil OL in the gas G having been separated from the blow-by gas BG by the separating portion 330 can be suppressed, emission of the oil OL having been separated from the blow-by gas BG from the outlet portion 40 can be suppressed regardless of the position of the outlet portion 40. As a result, the degree of freedom in selecting the installation position or the installation direction of the outlet portion 40 can be increased.

The first oil-guiding groove portion 151 and the second oil-guiding groove portion 152 present the groove shape and thus, even if the engine 1 is inclined in the front-back direction, it can guide the oil OL having been separated from the blow-by gas BG by the separating portion 330 to the front side and the rear side of the engine 1 reliably even with a simple structure.

Moreover, according to the blow-by gas treating device 100 according to this embodiment, the first blow-by gas taking-in portion 111 as well as the second blow-by gas taking-in portion 112 which take in the blow-by gas BG, and the first oil-guiding groove portion 151 as well as the second oil-guiding groove portion 152 which guide the oil OL are provided separately at positions on both sides on the upper surface side and the lower surface side through the common partition wall portion 200. Therefore, the first blow-by gas taking-in portion 111 as well as the second blow-by gas taking-in portion 112 and the first oil-guiding groove portion 151 as well as the second oil-guiding groove portion 152 can be provided as single members on the partition wall portion 200. Therefore, the dimension V (see FIG. 4) in the up-down direction of the blow-by gas treating device 100 can be suppressed. Thus, the height dimension of the head cover 4 in which the blow-by gas treating device 100 is disposed can be suppressed, and the height dimension of the engine 1 including the blow-by gas treating device 100 in the head cover 4 can be suppressed.

Moreover, the blow-by gas BG passes through the filter 130 and collides against the impact plate 133 after having the flow velocity raised by the impactor 120. Thus, the blow-by gas BG is separated into the oil OL and the gas G excluding the mist of the oil OL more reliably. Moreover, the impactor 120 raises the flow velocity of the blow-by gas BG along the vertical direction (up-down direction) at the center position RP in the front-back direction of the engine 1. Furthermore, the impact plate 133 extends in the horizontal direction and causes the blow-by gas BG having passed through the filter 130 to be collided. Thus, as compared with the case where the impactor raises the flow velocity of the blow-by gas along the horizontal direction and causes the blow-by gas to collide against the impact plate extending in the vertical direction, the dimension V in the up-down direction of the blow-by gas treating device 100 can be suppressed.

Subsequently, a third embodiment of the present invention will be described.

Note that, when constituent elements of the blow-by gas treating device according to the third embodiment are similar to the constituent elements of the blow-by gas treating devices according to the first embodiment and the second embodiment, duplicated explanation will be omitted as appropriate, and different points will be mainly explained below.

(Blow-by Gas Treating Device 100 According to Third Embodiment)

A preferred structure example of the blow-by gas treating device 100 according to the third embodiment will be described by referring to FIGS. 7 to 9.

Figure 7:
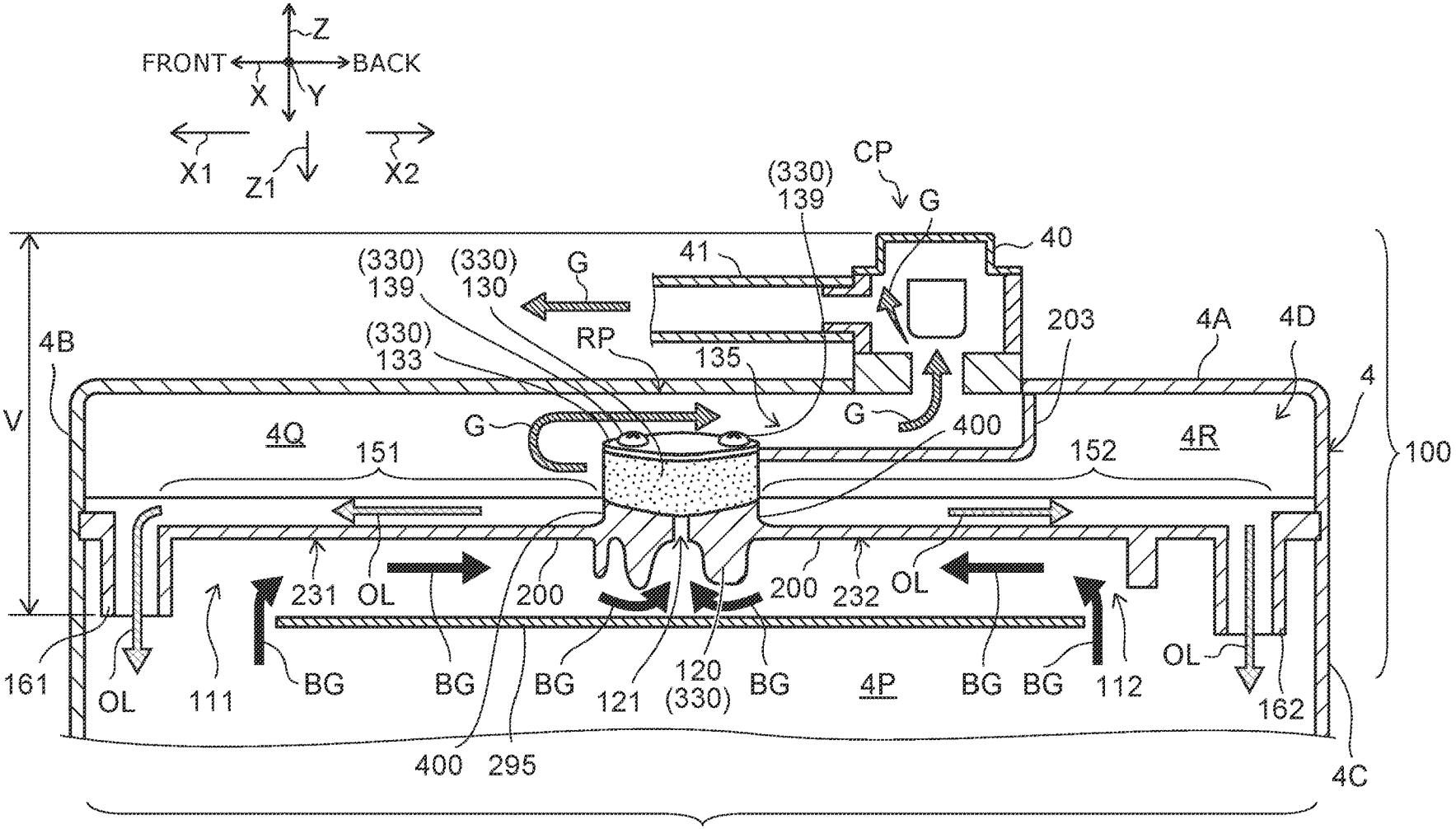
FIG. 7 is a sectional view on the X-Z plane illustrating the structure example of the blow-by gas treating device according to this embodiment.

FIG. 7 is a sectional view on the X-Z plane illustrating the structure example of the blow-by gas treating device according to this embodiment.

Figure 8:
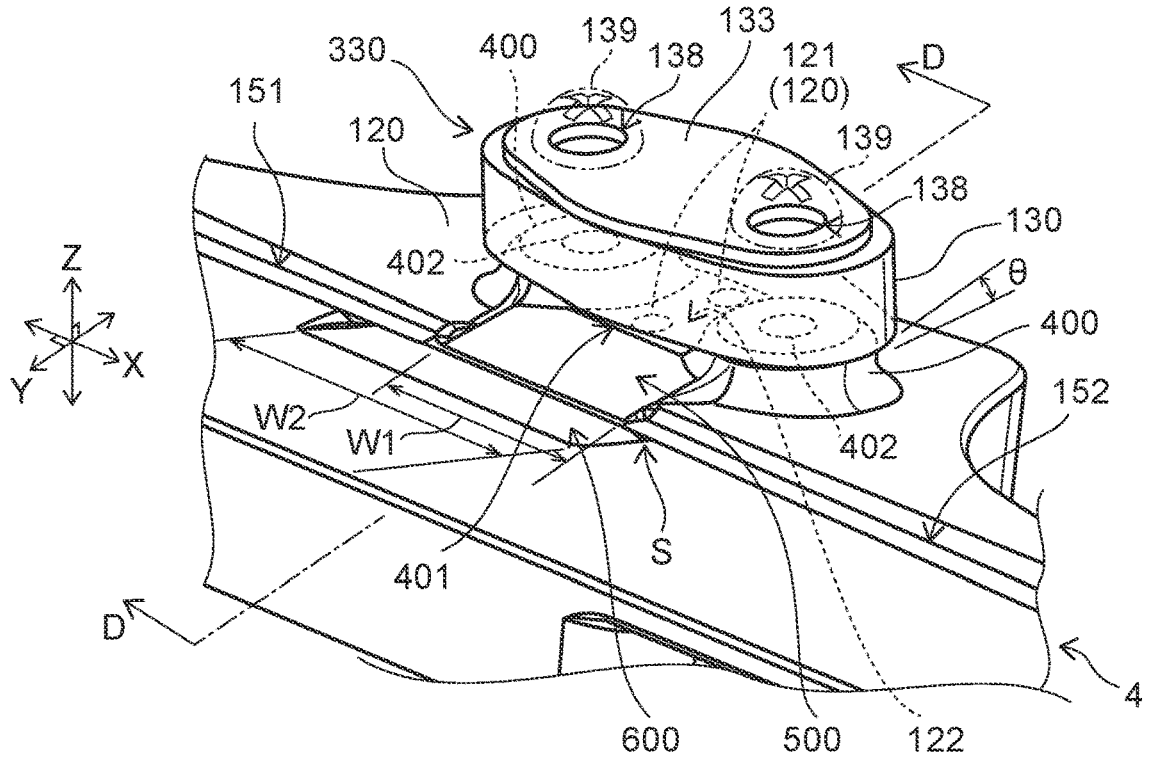
FIG. 8 is a perspective view illustrating a structure example of a separating portion and a peripheral region thereof of the blow-by gas treating device according to this embodiment.

FIG. 8 is a perspective view illustrating a structure example of the separating portion and the peripheral region thereof of the blow-by gas treating device according to this embodiment.

Figure 9:
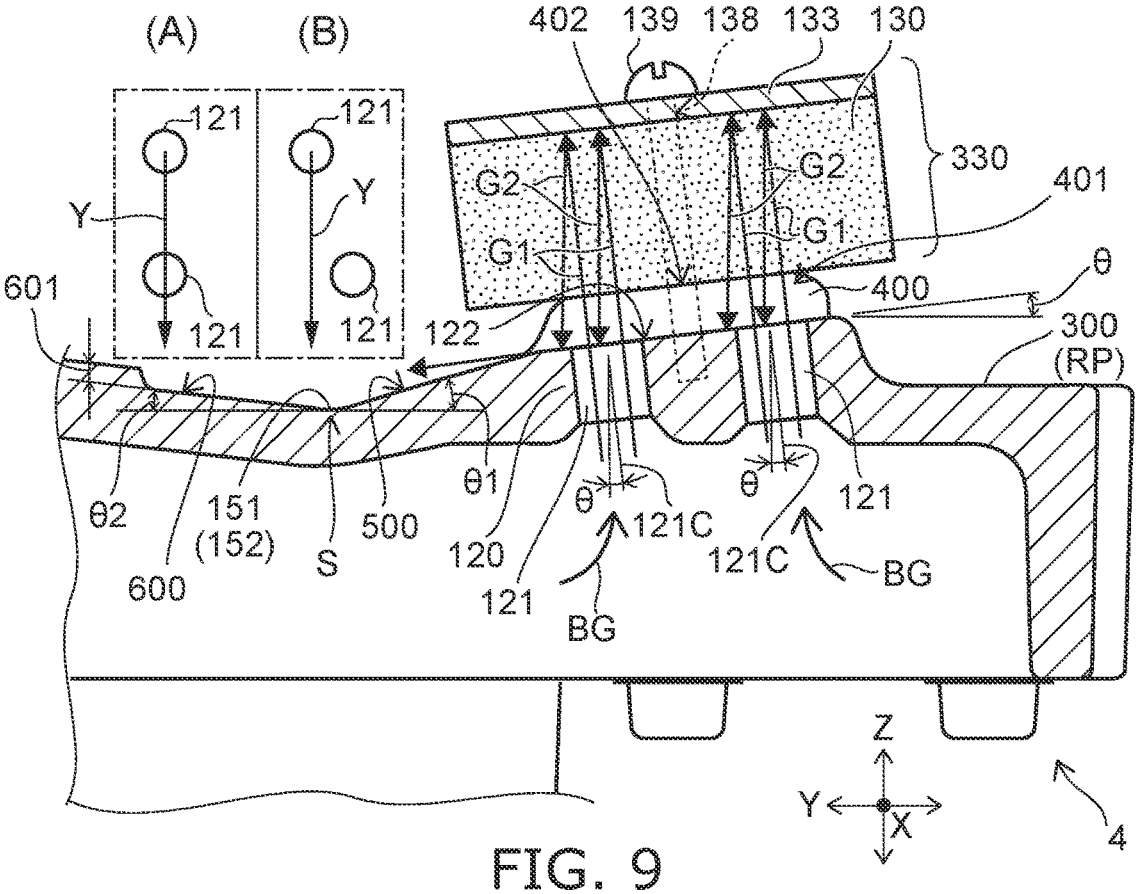
FIG. 9 is a sectional view on a D-D line along a Y-direction of the separating portion and the peripheral region thereof of the blow-by gas treating device according to this embodiment shown in FIG. 8.

FIG. 9 is a sectional view on the D-D line along the Y-direction of the separating portion and the peripheral region thereof of the blow-by gas treating device according to this embodiment shown in FIG. 8.

Here, the X-direction shown in FIGS. 7 to 9 is the front-back direction of the engine 1 shown in FIG. 1, that is, the axial direction of the crank shaft 9. The Y-direction is the left-right direction of the engine 1. The Z-direction is the up-down direction of the engine 1. The X, Y, and Z directions are orthogonal to one another.

As shown in FIGS. 1 and 7, the blow-by gas treating device 100 is also called a breather device or a breather and is disposed in the head cover 4. As shown in FIG. 7, the blow-by gas treating device 100 separates the blow-by gas BG into the oil OL and the gas G and can guide the oil OL and the gas G in separate paths.

The blow-by gas treating device 100 shown in FIG. 7 has the main structure portion 101 and the outlet portion 40. The main structure portion 101 is provided in the head cover 4. The outlet portion 40 is provided by protruding above the head cover 4. Moreover, as shown in FIG. 7, the outlet portion 40 is disposed at the substantially center position CP, for example, with respect to the front-back direction, which is the X-direction of the main structure portion 101. The outlet portion 40 adjusts the pressure of the gas G to be supplied to the intake system of the engine 1 at the substantially center position CP, for example, of the engine 1 and sends only the gas G having been led from the main structure portion 101 to the pipe 41 of the intake system in the engine 1. In the outlet portion 40, the pressure regulation valve (diaphragm), for example, is provided. The pressure regulation valve provided in the outlet portion 40 suppresses flowing-in of the new intake air AR into the engine 1 through the blow-by gas mixing joint 70 and the pipe 41 of the intake system shown in FIG. 1.

<Main Structure Portion 101 of Blow-by Gas Treating Device 100 According to Third Embodiment>

First, a preferred structure example of the main structure portion 101 of the blow-by gas treating device 100 according to the third embodiment will be described by referring to FIGS. 1 and 7.

As shown in FIGS. 1 and 7, the main structure portion 101 is accommodated in the head cover 4. Specifically, the head cover 4 has the upper surface portion 4A, the front surface portion 4B, the rear surface portion 4C, and the left and right surface portions 4D. The main structure portion 101 is disposed in a space surrounded by the upper surface portion 4A, the front surface portion 4B, the rear surface portion 4C, and the left and right surface portions 4D. The main structure portion 101 takes in and guides the blow-by gas BG and separates the oil OL and the gas G contained in the blow-by gas BG from the blow-by gas BG as shown in FIG. 7. Then, the main structure portion 101 guides the oil OL and the gas G in the separate paths so that the oil OL and the gas G separated from the blow-by gas BG do not leak out of the engine 1. For that purpose, the head cover 4 is held by the cylinder head 3 in a state where air tightness inside the head cover 4 is kept with respect to the outside of the head cover 4. As a result, leakage of the blow-by gas BG and the oil OL as well as the gas G having been separated from the blow-by gas BG to the outside of the engine 1 is suppressed.

As shown in FIG. 7, the main structure portion 101 roughly has the first blow-by gas taking-in portion 111, the second blow-by gas taking-in portion 112, the separating portion 330, the first oil-guiding groove portion 151, the second oil-guiding groove portion 152, the first oil drain 161, and the second oil drain 162. Each of the first oil-guiding groove portion 151 and the second oil-guiding groove portion 152 is an example of the "oil guiding portion" of the present invention.

As shown in FIG. 7, the main structure portion 101 has the partition wall portion 200, the guiding wall portion 203, and the guiding plate 295 in order to constitute the aforementioned constituent elements. The partition wall portion 200 is disposed on the X-Y plane in the head cover 4, that is, horizontally, and partitions the lower region 4P and the upper regions 4Q and 4R of the head cover 4 from each other. Therefore, the lower region 4P and the upper regions 4Q and 4R are spaces independent of one another.

As shown in FIG. 7, the guiding wall portion 203 guides the gas G after being treated, that is, only the gas G after the mist of the oil OL has been separated from the blow-by gas BG to the outlet portion 40 reliably. The guiding wall portion 203 is disposed between the partition wall portion 200 and the upper surface portion 4A of the head cover 4 and partitions the upper region 4Q and the upper region 4R from each other. Therefore, the upper region 4Q and the upper region 4R are spaces independent of each other.

<First Blow-by Gas Taking-In Portion 111 and Second Blow-by Gas Taking-In Portion 112>

Subsequently, the first blow-by gas taking-in portion 111 and the second blow-by gas taking-in portion 112 will be described by referring to FIG. 7.

The first blow-by gas taking-in portion 111 and the second blow-by gas taking-in portion 112 are holes formed by the partition wall portion 200 and the guiding plate 295 and take in the blow-by gas BG. The partition wall portion 200 is separated into the first guiding lower-surface portion 231 side and the second guiding lower-surface portion 232 side with the separating portion 330 as a center. The first blow-by gas taking-in portion 111 is provided at a position closer to the front surface portion 4B (that is, on the front side of the engine 1) and takes in the blow-by gas BG from the front side. In addition, the second blow-by gas taking-in portion 112 is provided at a position closer to the rear surface portion 4C (that is, on the rear side of the engine 1) and takes in the blow-by gas BG from the rear side. The guiding plate 295 shown in FIG. 7 has a portion away from the partition wall portion 200 so as to face the first guiding lower-surface portion 231 and the second guiding lower-surface portion 232 and is disposed along the X-Y plane.

As shown in FIG. 1, when the blow-by gas BG having risen in the crank case 6 reaches the lower region 4P of the head cover 4 shown in FIG. 7, it passes through the first blow-by gas taking-in portion 111 and is taken in between the first guiding lower-surface portion 231 and the guiding plate 295 of the partition wall portion 200 and is guided toward the separating portion 330. Alternatively, the blow-by gas BG passes through the second blow-by gas taking-in portion 112, is taken in between the second guiding lower-surface portion 232 and the guiding plate 295 and is guided toward the separating portion 330. Then, the blow-by gas BG reaches the impactor 120 of the separating portion 330 located at the center position RP with respect to the X-direction, which is the front-back direction, as an arrow indicated in FIG. 7.

<Separating Portion 330>

Subsequently, a preferred structure example of the separating portion 330 will be described by referring to FIGS. 7 to 9.

The separating portion 330 shown in FIG. 7 is also called an impactor-type separator, has the impactor 120, the filter 130, and the impact plate 133 and is provided between the first blow-by gas taking-in portion 111 and the second blow-by gas taking-in portion 112 in the front-back direction of the engine 1. More specifically, the separating portion 330 is provided at a center part between the first oil drain 161 and the second oil drain 162 in the front-back direction of the engine 1, that is, at the center position RP.

As shown in FIGS. 8 and 9, the separating portion 330 is provided with inclination only by a predetermined inclination angle θ with respect to the horizontal plane along the X-Y plane in the partition wall portion 200 of the head cover 4. Specifically, the separating portion 330 is provided with inclination in a direction in which the oil OL having been separated from the blow-by gas BG by the separating portion 330 is led to the first oil-guiding groove portion 151 and the second oil-guiding groove portion 152. More specifically, an upper surface 122 of the impactor 120 is inclined only by the redetermined inclination angle θ with respect to the horizontal plane along the X-Y plane. The upper surface 122 is a surface of the impactor 120 faced with the inner surface (that is, the lower surface) of the impact plate 133 and is an example of the "surface" of the present invention. The upper surface 122 of the impactor 120 is inclined downward toward the first oil-guiding groove portion 151 and the second oil-guiding groove portion 152. The filter 130 and the impact plate 133 are placed on setting portions 400, 400 provided on the upper surface 122 of the impactor 120, inclined by the predetermined inclination angle θ with respect to the horizontal plane, and moreover, is removably fixed. The separating portion 330 is provided with inclination so as to be lowered toward the first oil-guiding groove portion 151 and the second oil-guiding groove portion 152 side. The inclination angle θ is approximately 5 degrees or more and 45 degrees or less, for example. If the inclination angle θ is smaller than 5 degrees, the oil OL having been separated from the blow-by gas BG by the separating portion 330 cannot be rapidly guided to the first oil-guiding groove portion 151 and the second oil-guiding groove portion 152 through an oil-outlet inclined-guiding portion 500 easily. Moreover, if the inclination angle θ is larger than 45 degrees, the separated oil OL can be rapidly guided to the first oil-guiding groove portion 151 and the second oil-guiding groove portion 152 through the oil-outlet inclined-guiding portion 500, but an effective opening area of an inlet portion of the throttle hole 121 of the impactor 120 is narrowed, and the blow-by gas BG cannot be guided to the impactor 120 easily. Particularly, if the inclination angle θ is 60 degrees or more, for example, the effective opening area of the inlet portion of the throttle hole 121 of the impactor 120 is narrowed. And the blow-by gas BG remains in the inlet portion of the throttle hole 121 of the impactor 120, and a risk of freezing of the moisture in the blow-by gas BG increases.

Subsequently, each of constituent elements of the separating portion 330 will be described in order by referring to FIGS. 7 to 9.

<Impactor 120 of Separating Portion 330>

The impactor 120 shown in FIG. 7 has a function of a nozzle or an orifice. As shown in FIG. 9, the impactor 120 preferably has at least two throttle holes 121. The throttle hole 121 is a hole penetrating the impactor 120. A direction of an axis 121C of the throttle hole 121 is not along the vertical direction or the up-down direction, which is the Z-direction, but is inclined to the Z-direction only by the aforementioned inclination angle θ. That is, the axis 121C of the throttle hole 121 is orthogonal to the inner surface of the impact plate 133.

The two throttle holes 121, 121 are through holes, each having a circular sectional shape, for example, and in the example shown in FIGS. 8 and 9, as exemplified in FIG. 9(A), they are disposed in series along the Y-direction. As another example, as exemplified in FIG. 9(B), the two throttle holes 121, 121 may be disposed in a staggered manner with respect to the Y-direction. In other words, the two throttle holes 121, 121 may be disposed at positions shifted from each other in the X-direction when seen along the Y-direction. Details of the disposition of the two throttle holes 121, 121 will be described later. Note that, the set number of the throttle holes 121 is not limited to two but may be one or three or more. Moreover, the sectional shape of the throttle hole 121 is not limited to a circular shape but may be a triangle, a square or the like.

The impactor 120 is a flow-velocity rise operation portion which can raise the flow velocity of the blow-by gas BG by having the blow-by gas BG passed diagonally upward along the throttle hole 121. The impactor 120 is disposed at the center position RP with respect to the X-direction of the partition wall portion 200. As a result, the blow-by gas BG taken in by the first blow-by gas taking-in portion 111 and the blow-by gas BG taken in by the second blow-by gas taking-in portion 112 are uniformly guided to the impactor 120. The impactor 120 raises the flow velocity of the blow-by gas BG flowing in the throttle hole 121 and then, leads the blow-by gas BG to the filter 130.

<Filter 130 of Separating Portion 330>

As shown in FIGS. 7 and 8, the filter 130 is replaceably mounted on the partition wall portion 200, that is, on the setting portions 400, 400. The filter 130 is made of a material such as glass wool or the like, for example. However, the material of the filter 130 is not particularly limited. The filter 130 is fixed by screws 139, 139 for mounting so as to be sandwiched between the impact plate 133 and the setting portions 400, 400 of the impactor 120. That is, on the lower surface of the filter 130, the impactor 120 as the flow-velocity rise operating portion is disposed. On the upper surface of the filter 130, the impact plate 133 is disposed. The impact plate 133 is a metal plate, for example, and extends in a parallel direction with respect to the upper surface 122 of the impactor 120. The impact plate 133 has screw holes 138, 138 through which the two screws 139, 139 for mounting are passed, for example.

As shown in FIGS. 8 and 9, the setting portions 400, 400, each having a protruding shape protruding outward from the upper surface 122 of the impactor 120, are provided on the upper surface 122 of the impactor 120. The setting portions 400, 400 are portions for causing the filter 130 and the impact plate 133 to be inclined downward toward the first oil-guiding groove portion 151 and the second oil-guiding groove portion 152 and specifically, are portions for removably fixing the filter 130 and the impact plate 133 in a state inclined by the aforementioned inclination angle θ. The setting portions 400, 400 are formed so as to rise in a circular shape on the upper surface 122 of the impactor 120. A position of each of the setting portions 400, 400 corresponds to each of the positions of the screw holes 138, 138 of the impact plate 133. Each of the setting portions 400, 400 is provided with inclination in the direction in which the oil OL having been separated from the blow-by gas BG is led to the first oil-guiding groove portion 151 and the second oil-guiding groove portion 152 as the oil guiding portions.

As shown in FIG. 8, between the two setting portions 400, 400, an oil-guiding clearance region 401 is formed. The oil-guiding clearance region 401 is a space formed between the impactor 120 and the filter 130. That is, the setting portions 400, 400 form the oil-guiding clearance region 401 as the space between the impactor 120 and the filter 130. As shown in FIG. 8, the two throttle holes 121, 121 are provided so as to penetrate the portion of the impactor 120 in the oil-guiding clearance region 401. The two throttle holes 121, 121 of the impactor 120 raise the flow velocity of the blow-by gas BG diagonally upward and supply it to the filter 130. In the setting portions 400, 400, a female thread portion 402 is provided, respectively. Each of the screws 139 for mounting passes through the screw hole 138 of the impact plate 133 and the filter 130 and is fastened to the female thread portion 402 of the setting portion 400. As a result, the filter 130 is removably fixed between the impact plate 133 and the setting portion 400.

As exemplified in FIG. 9, the blow-by gas BG flows into the throttle hole 121 of the impactor 120 and diagonally rises on a Y-Z plane toward an arrow G1 direction, whereby the flow velocity is raised. The blow-by gas BG whose flow velocity has risen passes through the filter 130, while foreign substances are removed, and collides against the lower surface of the impact plate 133 and is separated into the oil OL and the gas G.

The gas G having been separated from the blow-by gas BG by the separating portion 330 is emitted from the filter 130. As described above, the guiding wall portion 203 is provided between the partition wall portion 200 and the upper surface portion 4A of the head cover 4. Thus, the gas G not containing the mist of the oil OL emitted from the filter 130 is guided by the guiding wall portion 203, passes through the passage 135 of the upper region 4Q, and is led to the outlet portion 40.

On the other hand, the oil OL having been separated from the blow-by gas BG by the separating portion 330 passes through the filter 130 and falls as indicated by an arrow G2 in FIG. 9 and drops onto the upper surface 122 of the impactor 120 in the oil-guiding clearance region 401. The oil OL having dropped on the upper surface 122 of the impactor 120 flows along the upper surface 122 of the impactor 120 in the oil-guiding clearance region 401 and flows toward the first oil-guiding groove portion 151 and the second oil-guiding groove portion 152.

The separating portion 330 having the aforementioned structure is located at the center position RP in the X-direction shown in FIG. 7 and plays a role as a collecting portion which can collect the blow-by gas BG from the front side and the rear side of the engine 1 toward the center part in the X-direction. As described above, the separating portion 330 is located at the center position RP with respect to the X-direction of the head cover 4 and thus, in the head cover 4, it can collect, at the center part, the blow-by gas BG from the front side and the rear side with respect to the X-direction and separate it into the oil OL and the gas G not containing the mist of the oil OL.

<Oil-Outlet Inclined-Guiding Portion 500 and Oil Inclined-Guiding Return Portion 600>

Subsequently, the oil-outlet inclined-guiding portion 500 and the oil inclined-guiding return portion 600 will be described by referring to FIGS. 8 and 9.

As shown in FIGS. 8 and 9, the oil-outlet inclined-guiding portion 500 is provided between the oil-guiding clearance region 401 and the first oil-guiding groove portion 151 as well as the second oil-guiding groove portion 152. The oil-outlet inclined-guiding portion 500 is connected to the upper surface 122 of the impactor 120 in the oil-guiding clearance region 401 and to the first oil-guiding groove portion 151 as well as the second oil-guiding groove portion 152 and is formed with inclination in the direction lowering from the upper surface 122 of the impactor 120 toward the first oil-guiding groove portion 151 and the second oil-guiding groove portion 152. That is, the oil-outlet inclined-guiding portion 500 is formed with the inclination in the direction lowering from the upper surface 122 of the impactor 120 toward the first oil-guiding groove portion 151 and the second oil-guiding groove portion 152 in order to lead the oil OL having been separated from the blow-by gas BG by the separating portion 330 and flowing along the upper surface 122 of the impactor 120 to the first oil-guiding groove portion 151 and the second oil-guiding groove portion 152 as the oil guiding portions.

An inclination angle θ1 by which the oil-outlet inclined-guiding portion 500 is inclined with respect to the horizontal plane (X-Y plane) is preferably larger than the inclination angle θ1 of the upper surface 122 of the impactor 120 with respect to the horizontal plane. If the inclination angle θ1 is larger than the inclination angle θ, when the oil OL having been separated from the blow-by gas BG by the separating portion 330 and flown and fallen along the upper surface 122 of the impactor 120 flows down the oil-outlet inclined-guiding portion 500, the flow velocity of the oil OL becomes higher as compared with a case where the oil OL flows on the upper surface 122 of the impactor 120. Thus, the oil OL having been separated from the blow-by gas BG by the separating portion 330 can be rapidly led from the upper surface 122 of the impactor 120 to the first oil-guiding groove portion 151 and the second oil-guiding groove portion 152. Moreover, since the oil OL cannot remain on the upper surface 122 of the impactor 120 easily, mixing of the oil OL having been separated from the blow-by gas BG by the separating portion 330 in the blow-by gas BG again can be suppressed.

Moreover, as shown in FIGS. 8 and 9, the oil inclined-guiding return portion 600 is provided on a side opposite to the oil-outlet inclined-guiding portion 500 when seen from the first oil-guiding groove portion 151 and the second oil-guiding groove portion 152. That is, the oil-outlet inclined-guiding portion 500 is provided on one of sides (sides on which the separating portion 330 is provided) of the first oil-guiding groove portion 151 and the second oil-guiding groove portion 152, and the oil inclined-guiding return portion 600 is provided on the other sides of the first oil-guiding groove portion 151 and the second oil-guiding groove portion 152. The oil inclined-guiding return portion 600 is formed with inclination so as to have a counter gradient with respect to the gradient of the oil-outlet inclined-guiding portion 500 from the position of the lowest portion of the oil-outlet inclined-guiding portion 500. That is, as exemplified in FIG. 9, the oil-outlet inclined-guiding portion 500 and the oil inclined-guiding return portion 600 are formed substantially in a V-shape when seen on a section. An inclination angle θ2 of the oil inclined-guiding return portion 600 is not particularly limited but is set to an angle substantially the same as the inclination angle θ1 or smaller than the inclination angle θ1, for example. The inclination angle θ2 of the oil inclined-guiding return portion 600 is approximately 5 degrees or more and 10 degrees or less, for example. If the inclination angle θ2 of the oil inclined-guiding return portion 600 is smaller than 5 degrees, the oil OL temporarily stored or pooled in the oil inclined-guiding return portion 600 cannot be rapidly guided to the first oil-guiding groove portion 151 and the second oil-guiding groove portion 152 easily. Moreover, if the inclination angle θ2 of the oil inclined-guiding return portion 600 is larger than 10 degrees, a speed at which the oil OL temporarily stored or pooled in the oil inclined-guiding return portion 600 is guided to the first oil-guiding groove portion 151 and the second oil-guiding groove portion 152 is too high, and there is a concern that the oil OL returns to the oil-outlet inclined-guiding portion 500 on the opposite side.

The oil inclined-guiding return portion 600 temporarily stores or pools the oil OL in order to prevent flow-out of the oil OL from the oil-outlet inclined-guiding portion 500, the first oil-guiding groove portion 151, and the second oil-guiding groove portion 152 by momentum of the flow of the oil OL, when the oil OL having been separated from the blow-by gas BG by the separating portion 330 flows from the upper surface 122 of the impactor 120 via the oil-outlet inclined-guiding portion 500. Then, the oil inclined-guiding return portion 600 guides the oil OL to the first oil-guiding groove portion 151 and the second oil-guiding groove portion 152 and returns it. As described above, the oil inclined-guiding return portion 600 has a function of buffering or pooling oil for temporarily storing the oil OL having been separated from the blow-by gas BG by the separating portion 330 and guiding it to the first oil-guiding groove portion 151 and the second oil-guiding groove portion 152 and returning it. As shown in FIG. 9, the oil inclined-guiding return portion 600 has a step 601 in order to suppress flow-out of the oil OL from the oil-outlet inclined-guiding portion 500, the first oil-guiding groove portion 151, and the second oil-guiding groove portion 152 more reliably.

As shown in FIGS. 8 and 9, the lowest portion of the oil-outlet inclined-guiding portion 500 and the lowest portion of the oil inclined-guiding return portion 600 are connected at an intersection connection position S. The intersection connection position S extends along the X-direction and is located between the first oil-guiding groove portion 151 and the second oil-guiding groove portion 152.

Moreover, as shown in FIG. 8, a width W2 in the X-direction of the oil inclined-guiding return portion 600 is set larger than a width W1 in the X-direction of the oil-outlet inclined-guiding portion 500. The width W1 in the X-direction and the width W2 in the X-direction are examples of the "length" in the "direction in which the oil guiding portion extends" in the present invention. As a result, even if the oil OL having been separated from the blow-by gas BG by the separating portion 330 flows from the upper surface 122 of the impactor 120 via the oil-outlet inclined-guiding portion 500, the oil inclined-guiding return portion 600 accommodates the oil OL with allowance while overflow of the flowing-in oil OL is suppressed and then, can cause it to flow to the first oil-guiding groove portion 151 and the second oil-guiding groove portion 152 and to return.

<First Oil-Guiding Groove Portion 151 and Second Oil-Guiding Groove Portion 152>

The first oil-guiding groove portion 151 shown in FIG. 7 presents a groove shape and is provided from the front surface portion 4B of the head cover 4 to the vicinity of the filter 130 and is inclined downward from the filter 130 toward the front surface portion 4B of the head cover 4. Similarly, the second oil-guiding groove portion 152 presents the groove shape and is provided from the rear surface portion 4C of the head cover 4 to the vicinity of the filter 130 and is inclined downward from the filter 130 toward the rear surface portion 4C of the head cover 4. The first oil-guiding groove portion 151 and the second oil-guiding groove portion 152 guide the oil OL having been separated from the blow-by gas BG by the separating portion 330. The first oil-guiding groove portion 151 is a specific structure example of the "first oil guiding portion" of the present invention and can guide the oil OL emitted from the filter 130 to the front indicated by the X1-direction when the engine 1 in FIG. 1 is inclined to the front side and can lead it to the first oil drain 161 on the front side. Similarly, the second oil-guiding groove portion 152 is a specific structure example of the "second oil guiding portion" of the present invention and can guide the oil OL emitted from the filter 130 to the rear indicated by the X2-direction when the engine 1 in FIG. 1 is inclined to the rear side and can lead it to the second oil drain 162 on the rear side.

The first oil-guiding groove portion 151 and the second oil-guiding groove portion 152 are connected to each other through the aforementioned oil-outlet inclined-guiding portion 500 and the oil inclined-guiding return portion 600.

<First Oil Drain 161 and Second Oil Drain 162>

The first oil drain 161 is provided on the front side of the engine 1 and presents a cylindrical shape, for example. The first oil drain 161 is provided downward, which is the Z1-direction in the head cover 4, at the front position of the first guiding lower-surface portion 231 of the partition wall portion 200. The first oil drain 161 has a check valve, temporarily stores the oil OL having been guided by the first oil-guiding groove portion 151 and discharges it into the engine 1. Similarly, the second oil drain 162 is provided on the rear side of the engine 1 and presents a cylindrical shape, for example. The second oil drain 162 is provided downward, which is the Z1-direction in the head cover 4, at the rear position of the second guiding lower-surface portion 232 of the partition wall portion 200. The second oil drain 162 has a check valve, temporarily stores the oil OL having been guided by the second oil-guiding groove portion 152 and discharges it into the engine 1.

As a result, if the engine 1 is inclined to the front side, the oil OL having been separated from the blow-by gas BG by the separating portion 330 is guided in the X1-direction by the first oil-guiding groove portion 151, is temporarily stored in the first oil drain 161 and then, is discharged in the Z1-direction through the first oil drain 161. Similarly, if the engine 1 is inclined to the rear side, the oil OL having been separated from the blow-by gas BG by the separating portion 330 is guided in the X2-direction by the second oil-guiding groove portion 152, is temporarily stored in the second oil drain 162 and then, is discharged in the Z1-direction through the second oil drain 162. In the head cover 4, the oil OL having been discharged from the first oil drain 161 and the second oil drain 162 is recovered by the oil pun 7 from the head cover 4 shown in FIG. 1, for example, through the aforementioned oil return path 99. Alternatively, the discharged oil OL can be also recovered by the oil container, not shown, for example. As a result, the oil OL discharged from the first oil drain 161 and the second oil drain 162 is discharged into the engine 1 and does not leak to the outside of the engine 1.

(Action Example of Blow-by Gas Treating Device 100 According to Third Embodiment)

Subsequently, an action example of the blow-by gas treating device 100 according to the third embodiment will be explained by referring to FIGS. 7 to 8.

The blow-by gas BG having leaked from between the piston 8 and the cylinder 5 shown in FIG. 1 reaches the lower region 4P of the head cover 4 shown in FIG. 7. The blow-by gas BG passes through the first blow-by gas taking-in portion 111 and the second blow-by gas taking-in portion 112, is taken in between the first guiding lower-surface portion 231 and the guiding plate 295 and between the second guiding lower-surface portion 232 and the guiding plate 295 and is guided toward the separating portion 330. Then, the blow-by gas BG having been guided toward the separating portion 330 reaches the impactor 120 of the separating portion 330 at the center position RP.

The impactor 120 shown in FIGS. 7 and 9 raises the flow velocity of the blow-by gas BG flowing into the throttle hole 121 and then, leads the blow-by gas BG to the filter 130 along the direction of the axis 121C of the throttle hole 121 inclined by the inclination angle θ, that is, along an arrow G1-direction shown in FIG. 9. The blow-by gas BG whose flow velocity has been raised collides against the inner surface (that is, the lower surface) of the impact plate 133 through the filter 130. At this time, the axis 121C of the throttle hole 121 intersects the inner surface of the impact plate 133. Thus, the blow-by gas BG having passed through the throttle hole 121 and whose flow velocity has risen perpendicularly collides against the inner surface of the impact plate 133. As a result, the blow-by gas BG receives a strong impact force from the impact plate 133 and is separated into the oil OL and the gas G not containing the mist of the oil OL more reliably.

As shown in FIG. 7, the gas G having been separated from the blow-by gas BG by the separating portion 330 is emitted from the filter 130, rises and passes through the passage 135 of the upper region 4Q, and is sent to the outlet portion 40.

On the other hand, the oil OL having been separated from the blow-by gas BG by the separating portion 330 falls along an arrow G2 shown in FIG. 9 while passing through the filter 130 and drops on the upper surface 122 of the impactor 120 in the oil-guiding clearance region 401. As described above, the oil OL having been separated from the blow-by gas BG at the impact plate 133 drops onto the upper surface 122 of the impactor 120 toward a direction (a direction of an arrow G2 shown in FIG. 9, that is, the vertical direction) different from the direction (a direction of an arrow G1 shown in FIG. 9) of the flow of the blow-by gas BG colliding against the inner surface of the impact plate 133. Thus, entry of the oil OL having been separated from the blow-by gas BG at the impact plate 133 into the throttle hole 121 is suppressed, and blocking of the throttle hole 121 can be suppressed.

Here, if the surface of the impactor faced with the impact plate 133 which separates the blow-by gas BG into the oil OL and the gas G is in parallel with the horizontal plane, there is a concern that the oil OL having been separated from the blow-by gas BG remains on the surface of the impactor. The oil OL having been separated from the blow-by gas BG contains a moisture (steam). Thus, when a temperature is relatively low, the moisture containing in the oil OL remaining on the surface of the impactor is frozen on the surface of the impactor in some cases. Then, the through hole formed in the impactor, through which the blow-by gas BG is passed, is blocked in some cases. When the through hole of the impactor is blocked, there is nonconformity that the blow-by gas BG cannot be separated into the oil OL and the gas G.

On the other hand, in the blow-by gas treating device 100 according to this embodiment, the separating portion 330 is provided in the partition wall portion 200 of the head cover 4 with inclination only by the predetermined inclination angle θ with respect to the horizontal plane along the X-Y plane. Specifically, the separating portion 330 is provided with inclination in the direction in which the oil OL having been separated from the blow-by gas BG by the separating portion 330 is led to the first oil-guiding groove portion 151 and the second oil-guiding groove portion 152. More specifically, the upper surface 122 of the impactor 120 is inclined only by the predetermined inclination angle θ with respect to the horizontal plane along the X-Y plane. Thus, the oil OL having dropped onto the upper surface 122 of the impactor 120 flows on the upper surface 122 of the impactor 120 inclined by the inclination angle θ by its own weight and flows into the oil-outlet inclined-guiding portion 500 with the larger inclination angle θ1.

As a result, the oil OL having been separated from the blow-by gas BG is reliably led from the upper surface 122 of the impactor 120 to the oil-outlet inclined-guiding portion 500. Then, even if the oil OL gushes in along the oil-outlet inclined-guiding portion 500, it is temporarily stored in the oil inclined-guiding return portion 600 which has a counter gradient. Therefore, the oil OL does not overflow to a region other than the oil-outlet inclined-guiding portion 500 and the oil inclined-guiding return portion 600 from the oil-outlet inclined-guiding portion 500 and the oil inclined-guiding return portion 600 but can flow at least to either one of the first oil-guiding groove portion 151 and the second oil-guiding groove portion 152 from the oil-outlet inclined-guiding portion 500 and the oil inclined-guiding return portion 600.

Moreover, the width W2 in the X-direction of the oil inclined-guiding return portion 600 is set larger than the width W1 in the X-direction of the oil-outlet inclined-guiding portion 500. As a result, even if the oil OL having been separated from the blow-by gas BG by the separating portion 330 flows via the oil-outlet inclined-guiding portion 500 from the upper surface 122 of the impactor 120, the oil inclined-guiding return portion 600 accommodates the oil OL with allowance while suppressing the overflow of the flowing-in oil OL and then, can be made to flow so as to return to the first oil-guiding groove portion 151 and the second oil-guiding groove portion 152.

Note that, as described above in relation with FIG. 9(B), the two throttle holes 121, 121 may be disposed at positions shifted from each other in the X-direction when seen along the Y-direction. In other words, they may be disposed at positions shifted from each other in the inclination direction of the upper surface 122 of the impactor 120, that is, the direction (X-direction in this embodiment) intersecting the flow direction of the oil OL flowing on the upper surface 122 of the impactor 120. According to this, flowing-in of the oil OL flowing from the upper surface 122 of the impactor 120 toward the oil-outlet inclined-guiding portion 500 into the throttle hole 121 disposed on the downstream side in the two throttle holes 121, 121 and blocking the throttle hole 121 on the downstream side can be suppressed. As a result, the operation of causing the blow-by gas BG to collide against the impact plate 133 and to separate it into the oil OL and the gas G is performed more reliably.

In FIG. 7, when the engine 1 is inclined to the front side, the oil OL having been separated from the blow-by gas BG by the separating portion 330 is emitted from the filter 130, is guided to the front indicated by the X1-direction by the first oil-guiding groove portion 151, and is led to the first oil drain 161 on the front side. Similarly, when the engine 1 is inclined to the rear side, the oil OL having been separated from the blow-by gas BG by the separating portion 330 is emitted from the filter 130, is guided to the rear indicated by the X2-direction by the second oil-guiding groove portion 152, and is led to the second oil drain 162 on the rear side.

The oil OL having been guided to the first oil drain 161 by the first oil-guiding groove portion 151 is temporarily stored in the first oil drain 161 and then, is discharged into the engine 1 through the check valve provided on the first oil drain 161. Similarly, the oil OL having been guided to the second oil drain 162 by the second oil-guiding groove portion 152 is temporarily stored in the second oil drain 162 and then, is discharged into the engine 1 through the check valve provided on the second oil drain 162. The oil OL discharged from the first oil drain 161 and the second oil drain 162 is recovered by the oil pun 7 through the oil return path 99 from inside the head cover 4, for example.

According to the blow-by gas treating device 100 and the engine 1 according to this embodiment, the separating portion 330 is provided with inclination in the direction in which the oil OL having been separated from the blow-by gas BG by the separating portion 330 is led to the first oil-guiding groove portion 151 and the second oil-guiding groove portion 152. Thus, the oil OL having been separated from the blow-by gas BG by the separating portion 330 does not remain in the separating portion 330 but is led to the first oil-guiding groove portion 151 and the second oil-guiding groove portion 152. As a result, the blow-by gas treating device 100 according to this embodiment can suppress remaining of the oil OL contained in the blow-by gas BG and can suppress freezing of the moisture contained in the oil OL at a low temperature. As a result, the operation of separating the blow-by gas BG into the oil OL and the gas G by the separating portion 330 is performed more reliably.

Moreover, the impactor 120 causes the blow-by gas BG to collide against the impact plate 133 while raising the flow velocity of the blow-by gas BG along the direction inclined with respect to the vertical direction (up-down direction). As a result, the blow-by gas BG is reliably separated into the oil OL and the gas G. And the oil OL having been separated from the blow-by gas BG at the impact plate 133 passes through the filter 130 and drops onto the upper surface 122 of the impactor 120 faced with the impact plate 133. Here, the upper surface 122 of the impactor 120 is inclined downward toward the first oil-guiding groove portion 151 and the second oil-guiding groove portion 152. Thus, the oil OL having dropped onto the upper surface 122 of the impactor 120 flows on the upper surface 122 of the impactor 120 by its own weight and is led to the first oil-guiding groove portion 151 and the second oil-guiding groove portion 152. As a result, the blow-by gas treating device 100 according to this embodiment can suppress the remaining of the oil OL contained in the blow-by gas BG and can suppress the freezing of the moisture contained in the oil OL at a low temperature more reliably.

Moreover, the setting portion 400 on which the filter 130 is placed protrudes outward from the upper surface 122 of the impactor 120 and forms the oil-guiding clearance region 401 as a space between the impactor 120 and the filter 130. And the oil OL having been separated from the blow-by gas BG by the separating portion 330 flows along the upper surface 122 of the impactor 120 in the oil-guiding clearance region 401. As a result, remaining of the oil OL having been separated from the blow-by gas BG on the upper surface 122 of the impactor 120 is suppressed more reliably, and the oil OL having been separated from the blow-by gas BG is led from the oil-guiding clearance region 401 formed between the impactor 120 and the filter 130 toward the first oil-guiding groove portion 151 and the second oil-guiding groove portion 152 more reliably.

Moreover, the inclination angle θ1 of the oil-outlet inclined-guiding portion 500 with respect to the horizontal plane is larger than the inclination angle θ of the upper surface 122 of the impactor 120 with respect to the horizontal plane. As a result, the oil-outlet inclined-guiding portion 500 can rapidly lead the oil OL having been separated from the blow-by gas BG by the separating portion 330 and having flown along the upper surface 122 of the impactor 120 to the first oil-guiding groove portion 151 and the second oil-guiding groove portion 152. Moreover, the remaining of the oil OL in the vicinity of the upper surface 122 of the impactor 120 is suppressed, and the mixing of the oil OL having been separated from the blow-by gas BG by the separating portion 330 in the blow-by gas BG again can be suppressed.

Furthermore, according to the blow-by gas treating device 100 and the engine 1 including the blow-by gas treating device 100 according to this embodiment, the oil OL having been separated from the blow-by gas BG by the separating portion 330 is guided to the front side of the engine 1 by the first oil-guiding groove portion 151, is temporarily stored in the first oil drain 161 and then, is discharged into the engine 1. Moreover, the oil OL having been separated from the blow-by gas BG by the separating portion 330 is guided to the rear side of the engine 1 by the second oil-guiding groove portion 152, is temporarily stored in the second oil drain 162 and then, is discharged into the engine 1. Thus, in the blow-by gas treating device 100 according to this embodiment, the discharge path of the oil OL having been separated from the blow-by gas BG by the separating portion 330 is clear. Moreover, the gas G after the oil OL has been separated from the blow-by gas BG is led to the outlet portion 40 of the blow-by gas treating device 100 by the main structure portion 101. And the outlet portion 40 of the blow-by gas treating device 100 supplies the gas G having been led by the main structure portion 101 to the intake system of the engine 1. As described above, in the blow-by gas treating device 100 according to this embodiment, the discharge path of the oil OL having been separated from the blow-by gas BG by the separating portion 330 and the discharge path of the gas G having been separated from the blow-by gas BG by the separating portion 330 are clearly discriminated. As a result, even if the engine 1 is inclined to the front-back direction, emission of the oil OL having been separated from the blow-by gas BG from the outlet portion 40 can be suppressed. Moreover, since flowing of the mist of the oil OL to the intake system can be suppressed, burning of the mist of the oil OL can be suppressed, purification of the exhaust gas can be promoted.

Moreover, the separating portion 330 which separates the blow-by gas BG into the oil OL and the gas G is provided at the center part, that is, the center position RP between the first oil drain 161 which temporarily stores the oil OL having been guided by the first oil-guiding groove portion 151 and discharges it into the engine 1 and the second oil drain 162 which temporarily stores the oil OL having been guided by the second oil-guiding groove portion 152 and discharges it into the engine 1. As described above, the separating portion 330 is provided at a position relatively far from the first oil drain 161 and the second oil drain 162. Thus, even if the engine 1 is inclined in the front-back direction, mixing or re-mixing of the oil OL temporarily stored in the first oil drain 161 and the second oil drain 162 or the oil OL or the mist of the oil OL present above the first oil drain 161 and the second oil drain 162 in the gas G having been separated from the blow-by gas BG by the separating portion 330 can be suppressed. As a result, even if the engine 1 is inclined in the front-back direction, emission of the oil OL having been separated from the blow-by gas BG from the outlet portion 40 can be further suppressed.

Moreover, since mixing or re-mixing of the oil OL or the mist of the oil OL in the gas G having been separated from the blow-by gas BG by the separating portion 330 can be suppressed, emission of the oil OL having been separated from the blow-by gas BG from the outlet portion 40 can be suppressed regardless of the position of the outlet portion 40. As a result, a degree of freedom in selecting an installation position or an installation direction of the outlet portion 40 can be increased.

The first oil-guiding groove portion 151 and the second oil-guiding groove portion 152 present the groove shape and thus, even if the engine 1 is inclined in the front-back direction, the oil OL having been separated from the blow-by gas BG by the separating portion 330 can be guided to the front side and the rear side of the engine 1 reliably even with a simple structure.

Moreover, according to the blow-by gas treating device 100 according to this embodiment, the first blow-by gas taking-in portion 111 as well as the second blow-by gas taking-in portion 112 which take in the blow-by gas BG, and the first oil-guiding groove portion 151 as well as the second oil-guiding groove portion 152 which guide the oil OL are provided separately at positions on both sides on the upper surface side and the lower surface side through the common partition wall portion 200. Therefore, the first blow-by gas taking-in portion 111 as well as the second blow-by gas taking-in portion 112 and the first oil-guiding groove portion 151 as well as the second oil-guiding groove portion 152 can be provided as single members on the partition wall portion 200. Therefore, the dimension V (see FIG. 7) in the up-down direction of the blow-by gas treating device 100 can be suppressed. Thus, the height dimension of the head cover 4 in which the blow-by gas treating device 100 is disposed can be suppressed, and the height dimension of the engine 1 including the blow-by gas treating device 100 in the head cover 4 can be suppressed.

Moreover, the blow-by gas BG passes through the filter 130 and collides against the impact plate 133 after having the flow velocity raised by the impactor 120. Thus, the blow-by gas BG is separated into the oil OL and the gas G excluding the mist of the oil OL more reliably. Moreover, the impactor 120 raises the flow velocity of the blow-by gas BG along the direction inclined with respect to the vertical direction (up-down direction) at the center position RP in the front-back direction of the engine 1. Furthermore, the impact plate 133 extends substantially in the horizontal direction and causes the blow-by gas BG having passed through the filter 130 to be collided. Thus, as compared with the case where the impactor raises the flow velocity of the blow-by gas along the horizontal direction and causes the blow-by gas to collide against the impact plate extending in the vertical direction, the dimension V in the up-down direction of the blow-by gas treating device 100 can be suppressed.

Subsequently, a fourth embodiment of the present invention will be described.

Note that, when constituent elements of the blow-by gas treating device according to the fourth embodiment are similar to the constituent elements of the blow-by gas treating device according to the first embodiment, the second embodiment, and the third embodiment, duplicated explanation will be omitted as appropriate, and different points will be mainly explained below.

Essential parts of the structure of the blow-by gas treating device according to the fourth embodiment are similar to the essential parts of the structure of the blow-by gas treating device according to the third embodiment described above in relation with FIG. 7.

Figure 10:
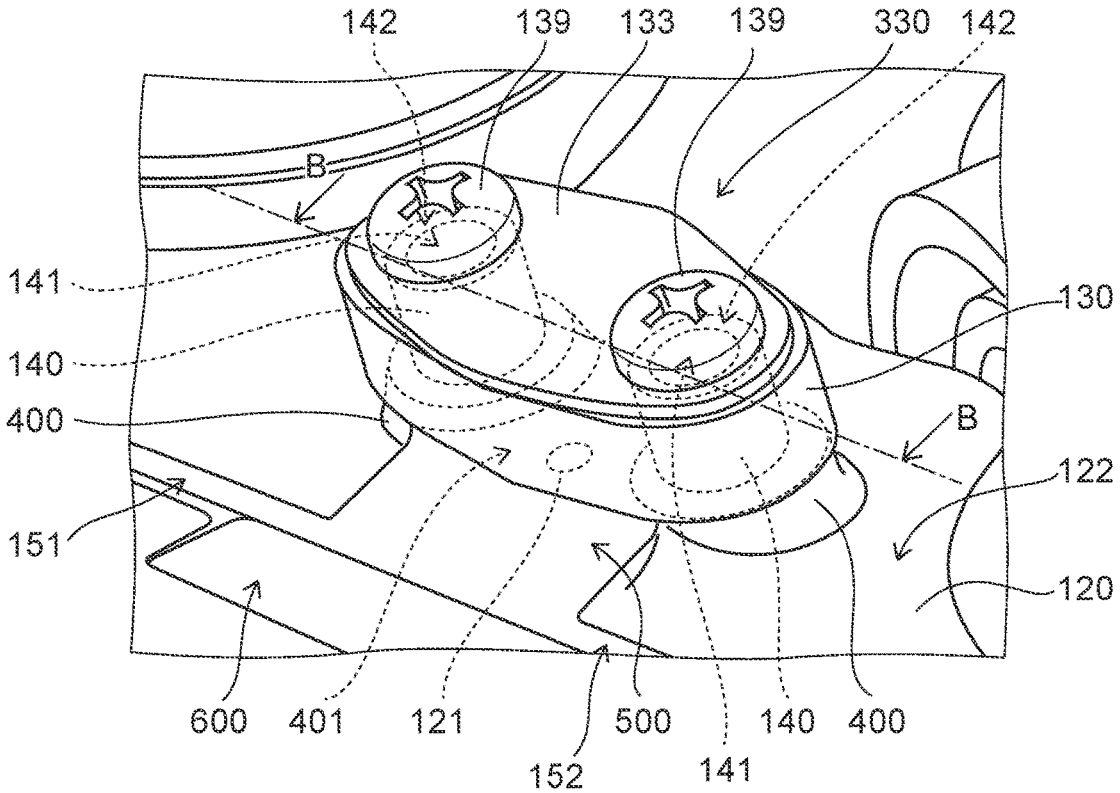
FIG. 10 is a perspective view illustrating the separating portion of the blow-by gas treating device according to this embodiment.
Figure 11:
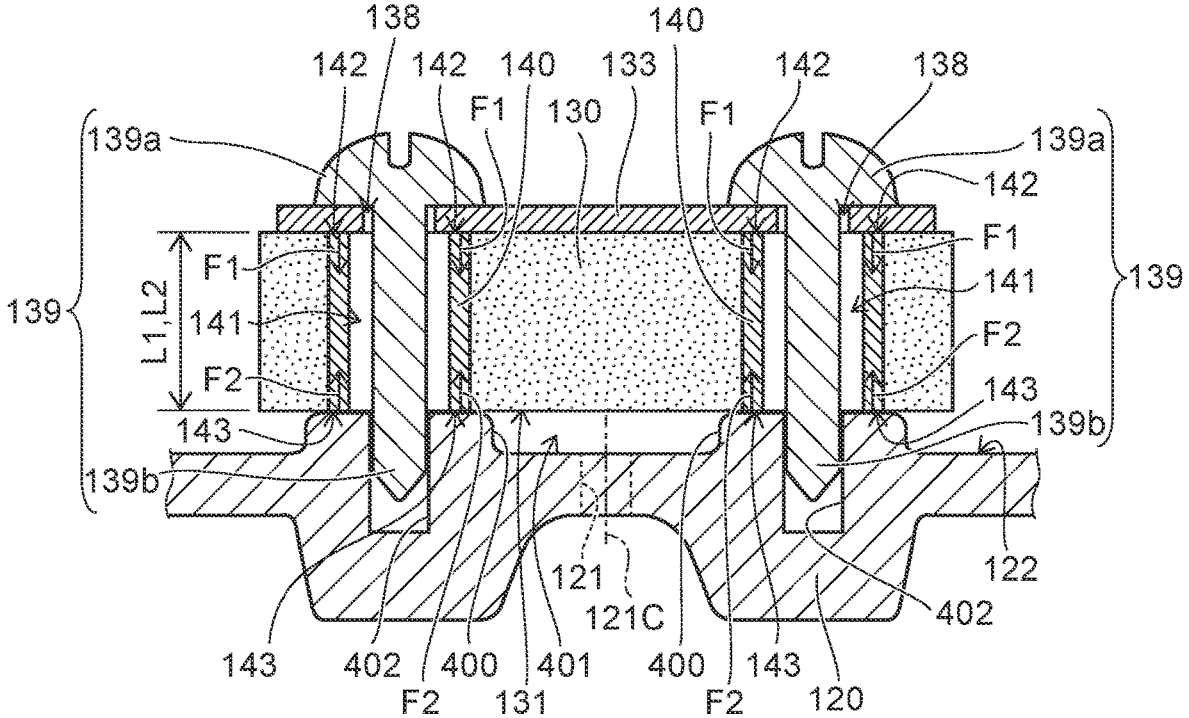
FIG. 11 is a sectional view on a cut surface B-B shown in FIG. 10.

Here, the structure example of the separating portion 330 will be mainly described by referring to FIGS. 10 to 11.

FIG. 10 is a perspective view illustrating the separating portion of the blow-by gas treating device according to this embodiment.

FIG. 11 is a sectional view on the cut surface B-B shown in FIG. 10.

The separating portion 330 shown in FIG. 10 is also called the impactor-type separator, has the impactor 120, the filter 130, and the impact plate 133 and is provided between the first blow-by gas taking-in portion 111 and the second blow-by gas taking-in portion 112 in the front-back direction of the engine 1. More specifically, the separating portion 330 is provided at a center part between the first oil drain 161 and the second oil drain 162 in the front-back direction of the engine 1, that is, at the center position RP.

The impactor 120 has a function of a nozzle or an orifice. A direction of the axis 121C of the throttle hole 121 of the impactor 120 is along the vertical direction, which is the Z-direction, or the up-down direction, and it is a so-called vertical throttle hole. The impactor 120 is the flow-velocity rise operating portion which can raise the flow velocity of the blow-by gas BG by having the blow-by gas BG passed upward along the throttle hole 121. The impactor 120 is disposed at the center position RP with respect to the X-direction of the partition wall portion 200. As a result, the blow-by gas BG taken in by the first blow-by gas taking-in portion 111 and the blow-by gas BG taken in by the second blow-by gas taking-in portion 112 are uniformly guided to the impactor 120. The impactor 120 raises the flow velocity of the blow-by gas BG flowing in the throttle hole 121 and then, leads the blow-by gas BG to the filter 130. Note that the direction of the axis 121C of the throttle hole 121 is not limited to the vertical direction or the up-down direction but may be inclined with respect to the Z-direction.

As shown in FIGS. 10 to 11, the filter 130 is replaceably mounted on the partition wall portion 200, that is, on the setting portions 400, 400 of the impactor 120. The filter 130 is a member for improving the performance of separating the oil OL from the blow-by gas BG (that is, the separation performance of the oil OL) and is made of a material such as glass wool, steel wool or the like, for example. However, the material of the filter 130 is not particularly limited. The filter 130 is fixed by the screws 139, 139 for mounting so as to be sandwiched between the impact plate 133 and the setting portions 400, 400 of the impactor 120. That is, on the lower surface of the filter 130, the impactor 120 as the flow-velocity rise operating portion is disposed. On the upper surface of the filter 130, the impact plate 133 is disposed. The impact plate 133 is a metal plate, for example, and extends in a parallel direction with respect to the upper surface 122 of the impactor 120. The impact plate 133 has the screw holes 138, 138 through which the two screws 139, 139 for mounting are passed, for example. The screw 139 of this embodiment is an example of the "fastening member" of the present invention.

As shown in FIGS. 10 and 11, the setting portions 400, 400, each having a protruding shape protruding outward from the upper surface 122 of the impactor 120, are provided on the upper surface 122 of the impactor 120. The setting portions 400, 400 are portions for causing the filter 130 and the impact plate 133 to be inclined downward toward the first oil-guiding groove portion 151 and the second oil-guiding groove portion 152 and specifically, are portions for removably fixing the filter 130 and the impact plate 133 in a state inclined by a predetermined inclination angle. However, the setting portions 400, 400 do not necessarily have to incline the filter 130 and the impact plate 133 downward toward the first oil-guiding groove portion 151 and the second oil-guiding groove portion 152. The setting portions 400, 400 are formed so as to rise in a circular shape on the upper surface 122 of the impactor 120. The position of each of the setting portions 400, 400 corresponds to each of the positions of the screw holes 138, 138 of the impact plate 133, respectively. Each of the setting portions 400, 400 is provided with inclination in the direction in which the oil OL having been separated from the blow-by gas BG is led to the first oil-guiding groove portion 151 and the second oil-guiding groove portion 152 as the oil guiding portions.

As shown in FIG. 10, between the two setting portions 400, 400, the oil-guiding clearance region 401 is formed. The oil-guiding clearance region 401 is a space formed between the upper surface 122 of the impactor 120 and a lower surface 131 of the filter 130. That is, the setting portions 400, 400 form the oil-guiding clearance region 401 as the space between the upper surface 122 of the impactor 120 and the lower surface 131 of the filter 130. As shown in FIG. 11, the throttle hole 121 is provided so as to penetrate the portion of the impactor 120 in the oil-guiding clearance region 401. The throttle hole 121 of the impactor 120 raises the flow velocity of the blow-by gas BG along an upper direction and supplies it to the filter 130. In the setting portions 400, 400, the female thread portion 402 is provided, respectively. Each of the screws 139 for mounting passes through the screw hole 138 of the impact plate 133 and the filter 130 and is fastened to the female thread portion 402 of the setting portion 400. As a result, the filter 130 is removably fixed between the impact plate 133 and the setting portion 400 of the impactor 120. In other words, the screw 139 holds the filter 130 between the impact plate 133 and the setting portion 400 of the impactor 120 by being fastened to the female thread portion 402 provided on the setting portion 400.

Here, by considering removal prevention and improvement of holding performance of the filter 130, as described above, the filter 130 is preferably held by using the fastening member such as the screw 139. However, as described above, the filter 130 is made of a material such as glass wool, steel wool or the like, for example. Therefore, when the filter 130 is held simply by using the fastening member, a deformation amount of the filter 130 is varied depending on the torque of the fastening member. Then, the shape of the filter 130 is not stable. As a result, if the filter 130 is held simply by using the fastening member, the separation performance of the oil OL might be unstable in some cases.

In contrast, as shown in FIGS. 10 and 11, in the blow-by gas treating device 100 according to this embodiment, a deformation suppressing member 140 is disposed between the setting portion 400 of the impactor 120 and the impact plate 133. The deformation suppressing member 140 is formed of metal, for example, and suppresses deformation of the filter 130 caused by fastening of the screw 139. The deformation suppressing member 140 is a cylindrical member having a hole 141. Here, the "cylindrical member" in the description of the present application is not limited only to a member in which a sectional shape of a hole in the perpendicular direction to the longitudinal direction of the member is circular but is supposed to include members with sectional shapes of the holes in the perpendicular direction to the longitudinal direction of the polygonal member such as a triangle, a square, a pentagon, and a hexagon. In FIG. 10, as an example of the deformation suppressing member 140, a cylindrical member having the hole 141 whose sectional shape is circular is illustrated. However, the example of the deformation suppressing member 140 is not limited only to this but may be a square prism member having a hole whose sectional shape is a polygon. As shown in FIG. 11, an axis of the hole 141 of the deformation suppressing member 140 is present on substantially the same straight line as the axis of the screw hole 138 provided in the impact plate 133 and the axis of the female thread portion 402 provided on the setting portion 400. And the hole 141 of the deformation suppressing member 140 has a shaft part 139*b* of the screw 139 passed.

That is, as shown in FIG. 11, the screw 139 has the shaft part 139*b* fastened to the female thread portion 402 provided on the setting portion 400 of the impactor 120 and a head part 139*a* provided on one of end portions of the shaft part 139*b*. And as shown in FIG. 11, the deformation suppressing member 140 is disposed between the setting portion 400 of the impactor 120 and the head part 139*a* of the screw 139 in a state where the shaft part 139*b* of the screw 139 is passed through the hole 141.

As shown in FIG. 11, the deformation suppressing member 140 receives a force F1 transmitted from the head part 139*a* of the screw 139 through the impact plate 133 caused by fastening of the screw 139 and a force F2 transmitted from the setting portion 400 of the impactor 120 caused by the fastening of the screw 139 by end portions 142, 143 of the cylindrical members. Specifically, the deformation suppressing member 140 receives the force F1 transmitted from the head part 139*a* of the screw 139 through the impact plate 133 caused by the fastening of the screw 139 by one of end portions (upper end portions in FIG. 11) 142. Moreover, the deformation suppressing member 140 receives the force F2 transmitted from the setting portion 400 of the impactor 120 caused by the fastening of the screw 139 by the other end portions (lower end portions in FIG. 11) 143. In this way, the deformation suppressing member 140 suppresses deformation of the filter 130 caused by the fastening of the screw 139. A length L1 in the direction of the axis of the hole 141 of the deformation suppressing member 140 is equal to a thickness L2 of the filter 130.

The blow-by gas BG has the flow velocity raised by flowing into the throttle hole 121 of the impactor 120 and rising toward an upper direction. The blow-by gas BG whose flow velocity has been raised passes through the filter 130, whereby foreign substances are removed, and collides against the lower surface of the impact plate 133 and is separated into the oil OL and the gas G. That is, the impact plate 133 causes the blow-by gas BG having passed through the filter 130 to be collided and separated into the oil OL and the gas G.

The gas G having been separated from the blow-by gas BG by the separating portion 330 is emitted from the filter 130. As described above, the guiding wall portion 203 is provided between the partition wall portion 200 and the upper surface portion 4A of the head cover 4. Thus, the gas G emitted from the filter 130 and not containing the mist of the oil OL is guided by the guiding wall portion 203, passes through the passage 135 of the upper region 4Q, and is led to the outlet portion 40.

On the other hand, the oil OL having been separated from the blow-by gas BG by the separating portion 330 passes through the filter 130 and falls and drops onto the upper surface 122 of the impactor 120 in the oil-guiding clearance region 401. The oil OL having dropped on the upper surface 122 of the impactor 120 flows along the upper surface 122 of the impactor 120 in the oil-guiding clearance region 401 and flows toward the first oil-guiding groove portion 151 and the second oil-guiding groove portion 152.

The separating portion 330 having the aforementioned structure is located at the center position RP in the X-direction shown in FIG. 7 and plays a role as the collecting portion which can collect the blow-by gas BG from the front side and the rear side of the engine 1 toward the center part in the X-direction. As described above, since the separating portion 330 is located at the center position RP in relation with the X-direction of the head cover 4, in the head cover 4, it can collect the blow-by gas BG from the front side and the rear side in relation with the X-direction to the center part and can separate it into the oil OL and the gas G not containing the mist of the oil OL.

Subsequently, the oil-outlet inclined-guiding portion 500 and the oil inclined-guiding return portion 600 will be described by referring to FIG. 10.

As shown in FIG. 10, the oil-outlet inclined-guiding portion 500 is provided between the oil-guiding clearance region 401 and the first oil-guiding groove portion 151 as well as the second oil-guiding groove portion 152. The oil-outlet inclined-guiding portion 500 is connected to the upper surface 122 of the impactor 120 in the oil-guiding clearance region 401, the first oil-guiding groove portion 151, and the second oil-guiding groove portion 152 and is formed with inclination in the direction lowering from the upper surface 122 of the impactor 120 toward the first oil-guiding groove portion 151 and the second oil-guiding groove portion 152. That is, the oil-outlet inclined-guiding portion 500 is formed with inclination in the direction lowering from the upper surface 122 of the impactor 120 toward the first oil-guiding groove portion 151 and the second oil-guiding groove portion 152 in order to lead the oil OL having been separated from the blow-by gas BG by the separating portion 330 and flown along the upper surface 122 of the impactor 120 to the first oil-guiding groove portion 151 and the second oil-guiding groove portion 152 as the oil guiding portions.

An inclination angle by which the oil-outlet inclined-guiding portion 500 is inclined with respect to the horizontal plane (X-Y plane) is preferably larger than the inclination angle of the upper surface 122 of the impactor 120 with respect to the horizontal plane. Note that the upper surface 122 of the impactor 120 does not necessarily have to be inclined with respect to the horizontal plane and may be in parallel with the horizontal plane. If the inclination angle of the oil-outlet inclined-guiding portion 500 with respect to the horizontal plane is larger than the inclination angle of the upper surface 122 of the impactor 120 with respect to the horizontal plane, when the oil OL having been separated from the blow-by gas BG by the separating portion 330 and flown down along the upper surface 122 of the impactor 120 flows down the oil-outlet inclined-guiding portion 500, the flow velocity of the oil OL is higher as compared with a case where the oil OL flows on the upper surface 122 of the impactor 120. Therefore, the oil OL having been separated from the blow-by gas BG by the separating portion 330 can be rapidly led from the upper surface 122 of the impactor 120 to the first oil-guiding groove portion 151 and the second oil-guiding groove portion 152. Moreover, since it becomes difficult for the oil OL to remain on the upper surface 122 of the impactor 120, mixing of the oil OL having been separated from the blow-by gas BG by the separating portion 330 in the blow-by gas BG again can be suppressed.

Moreover, as shown in FIG. 10, the oil inclined-guiding return portion 600 is provided on a side opposite to the oil-outlet inclined-guiding portion 500 when seen from the first oil-guiding groove portion 151 and the second oil-guiding groove portion 152. That is, the oil-outlet inclined-guiding portion 500 is provided on one of sides (sides on which the separating portion 330 is provided) of the first oil-guiding groove portion 151 and the second oil-guiding groove portion 152, and the oil inclined-guiding return portion 600 is provided on the other sides of the first oil-guiding groove portion 151 and the second oil-guiding groove portion 152. The oil inclined-guiding return portion 600 is formed with inclination so as to have a counter gradient with respect to the gradient of the oil-outlet inclined-guiding portion 500 from the lowest position of the oil-outlet inclined-guiding portion 500. That is, as exemplified in FIG. 10, the oil-outlet inclined-guiding portion 500 and the oil inclined-guiding return portion 600 are formed substantially in the V-shape when seen on the section. The inclination angle of the oil inclined-guiding return portion 600 with respect to the horizontal plane is not particularly limited but is set to an angle substantially the same as the inclination angle of the oil-outlet inclined-guiding portion 500 with respect to the horizontal plane or to an angle smaller than the inclination angle of the oil-outlet inclined-guiding portion 500 with respect to the horizontal plane, for example. The inclination angle of the oil inclined-guiding return portion 600 with respect to the horizontal plane is approximately 5 degrees or more and 10 degrees or less, for example. If the inclination angle of the oil inclined-guiding return portion 600 with respect to the horizontal plane is smaller than 5 degrees, the oil OL temporarily stored or pooled in the oil inclined-guiding return portion 600 cannot be rapidly guided to the first oil-guiding groove portion 151 and the second oil-guiding groove portion 152 easily. Moreover, if the inclination angle of the oil inclined-guiding return portion 600 with respect to the horizontal plane is larger than 10 degrees, a speed at which the oil OL temporarily stored or pooled in the oil inclined-guiding return portion 600 is guided to the first oil-guiding groove portion 151 and the second oil-guiding groove portion 152 is too high, and there is a concern that the oil OL returns to the oil-outlet inclined-guiding portion 500 on the opposite side.

The oil inclined-guiding return portion 600 temporarily stores or pools the oil OL in order to prevent flow-out of the oil OL from the oil-outlet inclined-guiding portion 500, the first oil-guiding groove portion 151, and the second oil-guiding groove portion 152 by the momentum of the flow of the oil OL, when the oil OL having been separated from the blow-by gas BG by the separating portion 330 flows from the upper surface 122 of the impactor 120 via the oil-outlet inclined-guiding portion 500. Then, the oil inclined-guiding return portion 600 guides the oil OL to the first oil-guiding groove portion 151 and the second oil-guiding groove portion 152 and returns it. As described above, the oil inclined-guiding return portion 600 has a function of temporarily buffering or pooling oil for temporarily storing the oil OL having been separated from the blow-by gas BG by the separating portion 330 and guiding it to the first oil-guiding groove portion 151 and the second oil-guiding groove portion 152 and returning it.

As shown in FIG. 10, the lowest portion of the oil-outlet inclined-guiding portion 500 and the lowest portion of the oil inclined-guiding return portion 600 are connected to each other. A connection position of the oil-outlet inclined-guiding portion 500 and the oil inclined-guiding return portion 600 with each other extends along the X-direction and is located between the first oil-guiding groove portion 151 and the second oil-guiding groove portion 152.

The first oil-guiding groove portion 151 shown in FIG. 7 presents a groove shape and is provided from the front surface portion 4B of the head cover 4 to the vicinity of the filter 130 and is inclined downward from the filter 130 toward the front surface portion 4B of the head cover 4. Similarly, the second oil-guiding groove portion 152 presents the groove shape and is provided from the rear surface portion 4C of the head cover 4 to the vicinity of the filter 130 and is inclined downward from the filter 130 toward the rear surface portion 4C of the head cover 4. The first oil-guiding groove portion 151 and the second oil-guiding groove portion 152 guide the oil OL having been separated from the blow-by gas BG by the separating portion 330. The first oil-guiding groove portion 151 is a specific structure example of the "first oil guiding portion" of the present invention and can guide the oil OL emitted from the filter 130 to the front indicated by the X1-direction when the engine 1 in FIG. 1 is inclined to the front side and can lead it to the first oil drain 161 on the front side. Similarly, the second oil-guiding groove portion 152 is a specific structure example of the "second oil guiding portion" of the present invention and can guide the oil OL emitted from the filter 130 to the rear indicated by the X2-direction when the engine 1 in FIG. 1 is inclined to the rear side and can lead it to the second oil drain 162 on the rear side.

The first oil-guiding groove portion 151 and the second oil-guiding groove portion 152 are connected to each other through the aforementioned oil-outlet inclined-guiding portion 500 and the oil inclined-guiding return portion 600.

The first oil drain 161 is provided on the front side of the engine 1 and presents a cylindrical shape, for example. The first oil drain 161 is provided downward, which is the Z1-direction in the head cover 4, at the front position of the first guiding lower-surface portion 231 of the partition wall portion 200. The first oil drain 161 has a check valve, temporarily stores the oil OL having been guided by the first oil-guiding groove portion 151 and discharges it into the engine 1. Similarly, the second oil drain 162 is provided on the rear side of the engine 1 and presents a cylindrical shape, for example. The second oil drain 162 is provided downward, which is the Z1-direction in the head cover 4, at the rear position of the second guiding lower-surface portion 232 of the partition wall portion 200. The second oil drain 162 has a check valve, temporarily stores the oil OL having been guided by the second oil-guiding groove portion 152 and discharges it into the engine 1.

As a result, if the engine 1 is inclined to the front side, the oil OL having been separated from the blow-by gas BG by the separating portion 330 is guided in the X1-direction by the first oil-guiding groove portion 151, is temporarily stored in the first oil drain 161 and then, is discharged in the Z1-direction through the first oil drain 161. Similarly, if the engine 1 is inclined to the rear side, the oil OL having been separated from the blow-by gas BG by the separating portion 330 is guided in the X2-direction by the second oil-guiding groove portion 152, is temporarily stored in the second oil drain 162 and then, is discharged in the Z1-direction through the second oil drain 162. In the head cover 4, the oil OL having been discharged from the first oil drain 161 and the second oil drain 162 is recovered by the oil pun 7 from the head cover 4 shown in FIG. 1, for example, through the aforementioned oil return path 99. Alternatively, the discharged oil OL can be also recovered by the oil container, not shown, for example. As a result, the oil OL discharged from the first oil drain 161 and the second oil drain 162 is discharged into the engine 1 and does not leak to the outside of the engine 1.

As described above, according to the blow-by gas treating device 100 and the engine 1 according to this embodiment, the filter 130 of the separating portion 330 which separates the blow-by gas BG into the oil OL and the gas G is held between the setting portion 400 of the impactor 120 and the impact plate 133 by fastening of the screw 139 with the female thread portion 402 provided on the setting portion 400 of the impactor 120. Here, the deformation suppressing member 140 is disposed between the setting portion 400 of the impactor 120 and the impact plate 133. The deformation suppressing member 140 suppresses deformation of the filter 130 held between the setting portion 400 of the impactor 120 and the impact plate 133 caused by the fastening of the screw 139. As a result, when the filter 130 is held by using the screw 139, the deformation of the filter 130 can be suppressed. For example, variation in a deformation amount of the filter 130 in accordance with the torque of the screw 139 or an unstable shape of the filter 130 can be suppressed. As a result, when the filter 130 is held by using the screw 139, stable separation performances of the oil OL can be realized.

Moreover, the deformation suppressing member 140 is a cylindrical member having the hole 141 through which the shaft part 139*b* of the screw 139 is passed. And the deformation suppressing member 140 is disposed between the setting portion 400 of the impactor 120 and the head part 139*a* of the screw 139 in the state where the shaft part 139*b* of the screw 139 is passed through the hole 141 of the deformation suppressing member 140. Thus, the deformation suppressing member 140 can receive the forces F1, F2 transmitted from the setting portion 400 of the impactor 120 and the head part 139*a* of the screw 139 caused by the fastening of the screw 139 between the setting portion 400 of the impactor 120 and the head part 139*a* of the screw 139. Thus, the deformation suppressing member 140 can suppress deformation of the filter 130 held between the setting portion 400 of the impactor 120 and the impact plate 133 caused by the fastening of the screw 139 more reliably. As a result, when the filter 130 is held by using the screw 139, the stable separation performances of the oil OL can be realized more reliably.

Moreover, the deformation suppressing member 140 receives the force F1 transmitted from the head part 139*a* of the screw 139 through the impact plate 133 caused by the fastening of the screw 139 by one of the end portions (the upper end portions in FIG. 11) 142, and receives the force F2 transmitted from the setting portion 400 of the impactor 120 caused by the fastening of the screw 139 by the other end portions (the lower end portions in FIG. 11) 143. Thus, the deformation suppressing member 140 can receive the force F1 which is the force transmitted from the head part 139*a* of the screw 139 and is made relatively uniform through the impact plate 133 by the one end portions 142. Thus, the deformation suppressing member 140 can suppress the deformation of the filter 130 held between the setting portion 400 of the impactor 120 and the impact plate 133 caused by the fastening of the screw 139 more reliably. As a result, when the filter 130 is held by using the screw 139, the stable separation performances of the oil OL can be realized more reliably.

Moreover, the length L1 in the axial direction of the hole 141 of the deformation suppressing member 140 is equal to the thickness L2 of the filter 130. Therefore, the deformation suppressing member 140 can suppress such a state that the filter 130 is crushed to a length shorter than the length L1 in the axial direction of the hole 141 of the deformation suppressing member 140. Thus, the variation in the deformation amount of the filter 130 in accordance with the torque of the screw 139 can be suppressed more reliably. As a result, when the filter 130 is held by using the screw 139, the stable separation performances of the oil OL can be realized.

The embodiments of the present invention have been described. However, the present invention is not limited to the aforementioned embodiments but is capable of various changes within a range not departing from the scope of claims. The constitutions of the aforementioned embodiments can be partially omitted or optionally combined differently from the above.

For example, as an example of the engine of the present invention, the engine 1 according to this embodiment is exemplified. The engine 1 is a supercharging-type diesel engine with a turbocharger. However, this is not limiting, and the engine of the present invention may be a natural-intake type diesel engine, a supercharging-type gasoline engine with a turbocharger, a natural-intake type gasoline engine and the like. Moreover, the type of the illustrated engine 1 is a multi-cylinder engine such as a supercharging-type three-cylinder engine, a four-cylinder engine and the like with a turbocharger with high outputs, for example. However, the type of the engine 1 is not limited only to them. The engine 1 can be mounted on vehicles of types other than the vehicles such as a construction machine, an agricultural machine, and a lawn mower, for example. Moreover, in the description of this embodiment, the first oil-guiding groove portion 151 is exemplified as the first oil guiding portion, and the second oil-guiding groove portion 152 is exemplified as the second oil guiding portion. However, the first oil guiding portion and the second oil guiding portion are not limited only to them but may be pipe-shaped members, for example.

For example, in this embodiment, the case where the deformation suppressing member 140 is a cylindrical member was cited as an example. However, the deformation suppressing member 140 is not limited to a cylindrical member but may be a semi-cylindrical member obtained by cutting the cylindrical member into halves along the axis of the hole 141, for example. Moreover, in this embodiment, the case in which the two deformation suppressing members 140 are provided was cited as an example. However, the number of the installed deformation suppressing members 140 is not limited to two but may be one or three or more.

| [Reference Signs List] | |
|---|---|
| 1 | Engine |
| 2 | Cylinder block |
| 3 | Cylinder head |
| 4 | Head cover |
| 4A | Upper surface portion |
| 4B | Front surface portion |
| 4C | Rear surface portion |
| 4D | Left and right surface portion |
| 4P | Lower region |
| 4Q | Upper region |
| 4R | Upper region |
| 5 | Cylinder |
| 6 | Crank case |
| 7 | Oil pun |
| 8 | Piston |
| 9 | Crank shaft |
| 10 | Conrod |
| 11 | Valve cam chamber |
| 12 | Valve cam shaft |
| 13 | Tappet |
| 14 | Tappet guide hole |
| 15 | Push rod |
| 16 | Insertion hole |
| 17 | Rocker arm |
| 18 | Spring |
| 19 | Intake valve |
| 20 | Exhaust valve |
| 21 | Oil flow-out hole |
| 22 | Oil drop hole |
| 30 | Intake passage |
| 31 | Exhaust passage |
| 40 | Outlet portion |
| 41 | Pipe |
| 50 | Intake pipe |
| 50T | Connecting pipe |
| 52 | Air cleaner |
| 60 | Turbocharger |
| 61 | Blower |
| 62 | Turbine |
| 70 | Blow-by gas mixing joint |
| 71 | Main pipe |
| 72 | Sub pipe |
| 99 | Oil return path |
| 100 | Blow-by gas treating device |
| 101 | Main structure portion |
| 111 | First blow-by gas taking-in portion |
| 112 | Second blow-by gas taking-in portion |
| 120 | Impactor |
| 121 | Throttle hole |
| 121C | Axis |
| 122 | Upper surface |
| 130 | Filter |
| 131 | Lower surface |
| 133 | Impact plate |
| 135 | Passage |
| 138 | Screw hole |
| 139 | Screw |
| 139a | Head part |
| 139b | Shaft part |
| 140 | Deformation suppressing member |

-continued

| [Reference Signs List] | |
|---|---|
| 141 | Hole |
| 142 | End portion |
| 143 | End portion |
| 151 | First oil-guiding groove portion |
| 152 | Second oil-guiding groove portion |
| 161 | First oil drain |
| 162 | Second oil drain |
| 200 | Partition wall portion |
| 203 | Guiding wall portion |
| 231 | First guiding lower-surface portion |
| 232 | Second guiding lower-surface portion |
| 295 | Guiding plate |
| 330 | Separating portion |
| 350 | Pressure regulation valve |
| 400 | Setting portion |
| 401 | Oil-guiding clearance region |
| 402 | Female thread portion |
| 500 | Oil-outlet inclined-guiding portion |
| 600 | Oil inclined-guiding return portion |
| 601 | Step |
| 680 | Through hole |
| 681 | Inner peripheral surface |
| 700 | Outlet mounting portion |
| 702 | Upper surface |
| 720 | Internal space |
| 721 | Internal space |
| 730 | Mating surface |
| 740 | Oil-guiding inclined surface |
| 741 | Upper end portion |
| 742 | Lower end portion |
| 745 | Seal member |
| 750 | Container body |
| 751 | Screw |
| 770 | Mating surface |
| AR | Intake |
| B | Intake air |
| BG | Blow-by gas |
| C | Intake air |
| F1 | Force |
| F2 | Force |
| G | Gas |
| OL | Oil |
| RP | Center position |
| S | Intersection connection position |

The invention claimed is:

1. A blow-by gas treating device for treating a blow-by gas generated in an engine, the device comprising: a main structure portion which is provided in a head cover of the engine, takes in and guides the blow-by gas, and separates from the blow-by gas an oil contained in the blow-by gas; and an outlet portion which supplies the gas, which is a gas after the oil has been separated from the blow-by gas by the main structure portion and has been guided from the main structure portion, to an intake system of the engine, wherein the main structure portion has: a first blow-by gas taking-in portion provided on a front side of the engine and taking in the blow-by gas; a second blow-by gas taking-in portion provided on a rear side of the engine and taking in the blow-by gas; a separating portion provided between the first blow-by gas taking-in portion and the second blow-by gas taking-in portion in a front-back direction of the engine and separating the blow-by gas, having been taken in by the first blow-by gas taking-in portion and the second blow-by gas taking-in portion, into the oil and the gas; a first oil guiding portion which is provided from the separating portion toward the front side and guides the oil, having been separated from the blow-by gas by the separating portion, to the front side; a second oil guiding portion which is provided from the separating portion toward the rear side and guiding the oil, having been separated from the blow-by gas by the separating portion, to the rear side; a first oil drain which is provided on the front side, temporarily stores the oil having been guided by the first oil guiding portion and discharges the oil into the engine; a second oil drain which is provided on the rear side, temporarily stories the oil having been guided by the second oil guiding portion and discharges the oil into the engine; wherein the separating portion has: a flow-velocity rise operating portion which raises a flow velocity of the blow-by gas along a vertical direction; a filter through which the blow-by gas, the flow velocity of which has been raised by the flow-velocity rise operating portion, is passed; and an impact plate which extends in a horizontal direction and causes the blow-by gas having passed the filter to be collided and separated into the oil and the gas.

2. The blow-by gas treating device according to claim 1, wherein the separating portion is provided at a center part between the first oil drain and the second oil drain in the front-back direction.

3. The blow-by gas treating device according to claim 1, wherein the first oil guiding portion and the second oil guiding portion exhibit a groove shape.

4. The blow-by gas treating device according to claim 1, wherein the main structure portion has a partition wall portion disposed horizontally along the front-back direction;

the first blow-by gas taking-in portion and the second blow-by gas taking-in portion are provided on a lower surface side of the partition wall portion; and the first oil guiding portion and the second oil guiding portion are provided on an upper surface side of the partition wall portion.

5. The blow-by gas treating device according claim 1, wherein, the oil-guiding inclined surface is formed over an entire region from the mating surface to an inner surface of the through hole.

6. The blow-by gas treating device according to claim 1, wherein the oil-guiding inclined surface exhibits a part of a surface of a pyramid.

7. The blow-by gas treating device according to claim 1, further comprising: a guiding wall portion which is provided in the head cover and guides the gas after having been separated from the blow-by gas to the outlet portion, wherein the oil having been guided by the oil guiding surface into the head cover from the outlet portion flows on the guiding wall portion and is led to at least one of the first oil guiding portion and the second oil guiding portion.

8. The blow-by gas treating device according to claim 1, wherein the separating portion is provided with inclination in a direction in which the oil having been separated from the blow-by gas by the separating portion is led to the first oil guiding portion and the second oil guiding portion.

9. The blow-by gas treating device according to claim 8, wherein the separating portion has:

a flow-velocity rise operating portion which raises a flow velocity of the blow-by gas along a direction inclined with respect to a vertical direction;

a filter through which the blow-by gas, the flow velocity of which has been raised by the flow-velocity rise operating portion, is passed; and an impact plate which causes the blow-by gas having passed the filter to be collided and separated into the oil and the gas, wherein a surface of the flow-velocity rise operating portion faced with the impact plate is inclined downward toward the first oil guiding portion and the second oil guiding portion.

10. The blow-by gas treating device according to claim 1, wherein the separating portion has:

a flow-velocity rise operating portion which raises a flow velocity of the blow-by gas;

a filter through which the blow-by gas, the flow velocity of which has been raised by the flow-velocity rise operating portion, is passed;

an impact plate which causes the blow-by gas having passed through the filter to be collided and separated into the oil and the gas;

a fastening member which is fastened to the flow-velocity rise operating portion and holds the filter between the flow-velocity rise operating portion and the impact plate; and a deformation suppressing member which is disposed between the flow-velocity rise operating portion and the impact plate and suppresses deformation of the filter caused by the fastening of the fastening member.

11. The blow-by gas treating device according to claim 10, wherein the fastening member has:

a shaft part fastened to the flow-velocity rise operating portion; and a head part provided on one of end portions of the shaft part, wherein the deformation suppressing member is a cylindrical member having a hole through which the shaft part is passed and is disposed between the flow-velocity rise operating portion and the head part in a state where the shaft part is passed through the hole.

12. The blow-by gas treating device according to claim 2, wherein the first oil guiding portion and the second oil guiding portion exhibit a groove shape.

13. The blow-by gas treating device according to claim 2, wherein the main structure portion has a partition wall portion disposed horizontally along the front-back direction;

the first blow-by gas taking-in portion and the second blow-by gas taking-in portion are provided on a lower surface side of the partition wall portion; and the first oil guiding portion and the second oil guiding portion are provided on an upper surface side of the partition wall portion.

14. The blow-by gas treating device according to claim 2, wherein the separating portion has:

a flow-velocity rise operating portion which raises a flow velocity of the blow-by gas along a vertical direction;

a filter through which the blow-by gas, the flow velocity of which has been raised by the flow-velocity rise operating portion, is passed; and an impact plate which extends in a horizontal direction and causes the blow-by gas having passed the filter to be collided and separated into the oil and the gas.

15. The blow-by gas treating device according to claim 5, wherein the oil-guiding inclined surface exhibits a part of a surface of a pyramid.

16. The blow-by gas treating device according to claim 1, further comprising: a guiding wall portion which is provided in the head cover and guides the gas after having been separated from the blow-by gas to the outlet portion, wherein the oil having been guided by the oil guiding surface into the head cover from the outlet portion flows on the guiding wall portion and is led to at least one of the first oil guiding portion and the second oil guiding portion.

17. An engine comprising a blow-by gas treating device for treating a blow-by gas generated in the engine, wherein the blow-by gas treating device has: a main structure portion which is provided in a head cover of the engine, takes in and guides the blow-by gas, and separates from the blow-by gas an oil contained in the blow-by gas; and an outlet portion which supplies the gas, which is a gas after the oil has been separated from the blow-by gas by the main structure portion and has been guided from the main structure portion, to an intake system of the engine, wherein the main structure portion has: a first blow-by gas taking-in portion provided on a front side of the engine and taking in the blow-by gas; a second blow-by gas taking-in portion provided on a rear side of the engine and taking in the blow-by gas; a separating portion provided between the first blow-by gas taking-in portion and the second blow-by gas taking-in portion in a front-back direction of the engine and separating the blow-by gas, having been taken in by the first blow-by gas taking-in portion and the second blow-by gas taking-in portion, into the oil and the gas; a first oil guiding portion which is provided from the separating portion toward the front side and guides the oil, having been separated from the blow-by gas by the separating portion, to the front side; a second oil guiding portion which is provided from the separating portion toward the rear side and guiding the oil, having been separated from the blow-by gas by the separating portion, to the rear side; a first oil drain which is provided on the front side, temporarily stores the oil having been guided by the first oil guiding portion and discharges the oil into the engine; a second oil drain which is provided on the rear side, temporarily stories the oil having been guided by the second oil guiding portion and discharges the oil into the engine; wherein the outlet portion has an oil guiding surface for guiding the oil remaining in the gas after having been separated from the blow-by gas into the head cover, wherein the separating portion has: a flow-velocity rise operating portion which raises a flow velocity of the blow-by gas along a vertical direction; a filter through which the blow-by gas, the flow velocity of which has been raised by the flow-velocity rise operating portion, is passed; and an impact plate which extends in a horizontal direction and causes the blow-by gas having passed the filter to be collided and separated into the oil and the gas.

18. A blow-by gas treating device for treating a blow-by gas generated in an engine, the device comprising: a main structure portion which is provided in a head cover of the engine, takes in and guides the blow-by gas, and separates from the blow-by gas an oil contained in the blow-by gas; and an outlet portion which supplies the gas, which is a gas after the oil has been separated from the blow-by gas by the main structure portion and has been guided from the main structure portion, to an intake system of the engine, wherein the main structure portion has: a first blow-by gas taking-in portion provided on a front side of the engine and taking in the blow-by gas; a second blow-by gas taking-in portion provided on a rear side of the engine and taking in the blow-by gas; a separating portion provided between the first blow-by gas taking-in portion and the second blow-by gas taking-in portion in a front-back direction of the engine and separating the blow-by gas, having been taken in by the first blow-by gas taking-in portion and the second blow-by gas taking-in portion, into the oil and the gas; a first oil guiding portion which is provided from the separating portion toward the front side and guides the oil, having been separated from the blow-by gas by the separating portion, to the front side; a second oil guiding portion which is provided from the separating portion toward the rear side and guiding the oil, having been separated from the blow-by gas by the separating portion, to the rear side; a first oil drain which is provided on the front side, temporarily stores the oil having been guided by the first oil guiding portion and discharges the oil into the engine; a second oil drain which is provided on the rear side, temporarily stories the oil having been guided by the second oil guiding portion and discharges the oil into the engine; wherein, the outlet portion has: an outlet mounting portion having a through hole which is provided on an upper part of the head cover and through which the gas is passed; and a container body which is mounted on the outlet mounting portion and temporarily stores the gas having passed through the through hole and supplies the gas to the intake system, wherein the oil guiding surface is an oil-guiding inclined surface inclined downward toward the through hole from a mating surface between the outlet mounting portion and the container body.

* * * * *